US005923922A

United States Patent [19]

Ishida et al.

[11] Patent Number: 5,923,922

[45] **Date of Patent: *Jul. 13, 1999**

[54] IMAGE FORMING APPARATUS WITH FLYING TONER DETECTING DEVICE

[75] Inventors: Toshihisa Ishida, Kashiba; Katuaki Sumida, Kitakatsuragi-gun, both of Japan; Kanshiro Okamoto, Memphis, Tenn.; Jitsuo Masuda, Yamatotakada, Japan; Masato Asanuma; Katsushi Inoue, both of Nara, Japan; Toshiaki Ino; Hideji Saiko, both of Yamatokoriyama, Japan; Yasuo Kitabatake, Nara, Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/657,870

[22] Filed: May 31, 1996

[30] Foreign Application Priority Data

Jun. 2, 1995 [JP] Japan ..... 7-136867

[51] Int. Cl.[6] ..... G03G 21/00

[52] U.S. Cl. ..... 399/98; 399/53

[58] Field of Search ..... 399/49, 61, 64, 399/65, 91, 98, 53

[56] References Cited

U.S. PATENT DOCUMENTS

| | | | |
|---|---|---|---|
| 4,447,145 | 5/1984 | Snelling et al. | 399/65 |
| 4,982,233 | 1/1991 | Lehman et al. | 399/32 |
| 5,028,959 | 7/1991 | Gooray . | |
| 5,097,293 | 3/1992 | Seto et al. | 399/11 |
| 5,270,784 | 12/1993 | Nakane et al. | 399/49 |
| 5,602,629 | 2/1997 | Saito et al. | 399/58 |

FOREIGN PATENT DOCUMENTS

| | | |
|---|---|---|
| 0 086 594 A2 | 8/1983 | European Pat. Off. . |
| 0 584 744 A2 | 3/1994 | European Pat. Off. . |
| 40 08519 A1 | 9/1990 | Germany . |
| 57-040270 | 3/1982 | Japan . |
| 01035466 | 2/1989 | Japan . |
| 3-063685 | 3/1991 | Japan . |
| 3-114069 | 5/1991 | Japan . |
| 4-051254 | 2/1992 | Japan . |
| 04067074 | 3/1992 | Japan . |
| 06075479 | 3/1994 | Japan . |

OTHER PUBLICATIONS

Bares, J. "Machine Dirt Sensor" Xerox Disclosure Journal, vol. 14, No. 2, Mar. 1989, p. 63.

*Primary Examiner*—Robert Beatty

*Attorney, Agent, or Firm*—Dike, Bronstein, Roberts & Cushman, LLP; David G. Conlin; George W. Neuner

[57] ABSTRACT

An image forming apparatus has a developer container, a development device for developing a latent image formed on a surface of a photoreceptor drum by supplying toner to the latent image, and an agitation roller for supplying toner to the development device and agitating the toner in the developer container. The development device and the agitation roller are installed in the developer container. Moreover, the image forming apparatus includes a flying toner detecting device for detecting an amount of toner flying from the development device, and a control unit for controlling various developer operations such as the toner related agitating operation of the agitation roller, toner supply amount, etc. in response to a result of a detection performed by the flying toner detecting device. This structure prevents the toner from flying from the development device.

70 Claims, 42 Drawing Sheets

DURING FLYING TONER PREVENTIVE PROCESSING

DURING NORMAL OPERATION

IMAGE FORMING APPARATUS WITH FLYING TONER DETECTING DEVICE

FIELD OF THE INVENTION

The present invention relates to an image forming apparatus such as an electrophotographic device adopting a development system using one-component developer or two-component developer.

BACKGROUND OF THE INVENTION

With an electrophotographic process, a desired image is formed on a transfer material as follows. First, light from a copy lamp is applied to an image on a document, and a photoreceptor is charged to a predetermined potential by an electrostatic charger. Subsequently, reflected light from the image on the document is irradiated on the photoreceptor to form an electrostatic latent image. After developing the electrostatic latent image into a visible toner image with developer in a development device, the toner image is transferred to a transfer material by a transfer charger.

When an extremely large number of copies of the image are produced through the above-mentioned process, the developer deteriorates and causes flying toner. The flying toner makes a wide range of components, such as an optical system having a mirror and a lens, image forming processing elements including various chargers and a development device, and paper feed and transport systems dirty. Such dirt deteriorates the development characteristic, and degrades the image quality.

In recent years, in order to solve the above-mentioned problem, Japanese Publication for Unexamined Patent Application No. 67074/1992 (Tokukaihei 4-67074) proposed a technique for detecting the dirt on.a charger 202 with an optical sensor 201 as shown in FIG. 42. Moreover, as illustrated in FIG. 43, Japanese Publication for Unexamined Patent Application No. 75479/1994 (Tokukaihei 6-75479) proposed a technique for detecting a fog on a photoreceptor 303 by optical sensors 301 and 302, adjusting the amount of light from the copy lamp or the developing bias, and controlling the agitation of developer.

However, the above conventional image forming apparatuses do not fully consider a structure for satisfactorily preventing flying toner that makes the inside of the apparatus dirty. Therefore, such apparatuses cannot sufficiently prevent the dirt inside the apparatuses caused by the flying toner.

SUMMARY OF THE INVENTION

It is an object of the present invention to provide an image forming apparatus capable of satisfactorily preventing flying toner and forming a high-quality image in a stable manner.

In order to achieve the above object, an image forming apparatus of the present invention includes:

- a development device for supplying developer to a latent image formed on a surface of a recording medium to develop the latent image;
- a flying toner detecting device for detecting an amount of toner flying from the development device; and
- a controlling device for shifting a set value relating to flying toner in a direction of reducing the flying toner when an amount of flying toner detected by the flying toner detecting device reaches or exceeds a predetermined value.

In this structure, when the amount of flying toner detected by the flying toner detecting device is not lower than a predetermined level, the controlling device shifts the set value relating to the flying toner in the direction of reducing the flying toner. It is thus possible to prevent the toner from flying from the development device.

Another image forming apparatus of the present invention includes:

- a development device having
- a toner containing section,
- a development roller, installed in the toner containing section, for supplying developer to a latent image formed on a surface of a recording medium to develop the latent image,
- an agitator, installed in the toner containing section, for supplying toner to the development roller and for agitating toner in the toner containing section;
- the flying toner detecting device for detecting an amount of toner flying from the development device; and
- a controlling device for controlling agitation of toner performed by the agitator in response to a result of a detection performed by the flying toner detecting device.

In this structure, the agitation of toner by the agitator is controlled by the controlling device in response to a result of a detection performed by the flying toner detecting device. For example, when the amount of flying toner detected by the flying toner detecting device is not lower than a predetermined level, the controlling device controls the agitator to perform an agitating operation. As a result, the toner in the toner containing section is agitated, has in increased amount of electrostatic charges, and can hardly fly from the toner containing section due to the electrostatic force. It is thus possible to prevent the toner from flying from the development device.

Still another image forming apparatus of the present invention includes:

- a development device having
- a toner containing section,
- an agitator for agitating toner in the toner containing section,
- a toner density detecting device for detecting a toner density in the toner containing section, and
- a toner supply section for supplying toner into the toner containing section in response to a result of a detection performed by the toner density detecting device, the development device developing a latent image formed on a surface of a recording medium with the toner in the toner containing section;
- a flying toner detecting device for detecting an amount of toner flying from the development device; and
- the controlling device for controlling a toner supply operation performed by the toner supply section in response to a result of a detection executed by the flying toner detecting device.

In this structure, the supply of the toner to the toner containing section from the toner supply section is performed in response to a toner density in the toner containing section detected by the flying toner detecting device under the control of the controlling device. For example, when the amount of flying toner detected by the flying toner detecting device is not lower than a predetermined value, the controlling device controls the toner supply section to reduce the amount of the toner to be supplied. As a result, the amount of the toner in the toner containing section decreases, and the toner in the toner containing section is agitated in an improved manner. Consequently, the amount of electrostatic charges of the toner in the toner containing section is increased, and the toner can hardly fly from the toner containing section due to the electrostatic force. It is thus possible to prevent the toner from flying from the development device.

A yet another image forming apparatus of the present invention includes:

a development device having a toner containing section, a development roller, installed in the toner containing section, for supplying developer to a latent image formed on a surface of a recording medium to develop the latent image, and an agitator, installed in the toner containing section, for supplying toner to the development roller and for agitating toner in the toner containing section;

a flying toner detecting device for detecting an amount of toner flying from the development device; and a controlling device for controlling adhesion of the toner to the development roller in response to a result of a detection performed by the flying toner detecting device.

In this structure, the adhesion of the toner to the development roller is controlled by the controlling device in response to a result of a detection performed by the flying toner detecting device in the image forming apparatus. For example, when the amount of flying toner detected by the flying toner detecting device is not lower than a predetermined value, the adhesion of the toner to the development roller is improved under the control of the controlling device. Consequently, the toner in the toner containing section can hardly float or fly from a surface of the development roller. It is thus possible to prevent the toner from flying from the development device.

For a fuller understanding of the nature and advantages of the invention, reference should be made to the ensuing detailed description taken in conjunction with the accompanying drawings.

DESCRIPTION OF THE PREFERRED EMBODIMENTS

Embodiment 1

The following description will discuss one embodiment of the present invention with reference to FIGS. 1 to 19.

Figure 1:
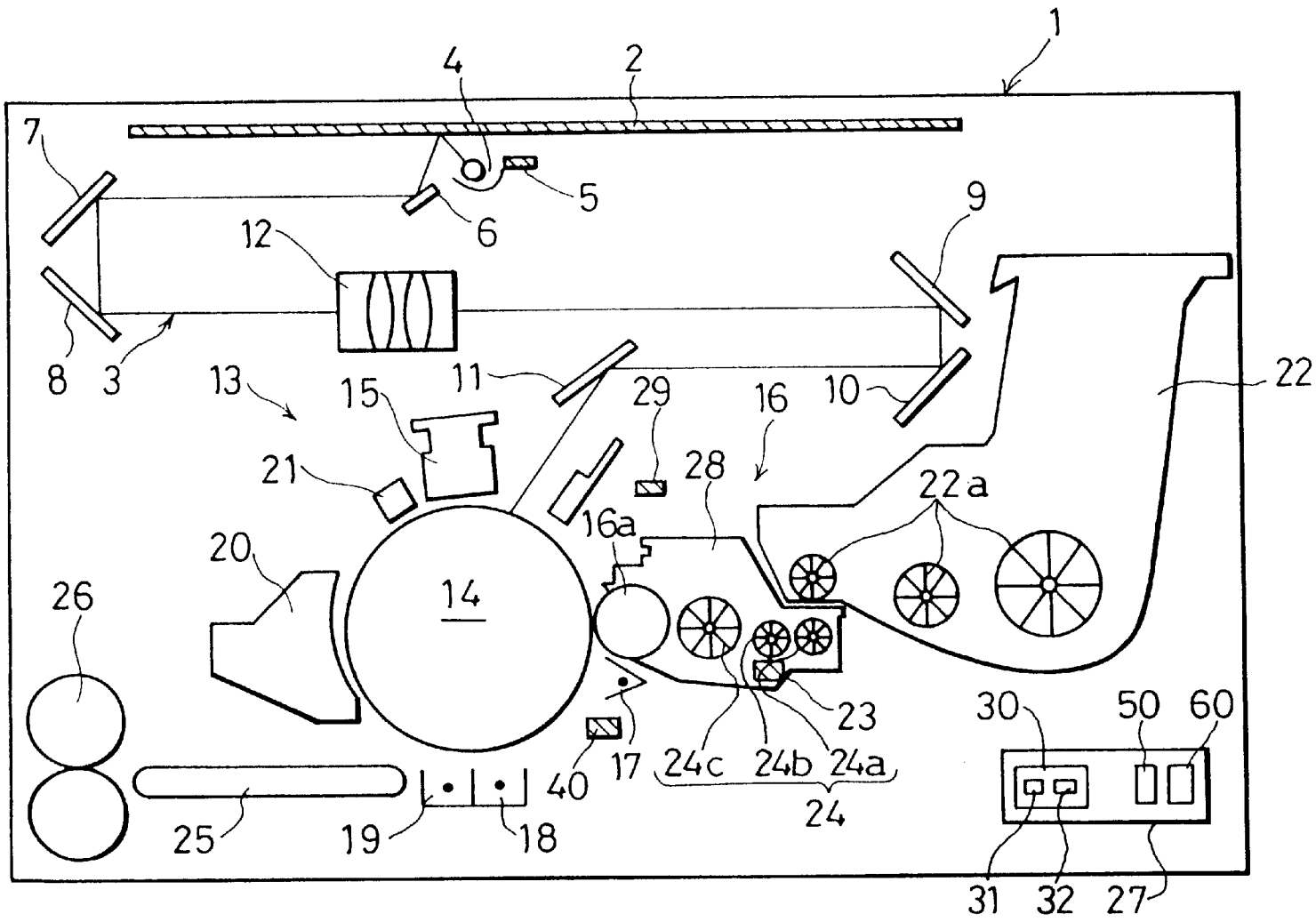
FIG. 1 is a structural view showing the entire structure of a copying machine according to one embodiment of the present invention.

As illustrated in FIG. 1, a copying machine 1 as an image forming apparatus of this embodiment includes a document platen 2 made of rigid transparent glass in an upper section, and a scanner 3 below the document platen 2. Formed below the scanner 3 is an image forming section 13 surrounding a photoreceptor drum 14.

The scanner 3 is formed by a lamp unit 4, an automatic exposure sensor 5, mirrors 6 to 11, and a lens unit 12. In the scanner 3, light is applied to a document on the document platen 2 from the lamp unit 4, and reflected light from the document is guided to the rotating photoreceptor drum 14 through the mirrors 6 to 11 and the lens unit 12. As a result, the photoreceptor 14 is exposed.

In the image forming section 13, disposed around the photoreceptor drum 14 are a main charger 15, a development device 16, a pre-transfer charger 17, a transfer charger 18, a separation charger 19, a cleaning unit 20, a charge removing lamp 21, and a blank lamp (not shown). The photoreceptor drum 14 is uniformly charged by corona discharge from the main charger 15 before the exposure of the photoreceptor drum 14. Moreover, on the photoreceptor drum 14, light is irradiated by the blank lamp according to the size of paper so as to remove charges in a non-image forming area. Consequently, an electrostatic latent image is formed on the photoreceptor drum 14 by the exposure.

The development device 16 includes a developer container 28 and a toner hopper 22. The toner hopper 22 stores toner to be supplied to the developer container 28. The developer container 28 has a development roller 16*a*, an agitation roller 24 as a supply roller or agitating means, and a toner density sensor 23. In response to a detection made by the toner density sensor 23, the toner in the toner hopper 22 is supplied so as to achieve a predetermined toner density in the developer container 28. In the developer container 28, the toner is agitated by the agitation roller 24, and charged to have a predetermined amount of electrostatic charges. The electrostatic latent image on a surface of the photoreceptor drum 14 is developed by the rotation of the photoreceptor drum 14 and the toner supplied by the development roller 16*a*. In this embodiment, the agitation roller 24 is formed by three agitation rollers 24*a*, 24*b*, and 24*c*.

The toner image formed by the development is transferred to a sheet supplied from a feed system (not shown) by the pre-transfer charger 17 and the transfer charger 18. After the transfer operation, the sheet and the photoreceptor drum 14 exert forces of attraction on each other. In order to eliminate the attraction force, the separation charger 19 lowers the electric potential on the sheet to be equal to an electric potential on the surface of the photoreceptor drum 14 by applying an AC corona to the sheet. As a result, the sheet is separated from the surface of the photoreceptor drum 14 due to its own rigidity and by a separating action of a separating claw (not shown). Thereafter, the sheet is transported to a fixing unit 26 by a transport unit 25, and the toner image is fixed onto the sheet.

Meanwhile, the toner remaining on the surface of the transfer drum 14 after the transfer is scraped off by the cleaning unit 20, and is collected in a waste toner box, not shown. Consequently, after the transfer operation, the surface of the photoreceptor drum 14 is cleaned. When light is irradiated from the charge removing lamp 21, the electrical resistance of a photoconducting layer of the photoreceptor drum 14 is lowered, and the residual electric potential on the photoreceptor drum 14 is removed.

The respective means used for the image formation is controlled by a control unit 27 as controlling means. The control unit 27 includes a process controlling section 30 having a toner density controlling section 31 and a development device controlling section 32. The toner density controlling section 31 is used to set a reference value of the toner density according to a toner density detected by the toner density sensor 23. The development device controlling section 32 performs control so that development is carried out satisfactorily.

Moreover, the copying machine includes a flying toner detecting device 40 as flying toner detecting means for detecting the amount of toner flying from the development device 16 in the vicinity of a section between the photoreceptor drum 14 and the development device 16. For example, the flying toner detecting device 40 is formed by a particle counter 41 shown in FIG. 2, an optical sensor 42 shown in FIG. 14, a detector for detecting a current in a charger shielding case, to be described later, a pressure sensor 48 shown in FIG. 18 for detecting the amount and pressure of air at an exhaust port.

The flying toner detecting device 40 is preferably disposed in the vicinity of the section between the photoreceptor drum 14 and the development device 16, particularly below the development device 16 considering the nature of the toner that falls. However, the position of the flying toner detecting device 40 is not necessarily limited to this, and may be positioned around the development device 16, the photoreceptor drum 14, or the optical system.

The particle counter 41 as one type of the toner detecting device 40 meets the standard specified by "JIS (Japanese Industrial Standard) B 9921 automatic particle counter by light scattering method". Alternatively, it is possible to use a counter having the same ability as the above counter. The particle counter 41 counts the amount of flying toner floating inside the copying machine by a light scattering method. One example of the particle counter 41 is given below.

Figure 2:
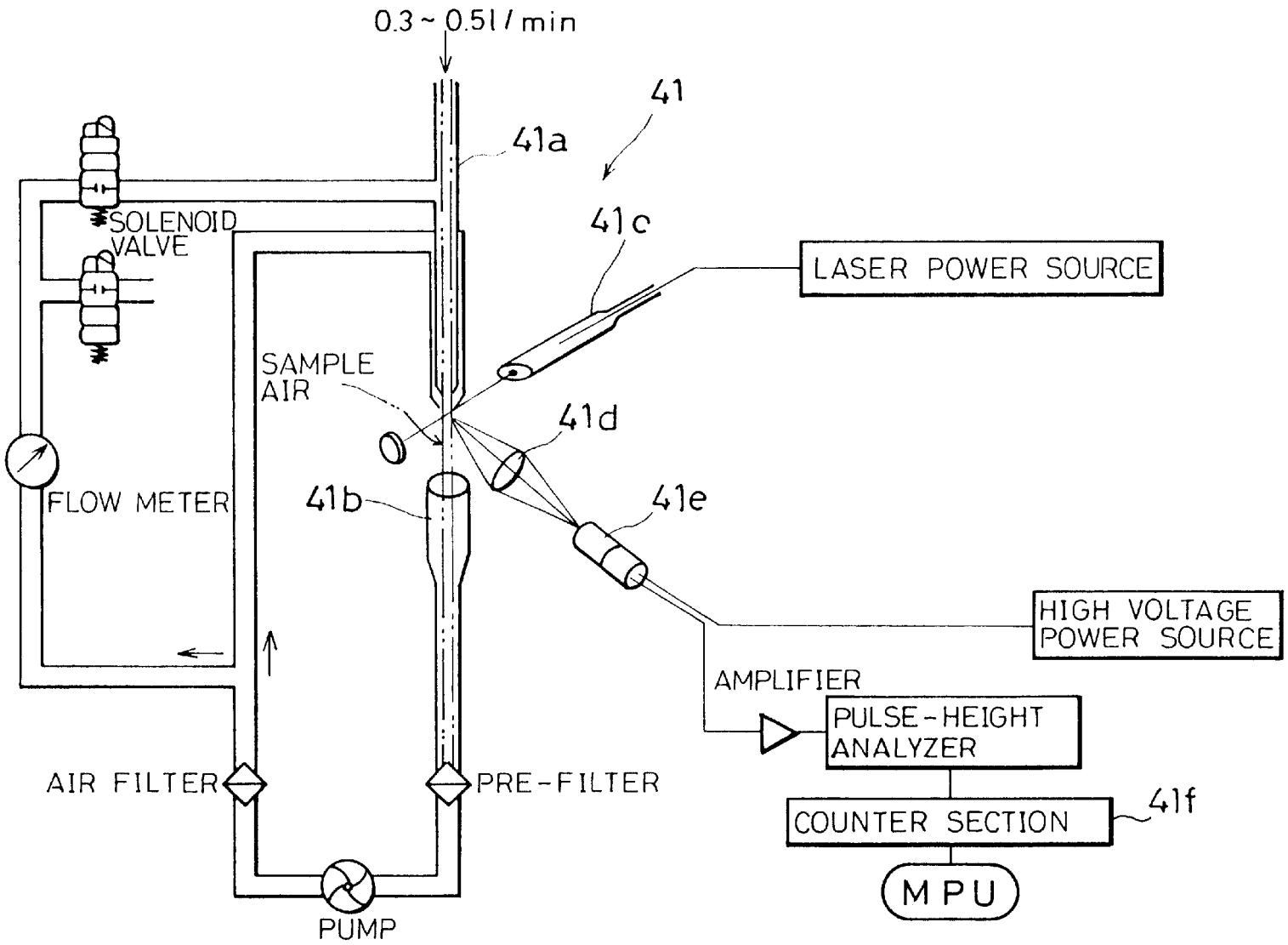
FIG. 2 is a structural view showing a particle counter functioning as a flying toner detecting device of the copying machine shown in FIG. 1.

As illustrated in FIG. 2, the particle counter 41 includes an inlet nozzle 41*a*, an outlet nozzle 41*b* as an exhaust pipe, a semiconducting laser 41*c*, a light conversing non-spherical lens 41*d*, a photodiode 41*e*, and a counter section 41*f*. The inlet nozzle 41*a* is a pipe for taking air containing toner. The semiconducting laser 41*c* irradiates laser light on a sample air passing through a space between the inlet nozzle 41*a* and the outlet nozzle 41*b* . The photodiode 41*e* receives through a light conversing non-spherical lens 41*d* the light which has passed through the space and been irradiated on the sample air. The counter section 41*f* counts the number of toner particles in the sample air based on a value detected by the photodiode 41*e*.

In the particle counter 41, the air around the section between the photoreceptor drum 14 and the development device 16 is taken, for example, at a rate of about 0.3 to 0.5 l per minute, and the number of toner particles having a diameter within a range of from about 1 to 20 $\mu$m in the air is calculated by the counter section 41*f*.

Figure 3:
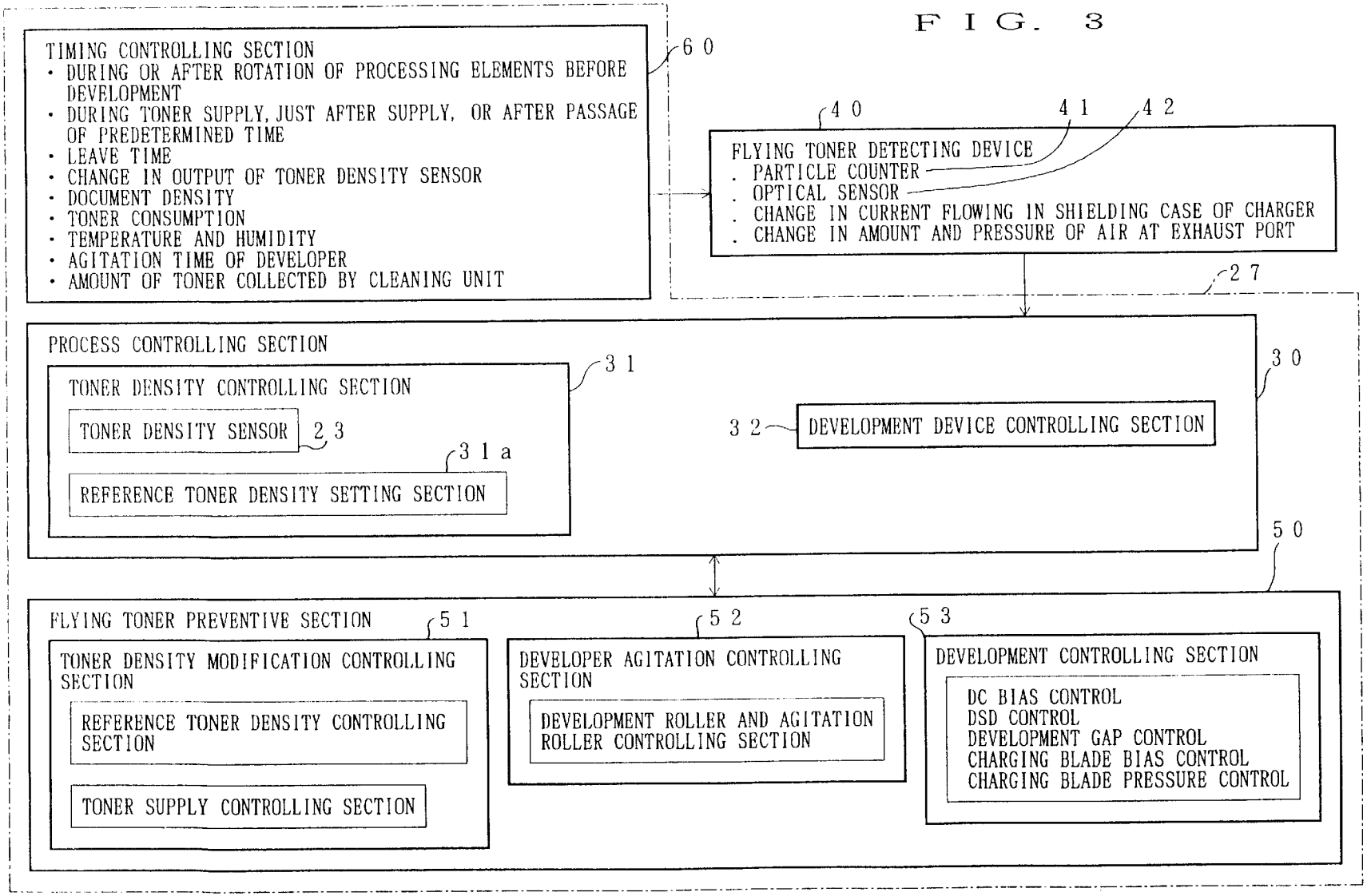
FIG. 3 is a block diagram showing the structure of a control unit of the copying machine.

The number of toner particles calculated by the counter section 41*f* is finally measured by the process controlling section 30 in the control unit 27 as shown in FIG. 3. According to the amount of flying toner, a toner density modification controlling section 51 as flying toner preventing means and a developer agitation controlling section 52 as developer agitation controlling means performs control so as to prevent the toner from flying.

The control unit 27 includes a timing controlling section 60 and a flying toner preventive section 50. The timing controlling section 60 controls the timing of detecting the amount of flying toner by the flying toner detecting device 40 as to be described later.

The flying toner preventive section 50 includes the toner density modification controlling section 51, the developer agitation controlling section 52, and a development controlling section 53. The toner density modification controlling section 51 has a reference toner density controlling section and a toner supply controlling section. The reference toner density controlling section suitably changes a reference toner density, which is a criteria used for judging whether or not the toner is to be supplied from the toner hopper 22 to the developer container 28, depending on the amount of flying toner. The toner supply controlling section controls the rotation speed of a supply rollers 22*a* of the toner hopper 22 according to the amount of flying toner.

The developer agitation controlling section 52 has a development roller and agitation roller controlling section. The development roller and agitation roller controlling section controls the actions of the development roller 16*a* and the agitation roller 24 provided in the developer container 28.

In this structure, the detection of flying toner and the control operation for preventing flying toner are performed by the control unit 27 as follows.

Figure 4:
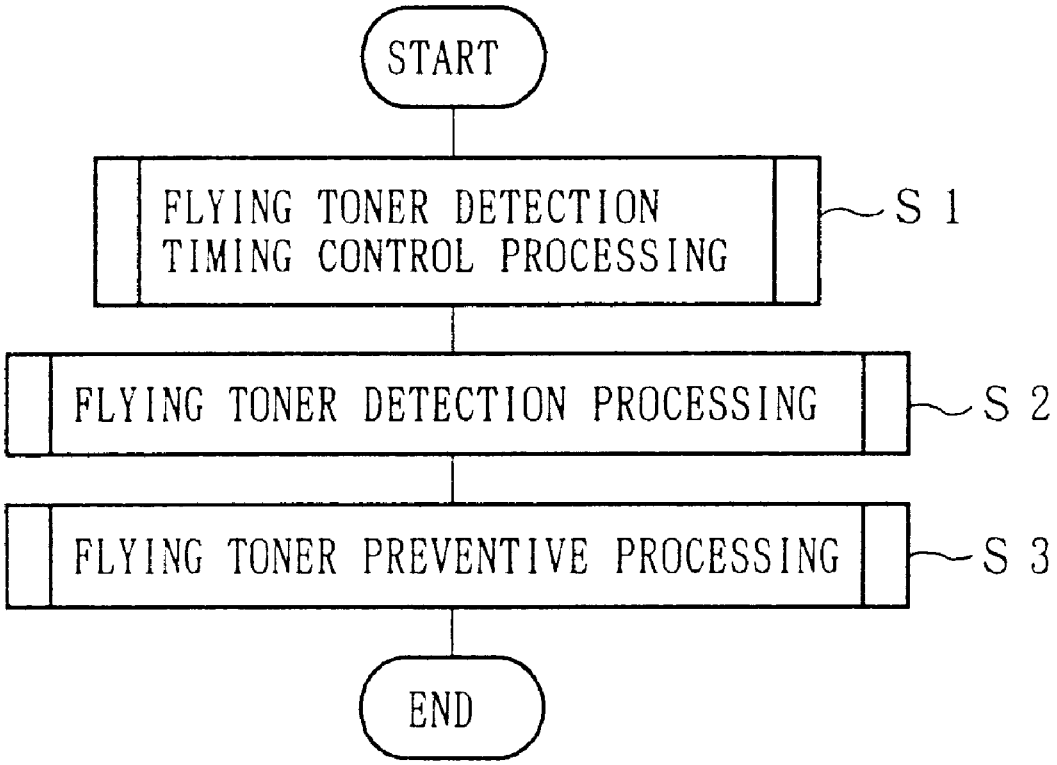
FIG. 4 is a flow chart showing a main routine of control performed by the control unit.

First, as shown in the flow chart of FIG. 4, in the control unit 27, the timing controlling section 60 performs flying toner detection timing control so as to determine the time for detecting the flying toner (S1). Subsequently, the flying toner detecting device 40 and the process controlling section 30 detect the amount of flying toner (S2). According to the result of the detection, a flying toner preventive operation is performed (S3).

Figure 5:
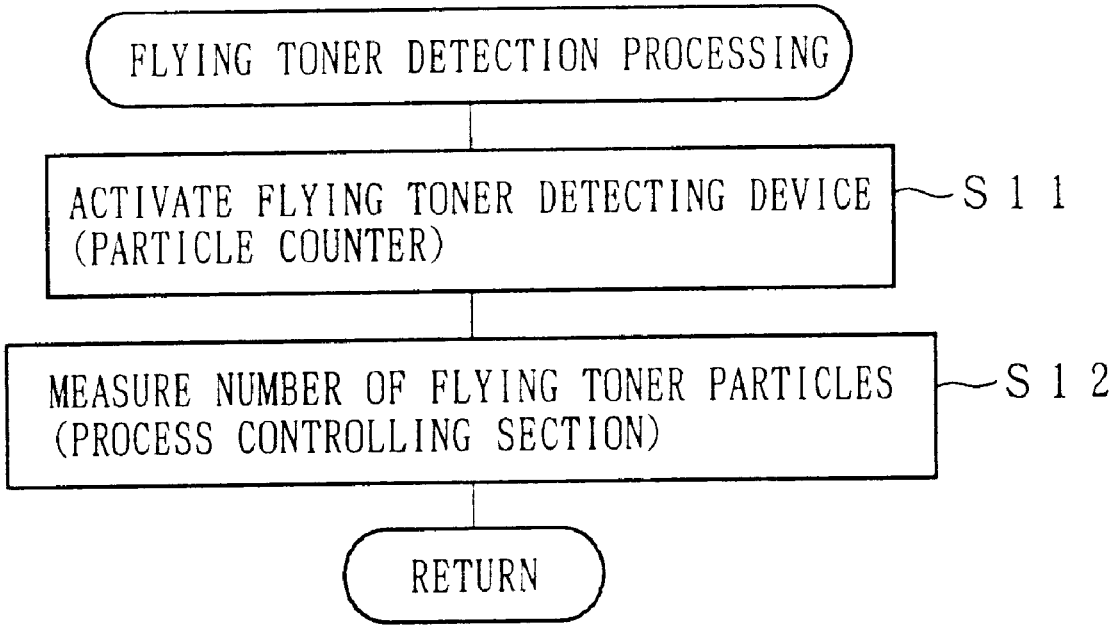
FIG. 5 is a flow chart showing a flying toner detecting routine performed by the control unit when the particle counter is used.

For example, when the particle counter 41 is used as the flying toner detecting device 40, the flying toner detection processing in S2 is performed as shown in the flow chart of FIG. 5.

More specifically, the particle counter 41 is actuated (S11), and then the number of flying toner particles are counted by the process controlling section 30 (S12).

Figure 6:
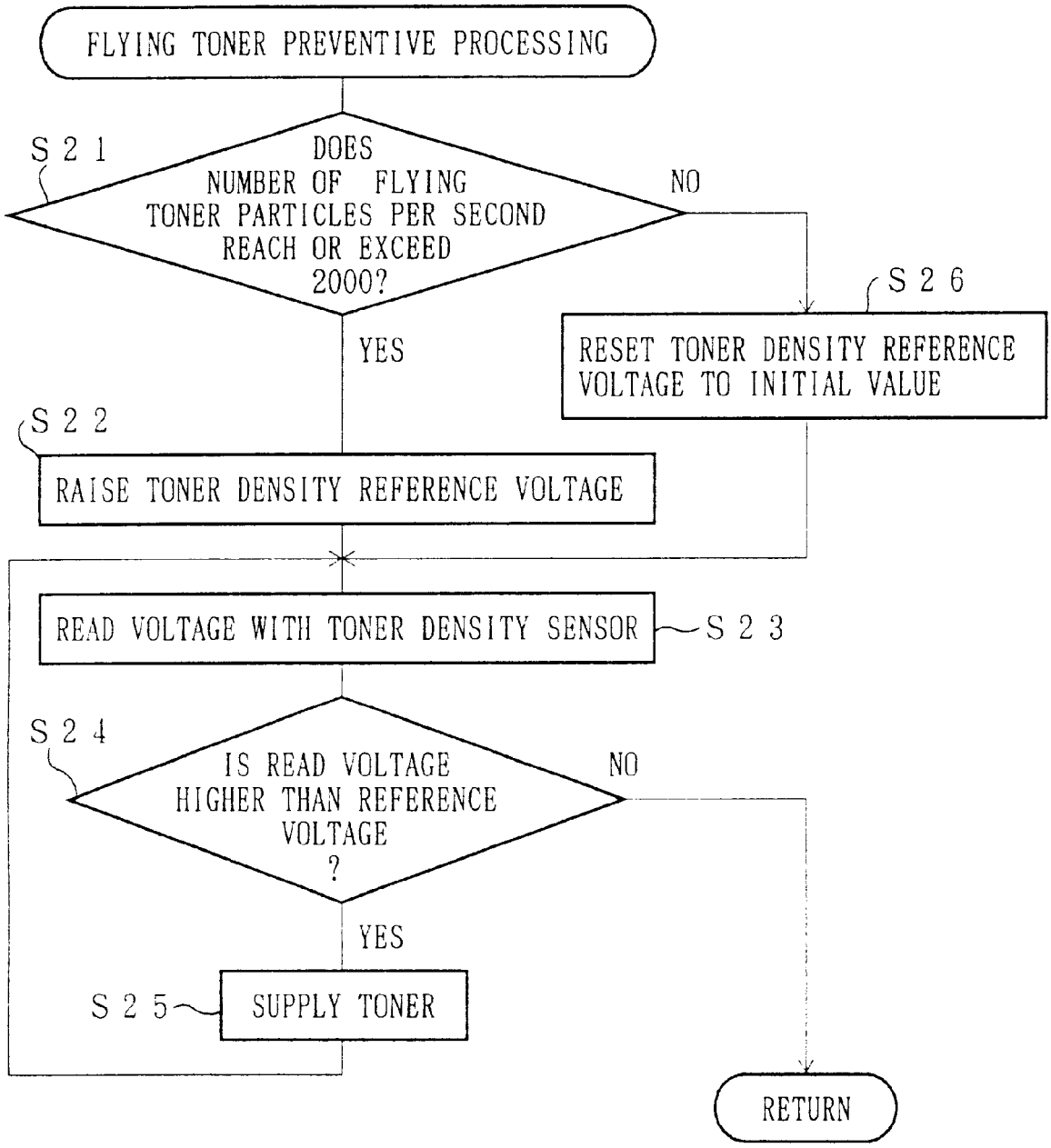
FIG. 6 is a flow chart showing a flying toner preventing routine performed by the control unit when a toner density reference voltage is varied.

Regarding the flying toner preventive processing (S3) performed by the particle counter 41 after the flying toner detection, for example, as illustrated in FIG. 3 and the flow chart of FIG. 6, a control operation is performed by the toner density modification controlling section 51 in the flying toner preventive section 50.

Namely, the toner density modification controlling section 51 judges whether the number of flying toner particles per second is not less than 2000 (S21). When the number of flying toner particles per second is not less than 2000, the toner density modification controlling section 51 controls the reference toner density setting section 31*a* in the process controlling section 30 to lower the reference toner density. More specifically, a toner density reference voltage is increased under the control (S22). The toner density reference voltage is increased by a unit of 0.1 V.

On the other hand, when the number of flying toner particles per second is less than 2000 in S21, the toner density modification controlling section 51 controls the reference toner density setting section 31*a* of the process controlling section 30 to reset the toner density reference voltage to an initial value (S26), and then the operation moves to S23.

Thereafter, the toner density controlling section 31 reads an output voltage of the toner density sensor 23 (S23), and judges whether the output voltage of the toner density sensor 23 is higher than the toner density reference voltage (S24). If the output voltage is higher than the toner density reference voltage, the toner is supplied to the developer container 28 from the toner hopper 22 (S25). On the other hand, if the output voltage is lower than the toner density reference voltage, the processing is completed.

Namely, in this copying machine 1, the toner caused to fly from the developer container 28 during a copying operation is detected in real time by the particle counter 41. Moreover, when the amount of flying toner, which is given by the number of toner particles having a particle diameter of 1 to 20 $\mu$m fly per second, is 2000, the toner density reference voltage is increased by 0.1 V so as to lower the toner density by 0.3 percent for the next copying operation. Consequently, the amount of toner in the developer container 28 is reduced and the toner is agitated in an improved manner, thereby increasing the amount of electrostatic charges on the toner. As a result, the amount of flying toner is reduced.

In addition, the use of the particle counter 41 allows the number of the floating toner particles that fly from the developer container 28 to be directly counted. Thus, the flying toner preventive processing can be carried out at an early stage. It is therefore possible to prevent the toner from flying before the respective processing elements used for the image formation get dirty due to the flying toner.

Furthermore, in the flying toner preventive processing, by changing the reference toner density, it is possible to delay the toner supply timing so as to prevent the toner from being abruptly supplied by once and to lower the toner density in the developer container 28. As a result, flying toner can be prevented. Additionally, in this structure, since a new device for preventing the toner from flying is not required, it is possible to easily but surely prevent the toner from flying.

In the flying toner preventive processing, the flying toner preventive section 50 changes the reference toner density by the reference toner density controlling section 12 in the toner density modification controlling section 51 and controls the toner density. However, it is also possible to control the toner density by controlling the speed of the toner supply roller 22*a* in the toner hopper 22 by the toner supply controlling section. In this case, the operation proceeds as shown in the flow chart of FIG. 7.

Figure 7:
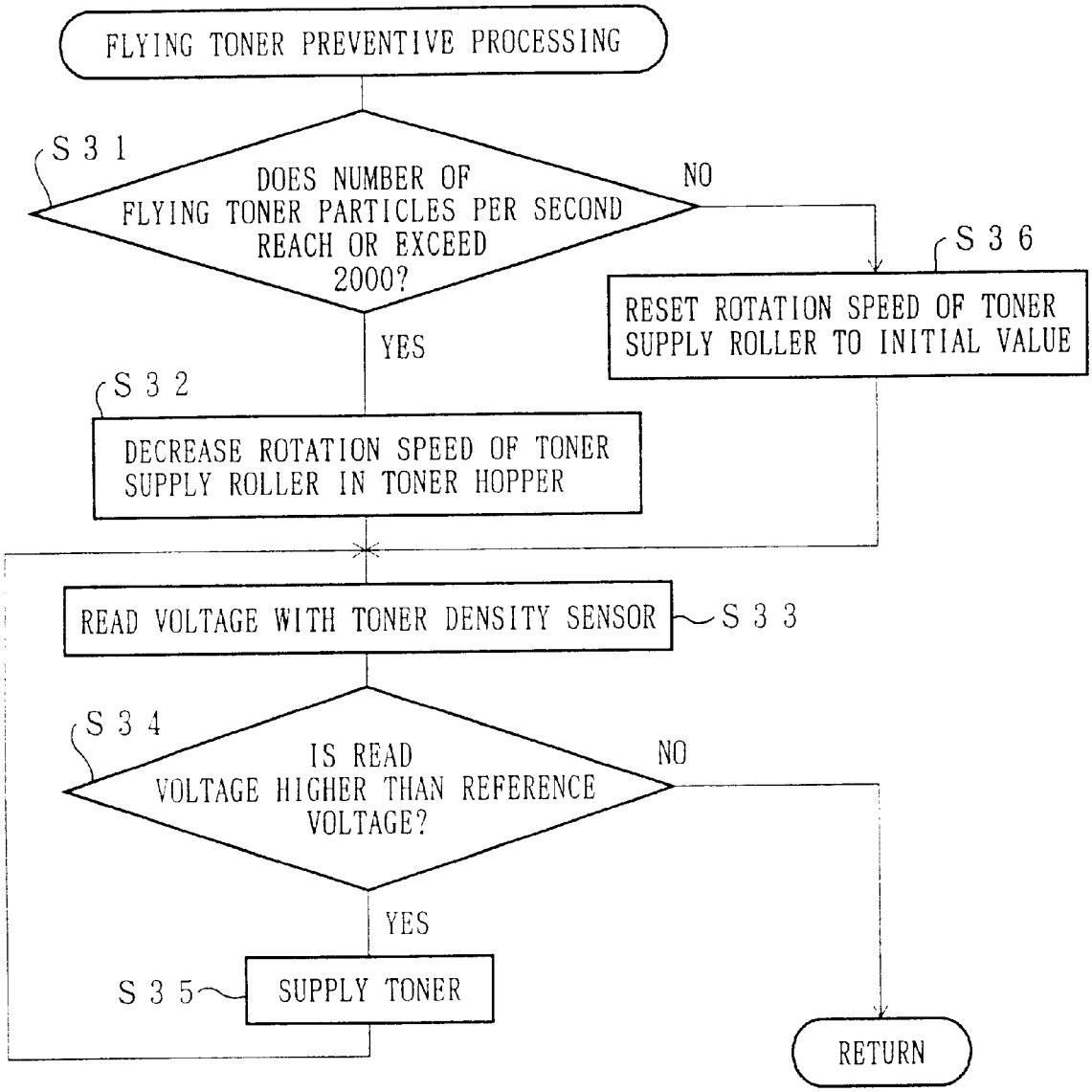
FIG. 7 is a flow chart showing a flying toner preventing routine performed by the control unit when the rotation speed of a toner supply roller is decreased.

In FIG. 7, the toner density modification controlling section 51 judges whether the number of the flying toner particles per second is not less than 2000 (S31). If the number of the flying toner particles per second is not less than 2000, the rotation speed of the toner supply roller 22*a* is lowered under the control of the toner density modification controlling section 51 (S32). On the other hand, if the number of the flying toner particles per second is less than 2000, the rotation speed of the toner supply roller 22*a* is reset to the initial value under the control of the toner density modification controlling section 51 (S36), and then the operation moves to S33.

Thereafter, the toner density controlling section 31 reads an output voltage of the toner density sensor 23 (S33), and judges whether the output voltage of the toner density sensor 23 is higher than the toner density reference voltage (S34). If the output voltage is higher than the toner density reference voltage, the toner density controlling section 31 allows a supply of toner (S35). On the other hand, if the output voltage is not higher than the toner density reference voltage, the toner density controlling section 31 completes the processing.

In the above-mentioned operation, the amount of toner flying from the developer container during copying is detected. When the amount of the flying toner, which is given by the number of toner particles having a particle diameter of 1 to 20 $\mu$m fly per second, becomes 2000, the amount of toner to be supplied per unit time is limited by decreasing the rotation speed of the toner supply roller 22*a* in the toner hopper 22 by 5 to 90 percent according to the amount of the flying toner. As a result, the toner density in the developer container 28 is decreased, and the probability that the toner supplied into the developer container 28 comes into contact with carrier increases. As a result, the toner is charged in an improved manner, and the amount of flying toner is reduced. In this structure, the rotation speed of the present toner supply roller 22*a* is controlled, and a new device is not required to prevent the toner from flying. It is thus possible to easily but surely prevent the toner from flying.

Figure 8:
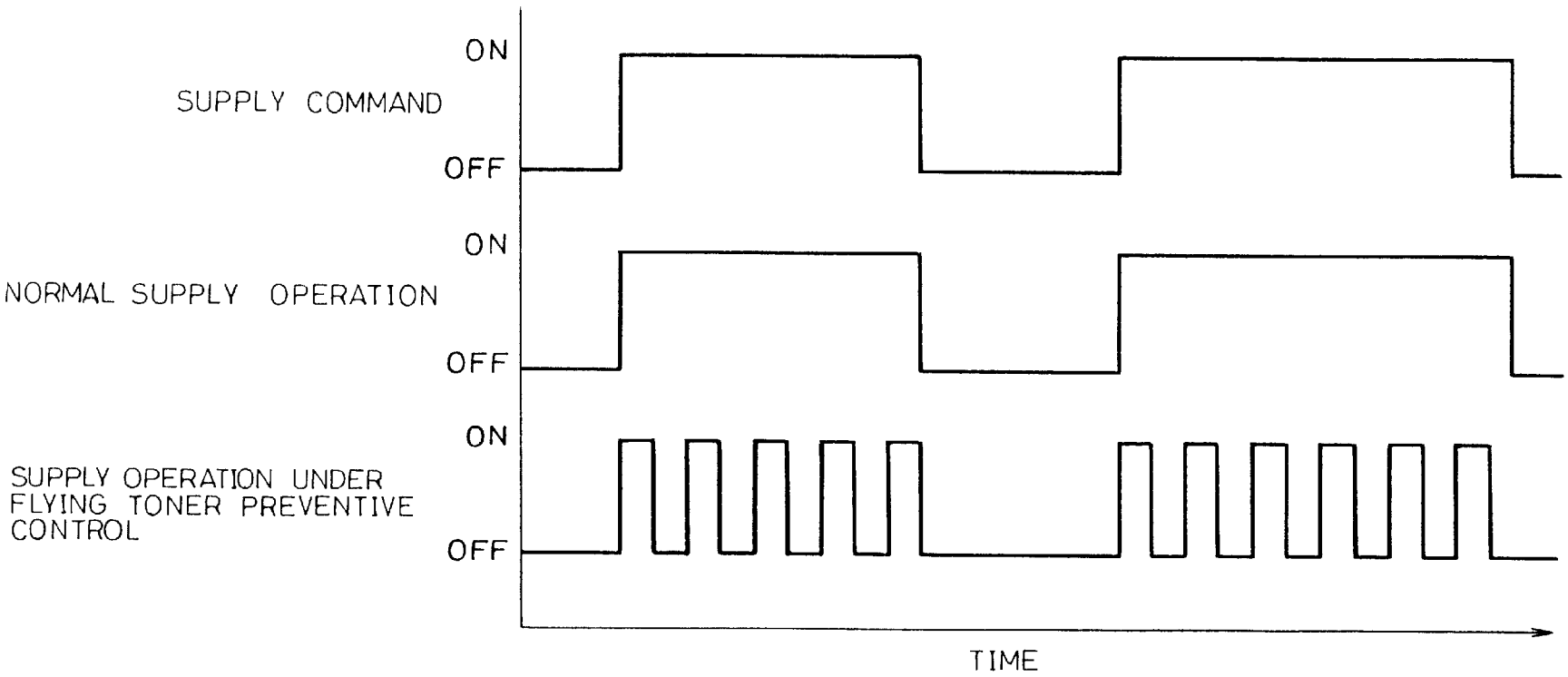
FIG. 8 is a timing chart of control for intermittently activating the toner supply roller to perform the flying toner preventive processing.

Moreover, the control of the speed of the toner supply roller 22*a* enables the toner supply roller 22*a* to rotate irregularly and intermittently rather than continuously. More specifically, the toner supply roller 22*a* is activated irregularly and intermittently but not continuously as shown in FIG. 8. In this case, the amount of toner to be supplied per unit time is arranged to be 10 to 90 percent of a usual supply so as to facilitate the mixing of the carrier and toner. As a result, the time taken for charging the supplied toner is shortened, preventing flying toner. In this structure, the rotation speed of the present toner supply roller 22*a* is controlled, and a new device is not required to prevent the toner from flying. It is thus possible to easily but surely prevent flying toner.

With the control of the developer agitation controlling section 52, it is possible to prevent the toner from flying by controlling the speed of the development roller 16*a* and the agitation roller 24 (see FIG. 1). This operation is shown by the flow chart of FIG. 9.

Figure 9:
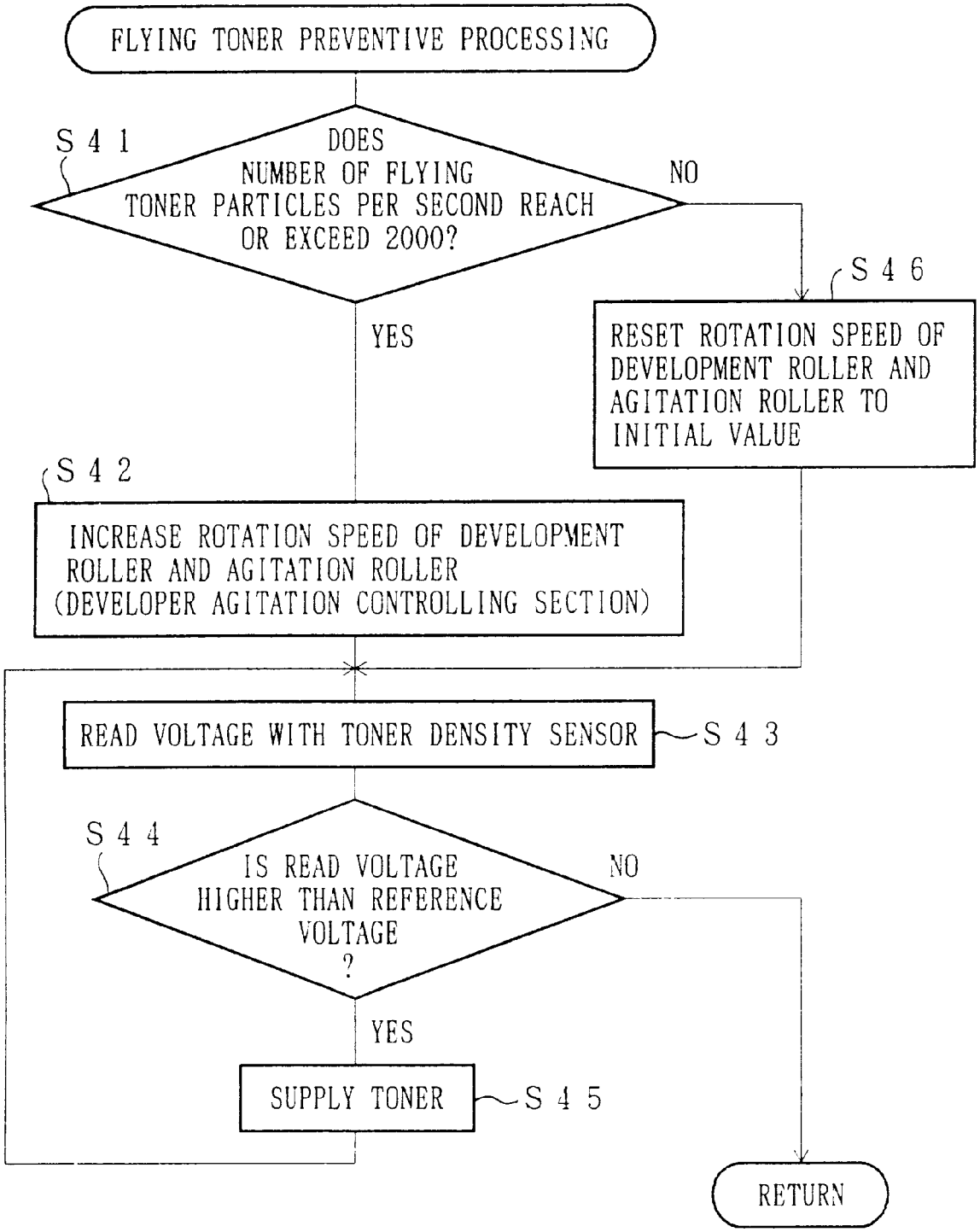
FIG. 9 is a flow chart showing a flying toner preventing routine performed by the control unit when the rotation speed of a development roller and an agitation roller is increased.

In FIG. 9, the developer agitation controlling section 52 judges whether the number of flying toner particles per second is not less than 2000 (S41), and controls the rotation speed of the development roller 16*a* and the agitation roller 24 to increase if the number of flying toner particles per second is not less than 2000 (S42). In this case, the developer agitation controlling section 52 sets the rotation speed, and the developing device controlling section 32 controls the rotation of the development roller 16*a* and the agitation roller 24 according to the set rotation speed.

On the other hand, if the number of flying toner particles per second is less than 2000, the developer agitation controlling section 52 controls the rotation speed of the development roller 16*a* and the agitation roller 24 to be reset to the initial value (S46).

Thereafter, the toner density controlling section 31 reads an output voltage of the toner density sensor 23 (S43), and judges whether the output voltage of the toner density sensor 23 is higher than the toner density reference voltage (S44). If the output voltage is higher than the toner density reference voltage, the toner is supplied (S45). On the other hand, if the output voltage is lower than the toner density reference voltage, the processing is completed.

In the above operation, the developer is agitated in an improved manner by increasing the rotation speed of the development roller 16*a* and the agitation roller 24 in the developer container 28 at a rate ranging from 10 to 100 percent. As a result, the amount of the electrostatic charges of the toner which has been supplied to the developer, and the toner which has already been contained in the developer increase. In particular, the amount of electrostatic charges of slightly charged toner increases. It is thus possible to reduce the amount of flying toner. In this structure, the rotation speed of the development roller 16*a* and of the agitation roller 24 are controlled, and a new device is not required to prevent the toner from flying. It is thus possible to easily but surely prevent the toner from flying. Moreover, the distribution of the amount of electrostatic charges of the toner becomes sharper, and the image quality, such as gradient, reproduction of dots and characters, is improved.

The agitation of the toner depends more greatly on the agitation roller 24 than on the development roller 16*a*. Therefore, it is possible to adopt a structure which only varies the rotation speed of the agitation roller 24 without changing the rotation speed of the development roller 16*a*. This structure is shown in FIG. 10.

Figure 10:
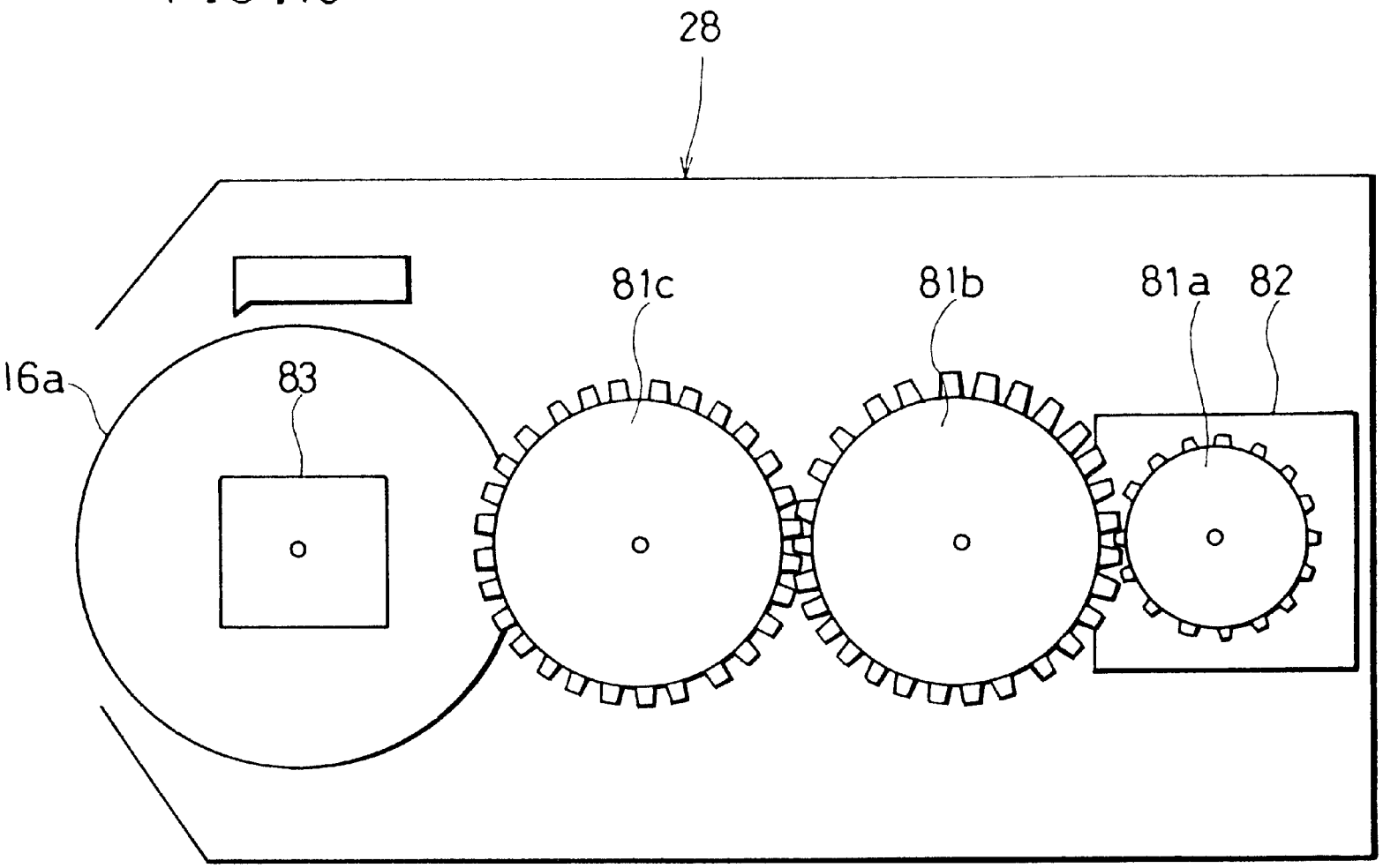
FIG. 10 is an explanatory view of a driving system for increasing the rotation speed of the agitation roller in the control unit.

In FIG. 10, gears 81*a*, 81*b* and 81*c* correspond to the agitation rollers 24*a*, 24*b* and 24*c*, respectively, and are fixed to the shafts of the respective rollers. The gears 81*a* to 81*c* mesh each other, and are simultaneously rotated with a rotation of an agitation roller driving motor 82 for driving the gears 81*a* to 81*c*. Meanwhile, the development roller 16*a* is separately rotated by a development roller driving motor 83. The developer agitation controlling section 52 controls the developer container 28 as shown in the flow chart of FIG. 11.

Figure 11:
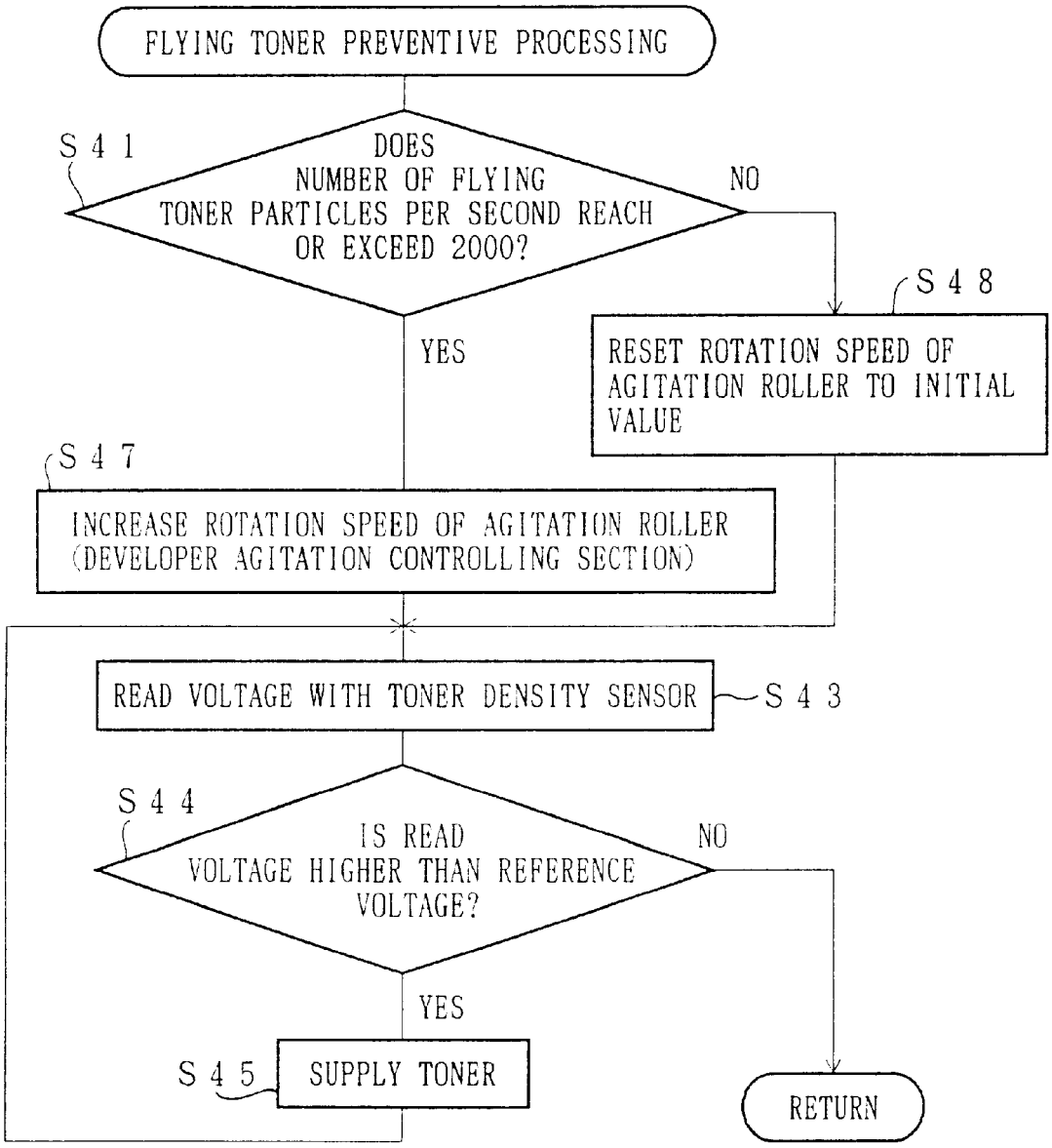
FIG. 11 is a flow chart showing a flying toner preventing routine performed by the control unit to increase the rotation speed of the agitation roller.

In FIG. 11, when the number of flying toner particles per second is not less than 2000, the developer agitation controlling section 52 increases the rotation speed of the agitation roller 24 (S47). On the contrary, when the number of flying toner particles per second is less than 2000, the developer agitation controlling section 52 resets the rotation speed of the agitation roller 24 to the initial value (S48).

Denoting the development roller driving motor 83 and the agitation roller driving motor 82 as D and E, respectively, the normal rotation speed $Dr_0$ and $Er_0$ of the motors D and E and the rotation speed $Dr_1$ and $Er_1$ thereof during the flying toner preventive processing are set to satisfy the relationship $$Er_1/Dr_1 > Er_0/Dr_0.$$

In this structure, although the agitation of the toner is improved by increasing the rotation speed of the agitation roller 24, since the development roller 16*a* is rotated at a normal speed, it is possible to prevent the toner from flying due to the centrifugal force.

Moreover, in the control of the agitation roller 24 by the developer agitation controlling section 52, when the number of flying toner particles per second is not less than 2000, it is possible to prevent the toner from flying by increasing the rotation time of the agitation roller 24 before development.

Figures 12A, 12B:
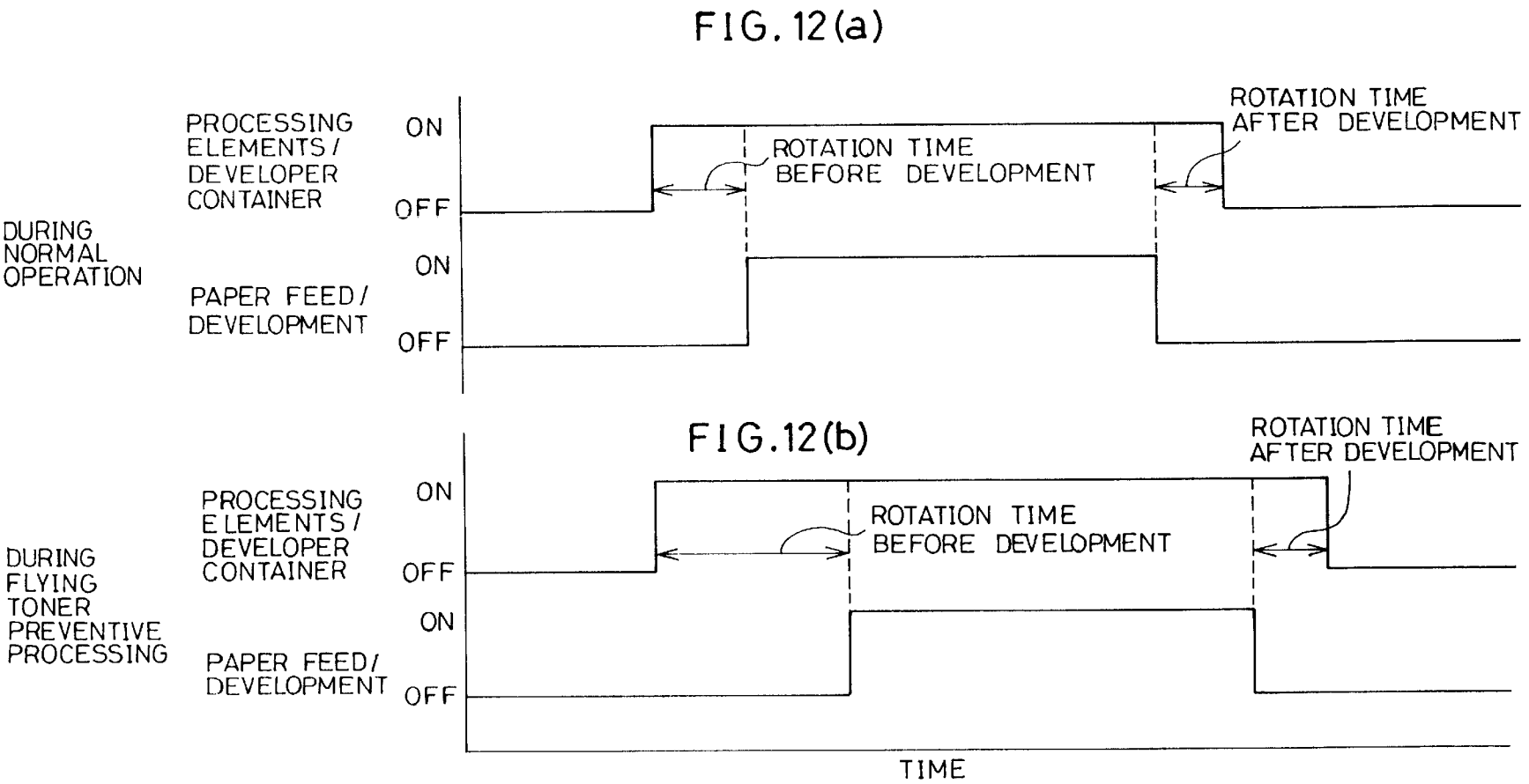
FIG. 12(*a*) is a timing chart showing a normal agitation time when the control unit performs pre-development rotation control of the agitation roller, and FIG. 12(*b*) is a timing chart when the agitation time is extended under the pre-development rotation control for the flying toner preventive processing.

More specifically, in the toner preventive processing, as shown in FIG. 12(*b*), the rotation speed before development is increased by 10 to 100 percent compared to the normal rotation time before development shown in FIG. 12(*a*). In this case, when the number of flying toner particles per second becomes less than 2000, the rotation time before development is reset to the initial time.

In this structure, the agitation of the toner is improved and the amount of electrostatic charges of the toner supplied to the developer is increased by extending the agitation time of the developer by 10 to 100 percent compared to the normal agitation time during the rotation before development, thereby reducing the amount of the flying toner. This structure enables the slightly charged toner supplied to have a sufficient amount of electrostatic charges before the development process.

In the control of the agitation roller 24 by the developer agitation controlling section 52, when the number of flying toner particles per second reaches or exceeds 2000, it is also possible to prevent the toner from flying by increasing the rotation time of the agitation roller 24 after the copying operation, i.e., development.

Figures 13A, 13B:
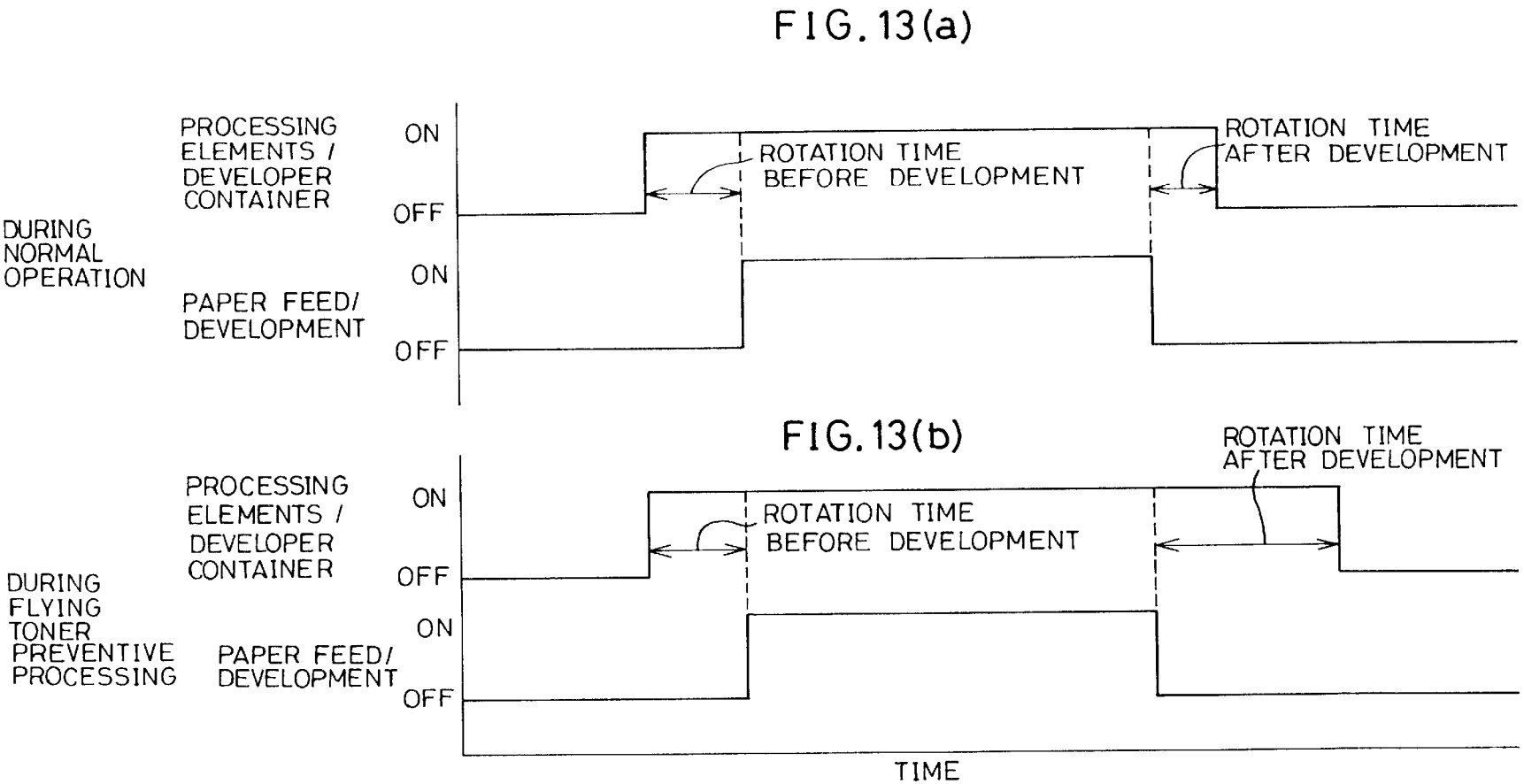
FIG. 13(*a*) is a timing chart showing a normal agitation time when the control unit performs post-development rotation control of the agitation roller, and FIG. 13(*b*) is a timing chart when the agitation time is extended under the post-development rotation control for the flying toner preventive processing.

More specifically, in the toner preventive processing, as shown in FIG. 13(*b*), the rotation speed after development is increased compared to the normal rotation time after development shown in FIG. 13(*a*). In this case, when the number of flying toner particles per second becomes less than 2000, the rotation speed after development is also reset to the initial time.

In this structure, the agitation time of the developer after development is increased and the amount of electrostatic charges of the toner after the copying operation is kept high so as to prevent the toner from flying in the next copying operation. Consequently, the developer can be easily charged in the next copying operation, and the time taken for performing the first copying operation is shortened.

In the above explanation, the particle counter 41 is used as the flying toner detecting device 40. However, it is also possible to use an optical sensor 42 as shown in FIG. 14(*a*) instead of the particle counter 41.

Figure 14A:
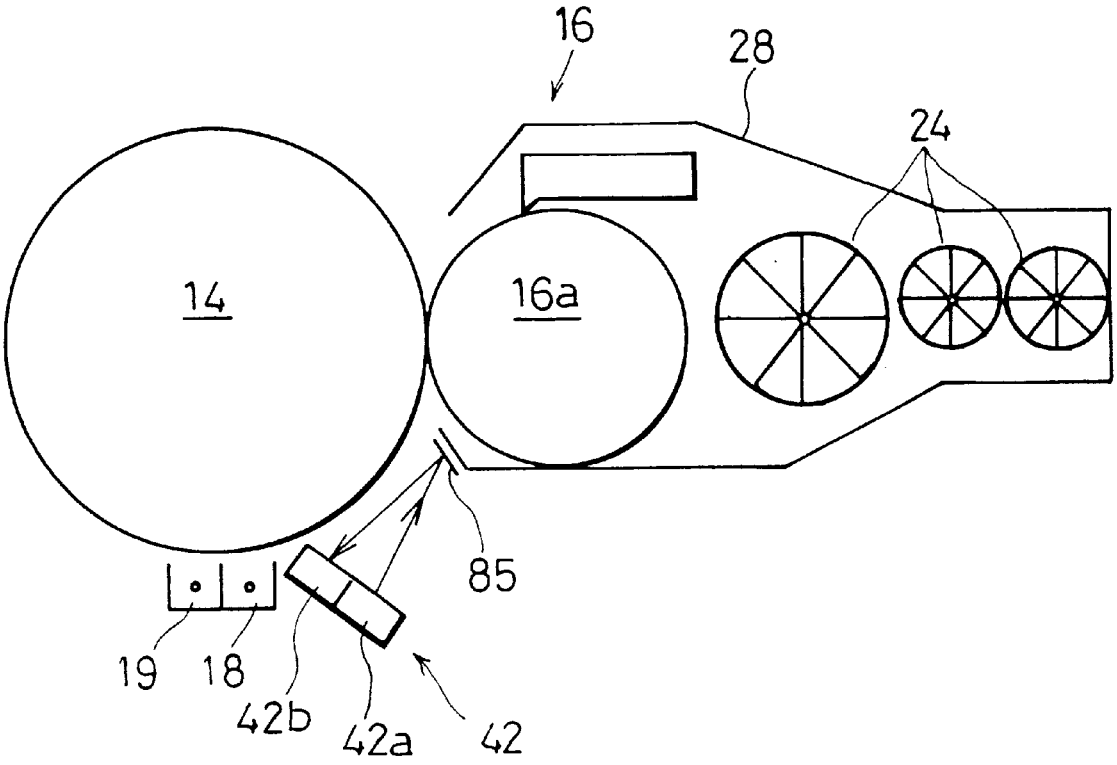
FIG. 14(*a*) is an explanatory view showing a state of detecting flying toner by an optical sensor functioning as a flying toner detecting device of the copying machine, and FIG. 14(*b*) is an explanatory view showing an alternative example of the structure shown in FIG. 14(*a*).
Figure 14B:
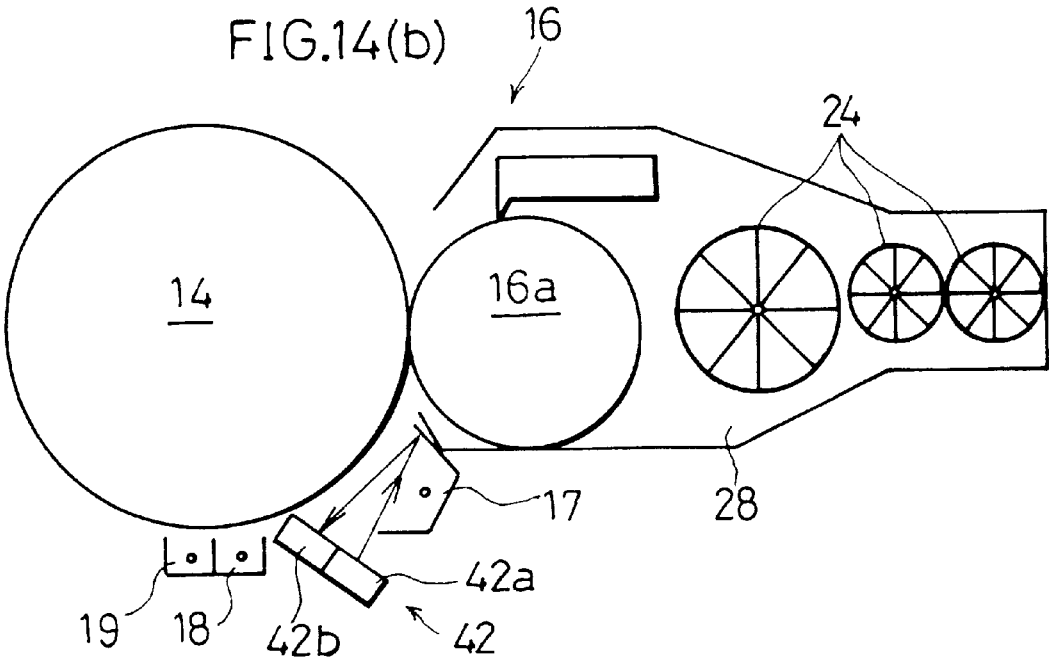

In FIG. 14(*a*), a reflector 85 is provided in the developer container 28 so as to detect the amount of flying toner by the optical sensor 42. The reflector 85 is disposed below the toner supply opening through which the toner is supplied to the photoreceptor drum 14 and on a side surface of the developer container 28 facing the photoreceptor drum 14. This is a position to which the toner dispersed from the developer container 28 tends to adhere. It is therefore possible efficiently and surely detect the amount of flying toner from the developer container 28.

The reflector 85 has a surface that easily reflects light, for example, a mirror surface or Mylar deposited surface. The optical sensor 42 irradiates light on the reflector 85 by an optical sensor light emitting section 42*a*, and detects the reflected light by an optical sensor light receiving section 42*b*. This structure uses a variation in the output of the optical sensor light receiving section 42*b* depending on the amount of toner adhering to the reflector 85, i.e., the amount of flying toner. It is possible to use more than one reflector 85 and more than one optical sensor 42.

Figure 15:
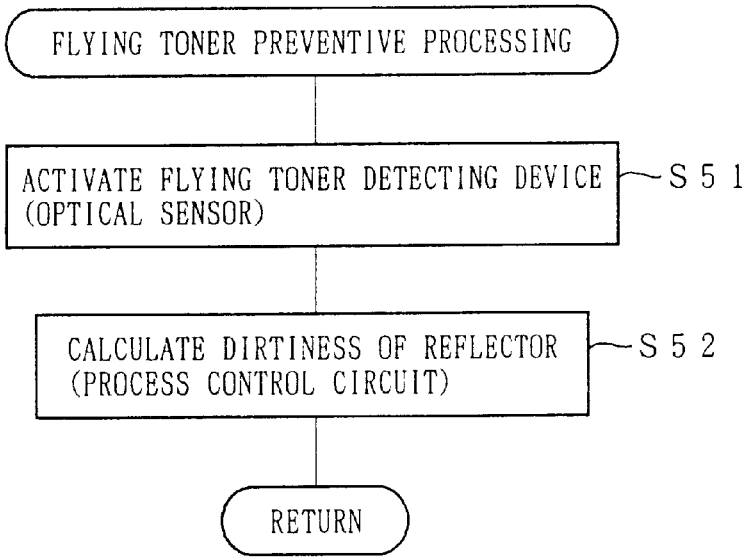
FIG. 15(*a*) is a flow chart of flying toner detecting processing performed by the control unit when the optical sensor is used as the flying toner detecting device, and FIG. 15(*b*) is a flow chart showing the flying toner preventive processing performed by the control unit based on a value detected by the optical sensor.
Figure 15:
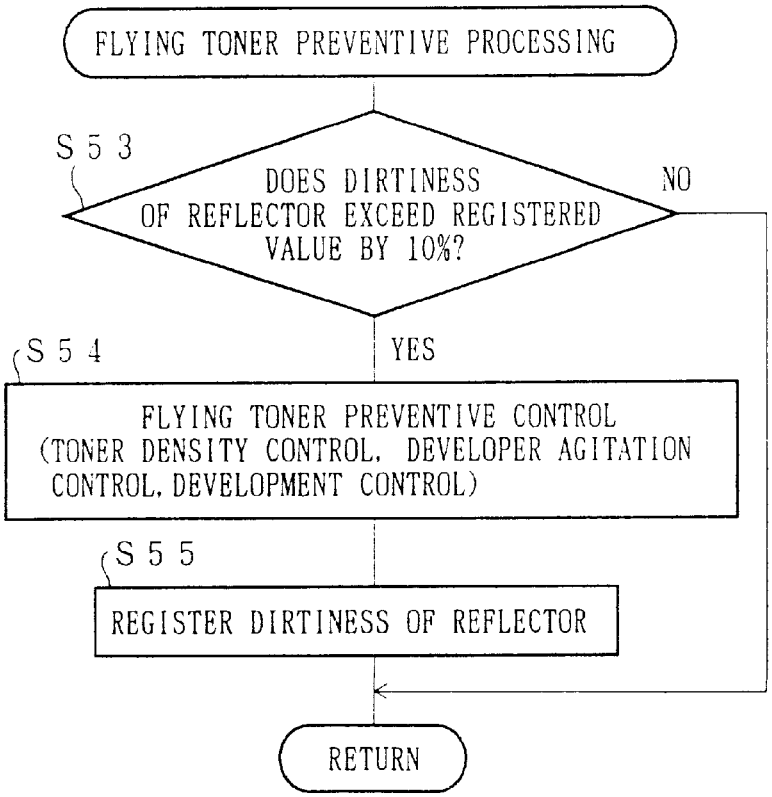

Referring now to the flow chart shown in FIGS. 15(*a*) and 15(*b*), the following description will discuss the control operation performed by the control unit 27 using the optical sensor 42 so as to detect the amount of flying toner and prevent flying toner.

As illustrated in FIG. 15(*a*), in the process of detecting the flying toner, the optical sensor 42 is activated (S51), the dirt on the reflector 85 is detected and the degree of dirtiness is measured by the process controlling section (S52).

Next, as illustrated in FIG. 15(*b*), in the process of preventing the toner from flying, the flying toner preventive section 50 judges whether the dirt on the reflector 85 is 10 percent higher than a registered value (S53). If the dirt on the reflector 85 is 10 percent higher than the registered value, the toner density control, developer agitation control mentioned above or flying toner preventive control such as development control are performed (S54). Subsequently, the flying toner preventive section 50 registers the dirtiness of the reflector 85 (S55) to complete the processing.

When the reflected light from the reflector 85 of the pre-transfer charger 17 shows at least a 10 percent variation between a copying operation and the next copying operation, the flying toner preventing control is performed by this processing.

In this embodiment, the dirt on the reflector 85 caused by the toner is detected by the optical sensor 42. However, the present invention is not limited to this structure. For example, when the pre-transfer charger 17 is installed in a position corresponding to the lower position of the toner supply opening on an outer wall section of the developer container 28, it is possible to use a shielding case of the pre-transfer charger 17 as shown in FIG. 14(*b*).

In this structure, with the use of the optical sensor as the flying toner detecting device 40, the dirt caused by the flying toner at the lower position of the toner supply opening of the developer container 28 is detected, and the level of the dirt is determined based the cumulative value from the initial value or the rate of a change from a reference value. The detection of the amount of flying toner with the optical sensor 42 is an indirect detection, but is advantageous because it can be easily performed at low cost.

Figure 16:
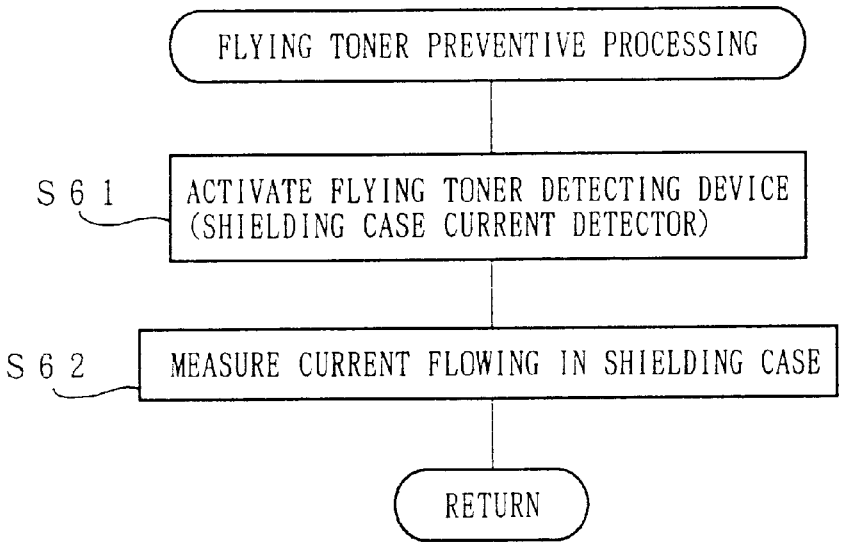
FIG. 16(*a*) is a flow chart showing the flying toner detecting processing performed by the control unit when a shielding case current detector is used as the flying toner detecting device, and FIG. 16(*b*) is a flow chart showing the flying toner preventive processing performed by the control unit based on a value detected by the shielding case current detector.
Figure 16:
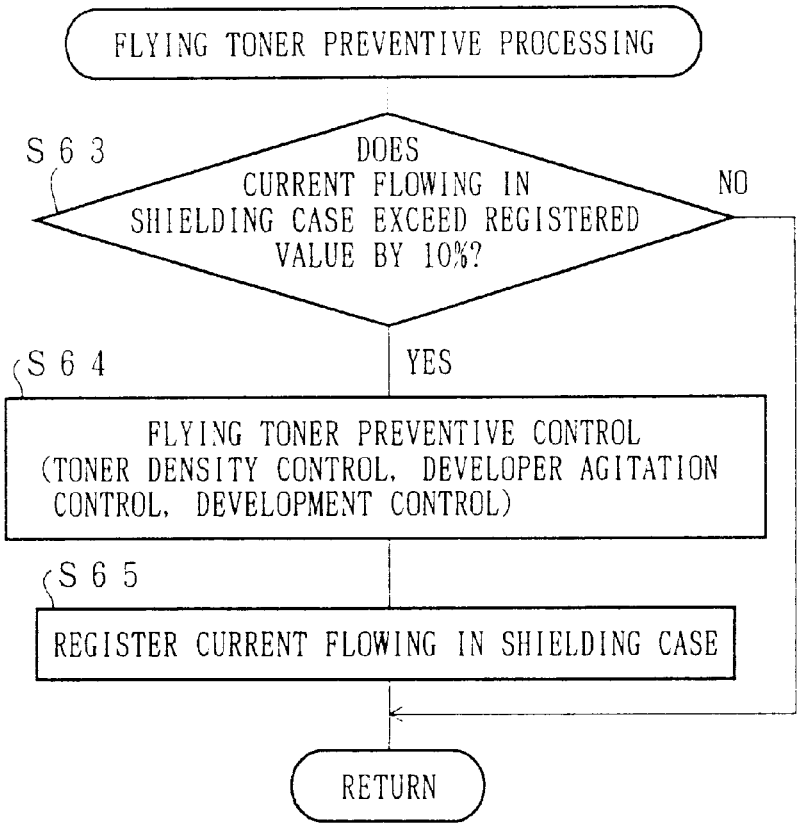

Referring now to the flow charts of FIGS. 16(*a*) and 16(*b*), the following description will discuss the control of the flying toner detection and the flying toner preventive operation performed by the control unit 27 when detecting the dirt on the shielding case of the main charger 15 by the flying toner detecting device 40 based on a variation in the current.

This structure uses the following characteristic of a secondary current flowing through the shielding case due to the discharge, for example, from a discharge wire of the pre-transfer charger 17. The secondary current varies depending on the degree of the dirt on the inside surface of the shielding case.

As shown in FIG. 16(*a*), in the flying toner detection processing, a shielding case current detector is activated (S61), and the value of the current flowing through the shielding case of the pre-transfer charger 17 is measured (S62).

Subsequently, in the flying toner preventive processing, as shown in FIG. 16(*b*), the flying toner preventive section 50 judges whether the current flowing through the shielding case is 10 percent higher than a registered value (S63). If the current in the shielding case is 10 percent higher than the registered value, the flying toner preventing control, such as toner density control, developer agitation control and development control, is performed (S64). Next, after the flying toner preventive section 50 registers the value of the current in the shielding case (S65), and a return instruction is given.

In this processing, when the value of the current usually flowing through the shielding case of the pre-transfer charger 17 is lowered by 10 percent or more, the flying toner preventive control is performed.

In the above explanation, the detection of the value of the current flowing through the shielding case of the pre-transfer charger 17 is exemplified. However, it is also possible to detect a current flowing through a shielding case of other charger, for example, the transfer charger 18 and the separation charger 19.

In this structure, a change in the case current flowing through the case of the pre-transfer charger 17 caused by the dirt on the pre-transfer charger 17 due to flying toner is detected, and a feed back control is applied to the flying toner preventive processing. The flying toner detecting device 40 detects a problem caused by the flying toner in copying, for example, development and transfer characteristics, separability from the photoreceptor drum 14, and deterioration of the image quality. Namely, the flying toner detecting device 40 is a type of the simplest detecting means which requires no new device other than the case current measuring means.

In this structure, since the case current in the pre-transfer charger 17 which is a charger located closest to the development device 16 is detected, it is possible to detect the amount of flying toner with accuracy. In a copying machine which is not provided with the pre-transfer charger 17, for example, a case current in the main charger 15 is detected.

Figure 17:
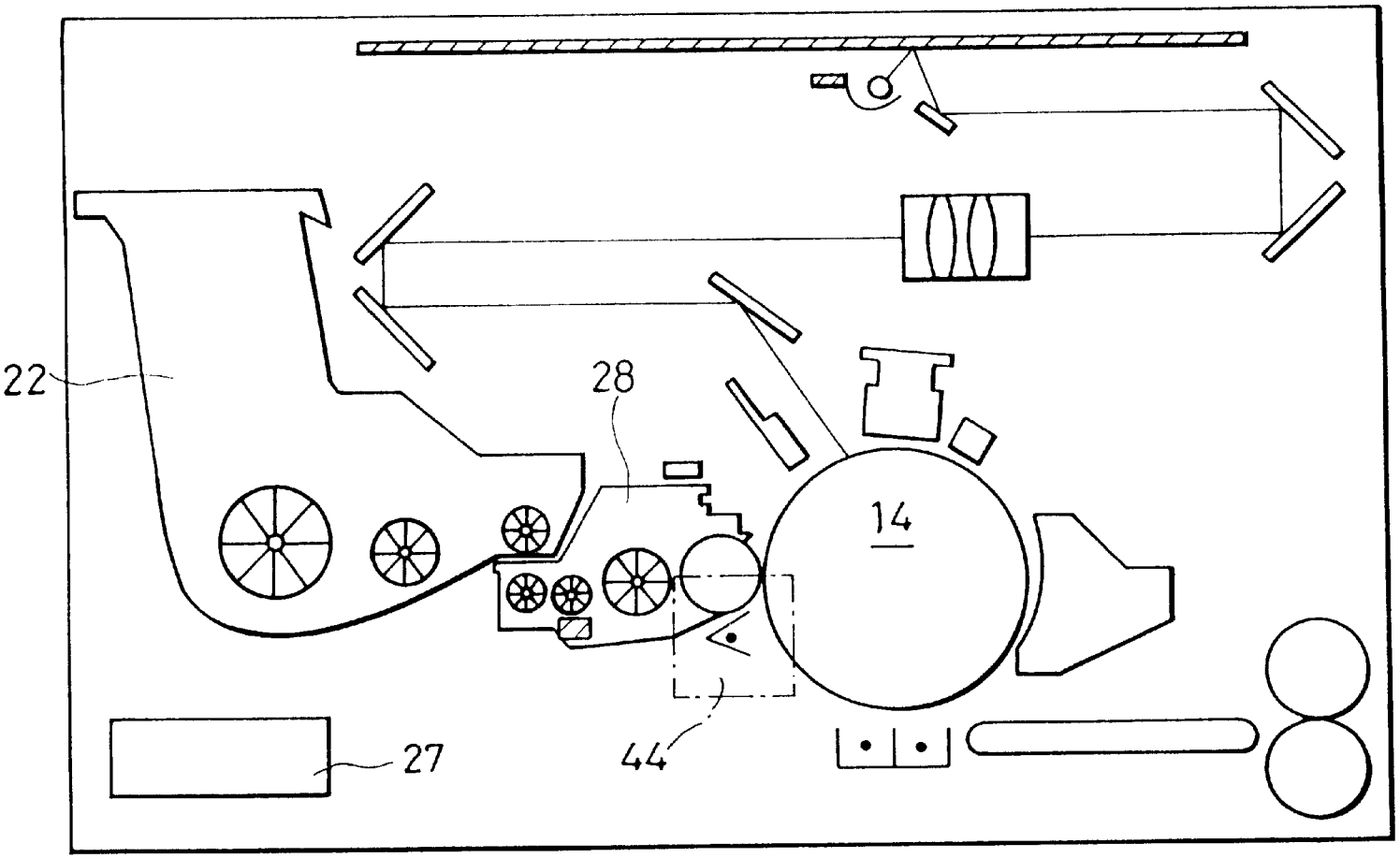
FIG. 17 is an explanatory view showing a position of an exhaust port provided in the copying machine.
Figure 18:
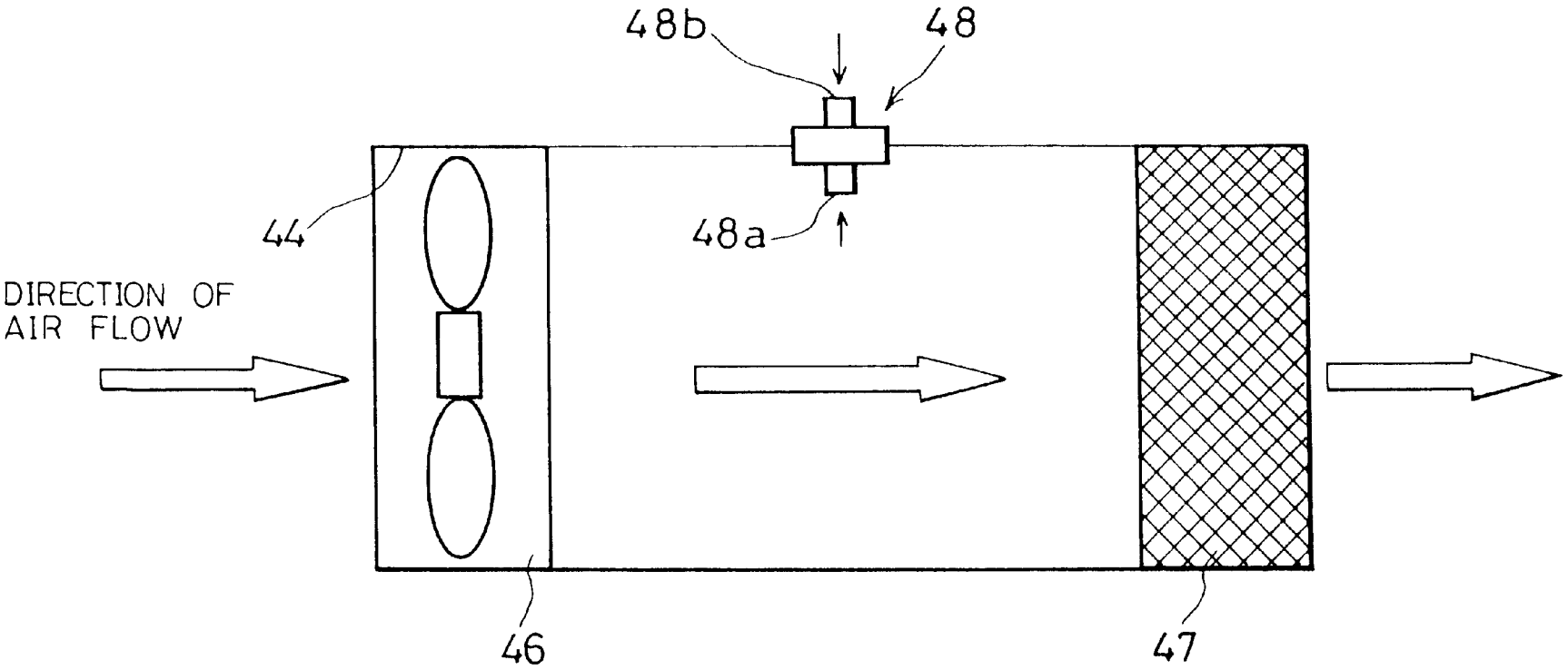
FIG. 18 is an explanatory view showing a flying toner detecting device formed by an exhaust filter positioned in the exhaust port, and a pressure sensor as a differential pressure gauge.
Figure 19:
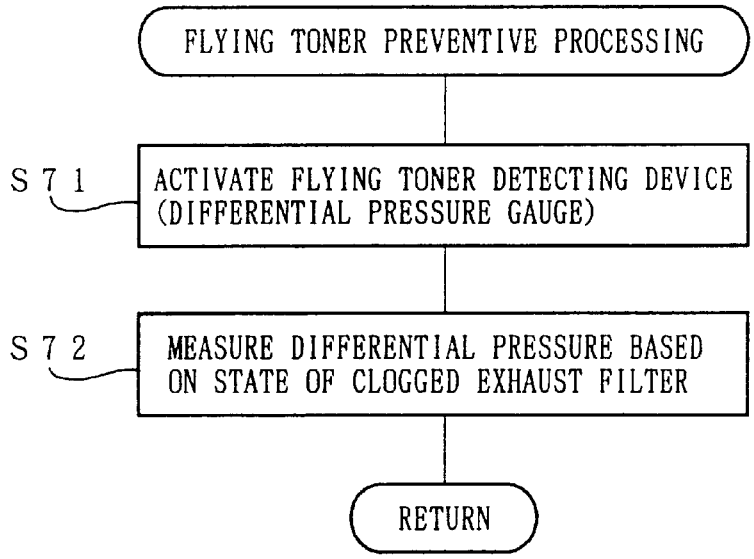
FIG. 19(*a*) is a flow chart showing the flying toner detecting processing performed by the control unit when the pressure sensor is used as the flying toner detecting device, and FIG. 19(*b*) is a flow chart showing the flying toner preventive processing performed by the control unit based on a value detected by the pressure sensor.
Figure 19:
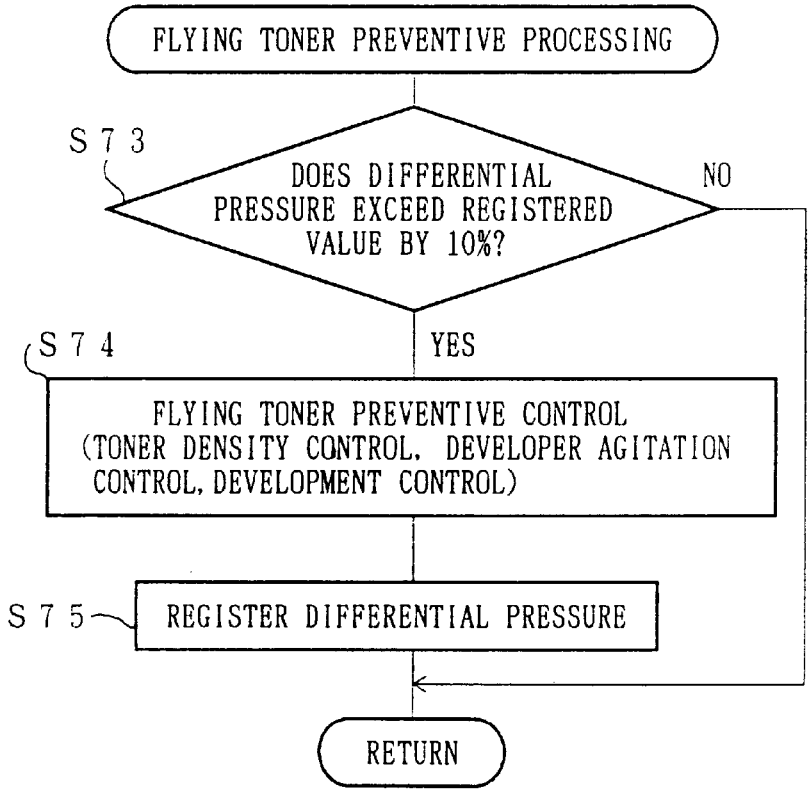

Referring now to FIGS. 17, 18 and the flow charts of FIGS. 19(*a*) and 19(*b*), the following description will discuss the structure as the flying toner detecting device 40 for detecting the amount of air or the air pressure at the exhaust port, and a control operation performed by the flying toner preventive section 50 in this structure.

As illustrated in FIG. 17, an exhaust port 44 of the copying machine 1 is provided on a rear wall of the copying machine 1 in the vicinity of the pre-transfer charger 17. As shown in FIG. 18, at the exhaust port 44, an exhaust fan 46 and an exhaust filter 47 are mounted as a single piece of component. In order to measure the amount of air or the air pressure at the exhaust port 44, a pressure sensor 48 is provided between the exhaust fan 46 and the exhaust filter 47.

For example, the pressure sensor 48 is formed by a piezoresistnce-type pressure sensor. The pressure sensor 48 is positioned so that its front section 48*a* faces an exhaust flow section and its rear section 48*b* faces the atmosphere. The pressure sensor 48 detects a differential pressure between the gas pressure in the exhaust port 44 and the atmospheric pressure. When the exhaust filter 47 is clogged with the flying toner, the amount of air passing through the exhaust filter 47 is reduced, and the differential pressure varies. It is also possible to convert the differential pressure to measure a change in the amount of air. Namely, it is possible to detect the state of the flying toner based on a change in the output of the pressure sensor 48.

In the flying toner preventive processing based on the air pressure and the amount of air at the exhaust port 44, as shown in FIG. 19(*a*), the differential pressure gauge is activated (S71), and the differential pressure caused by the clogged exhaust filter is measured (S72).

Next, in the flying toner preventive processing, as shown in FIG. 19(*b*), the flying toner preventive section 50 judges whether the differential pressure is 10 percent higher than the registered value (S73). When the differential pressure caused by the clogged exhaust filter is at least 10 percent higher than the registered value, the flying toner preventive control, such as toner density control, developer agitation control and development control, is performed (S74). Subsequently, after the flying toner preventive section 50 registers the differential pressure (S75), a return instruction is given.

With this processing, the flying toner preventive control is performed at the time a differential pressure detected based on the air pressure and the amount of air at the exhaust port is at least 10 percent lower than the normal differential pressure.

In this structure, since the pressure sensor 48 as the flying toner detecting device 40 is mounted in a device having the exhaust fan 46 and the exhaust filter 47, the pressure sensor 48 does not exclusively occupy the space around the copying processing device, particularly the space around the development device 16. It is thus possible. to make the entire size of the copying machine compact. Moreover, since the state of the exhaust filter 47 is detected, it is possible to observe the external environment of the copying machine 1. Regarding the structure for detecting the amount of flying toner based on the clogged state of the exhaust filter 47, a variation in the electrical resistance of the exhaust filter 47 may be detected instead of the above-mentioned detection.

As described above, in the copying machine 1 of this embodiment, the amount of flying toner from the development device 16 is accurately detected by the flying toner detecting device 40 of any type. In addition, it is possible to successfully prevent the toner from flying by the toner density modification controlling section 51 and the developer agitation controlling section 52 of the flying toner preventive section 50 based on a value detected by the flying toner detecting device 40.

More specifically, by detecting the flying toner from the development device 16 and the photoreceptor drum 14 that makes the image forming means dirty at an early stage and making various corrections, it is possible to prevent the toner from flying further. As a result, the dirt on the processing elements used for the image formation is reduced, and a high-quality image can be obtained in a stable manner.

Embodiment 2

The following description will discuss another embodiment of the present invention with reference to FIGS. 1, 3, 4 and 20 to 31. The members having the same function as in Embodiment 1 will be designated by the same code and their description will be omitted.

This embodiment explains control performed by the timing controlling section 60 in the control unit 27 shown in FIG. 3.

In the detection of the amount of flying toner described in Embodiment 1, deciding the time to perform the detection is an important element in order to improve the effect of preventing flying toner. Namely, the timing controlling section 60 in the control unit 27 controls the timing of detecting the amount of flying toner.

In order to decide the timing of the detection of the amount of flying toner, for example, the timing controlling section 60 performs control so that the amount of flying toner is detected at a time between the start of the rotation of the processing devices before development and just after the rotation, at a time between the start of the supply of the toner to the toner hopper 22 and just after the supply, after the elapse of a predetermined time from the completion of the supply of the toner to the toner hopper 22, based on a leave time, based on a change in the output of the toner density sensor 23, based on the document density, based on the consumption of toner, based on temperature or humidity, based on the toner agitation time, or based on the amount of toner collected by the cleaning unit 20.

The following description will explain the respective timing.

First, the structure for detecting the amount of flying toner in a time between the start of the rotation of the processing elements before development and just after the rotation is discussed. The amount of electrostatic charges of the toner is low before starting a copying operation. If a pre-rotation is performed in this state, toner tends to fly from the developer container 28 during a time between the start of the pre-rotation and just after the rotation, i.e., until the toner floating in the developer container 28 settles down. Therefore, by detecting the amount of flying toner within this time, it is possible to efficiently detect the amount of the flying toner. On the other hand, if the amount of the flying toner is detected before development, a feedback can be given to the flying toner preventive section 50 at an early stage. It is thus possible to improve the flying toner preventing function and reduce the effect on the image. The pre-rotation is an operation usually performed in a copying machine for the purpose of imparting a predetermined amount of electrostatic charges to the toner in the developer container 28.

Next, detecting the amount of flying toner during a time between the start of supplying toner to the toner hopper 22 and just after the supply is discussed.

Figure 20:
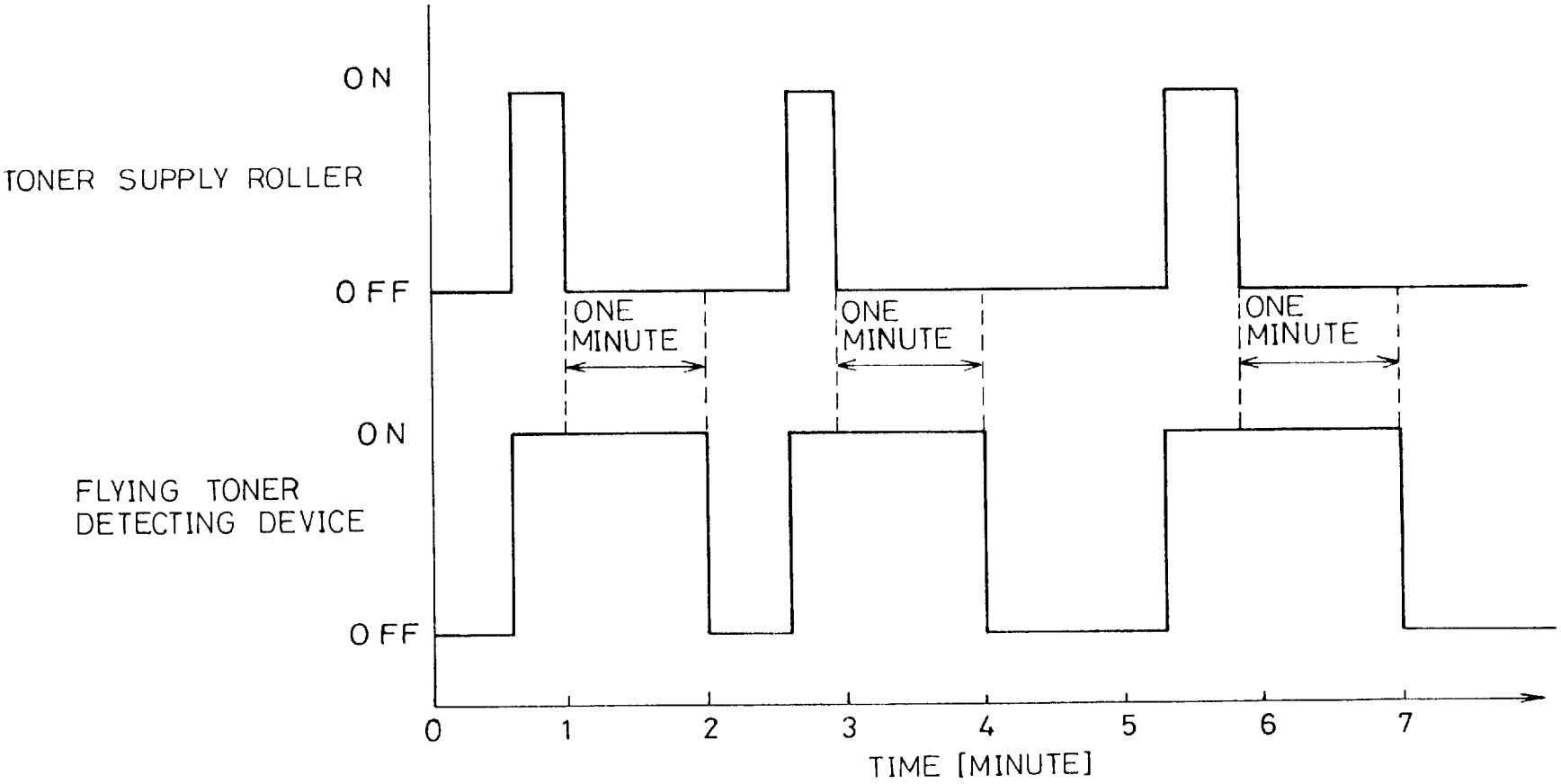
FIG. 20 shows a control operation of a timing controlling section in the control unit, and also shows the relationship between a toner supply operation for supplying the toner to a toner hopper and a flying toner detecting operation.

In this case, as shown in FIG. 20, for example, the flying toner detecting device 40 is activated within a time between the start of the rotation of the toner supply roller 22*a* and one minute after the end of the rotation. The toner supply roller 22*a* transports the toner supplied to the toner hopper 22 to the developer container 28. More specifically, the supply of the toner to the toner hopper 22 is performed according to a detection made by a toner empty sensor, not shown, provided in the toner hopper 22. When the toner is supplied to the toner hopper 22 and the toner empty sensor detects this state, for example, if the front door of the copying machine 1 is closed and a door switch on the door is turned on, the development device 16 is activated and an agitating action is performed. At this time, if a shortage of toner is detected by the toner density sensor 23, the toner supply roller 22*a* is rotated to supply the toner from the toner hopper 22 to the developer container 28. The toner supplied here is the toner which has just been supplied to the toner hopper 22. Therefore, the flying toner detecting device 40 is activated at the same time as the toner supply roller 22*a* is activated, and continues to be operated until one minute elapses after the toner supply roller 22*a* is stopped.

During and just after the supply of the toner to the toner hopper 22, the amount of electrostatic charges of the toner in the toner hopper 22 and the developer container 28 is low, and the distribution of electrostatic charges is uneven.

Consequently, the toner tends to fly. Therefore, it is effective to detect the amount of the flying toner in a time between the start of the supply of the toner to the toner hopper 22 and just after the supply. The operation shown in FIG. 20 is an example of detecting the amount of flying toner just after the supply of the toner to the toner hopper 22. The flying toner detection is carried out during the supply of the toner to the toner hopper 22, for example, by supplying the toner from the toner hopper 22 to the developer container 28 while supplying the toner to the toner hopper 22, or by agitating the toner in the toner hopper 22 while supplying the toner to the toner hopper 22.

Next, a detection of the amount of flying toner to be performed when a predetermined time elapses after the supply of the toner to the toner hopper 22 is discussed.

Figure 21:
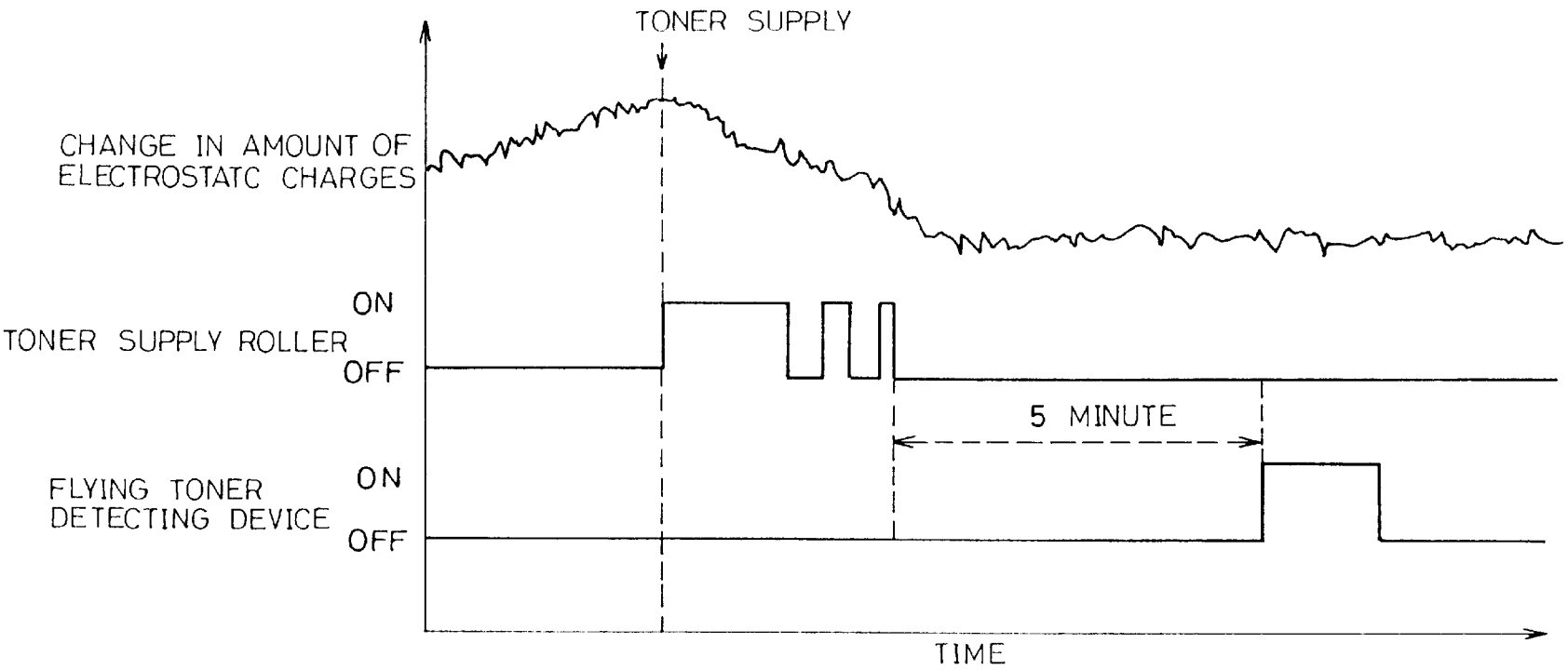
FIG. 21 is a timing chart showing the control operation of the timing controlling section in the control unit, and also shows the flying toner detecting operation when a predetermined time has elapsed after the completion of the supply of the toner to the toner hopper.

In this case, for example, as shown in FIG. 21, the flying toner detecting device 40 is activated when five minutes elapses after the completion of the supply of the toner. If toner is newly supplied when the toner hopper 22 is empty, an excessive amount of toner tends to be supplied temporarily. At this time, after the supply of the toner, by agitating the toner for a while, the toner is sufficiently charged and enters into a stable state. By detecting the flying toner when the predetermined time has passed after the supply of the toner, it is possible to confirm a flying toner preventive state when the toner is in the stable state, thereby preventing flying toner in the next copying operation. If the detection of the flying toner after the elapse of the predetermined time from the completion of the supply of the toner is carried out in combination with the detection of the flying toner which is to be performed in a time between the start of the supply of the toner to the toner hopper 22 and just after the supply, the toner can be surely and effectively prevented from flying.

Figure 22:
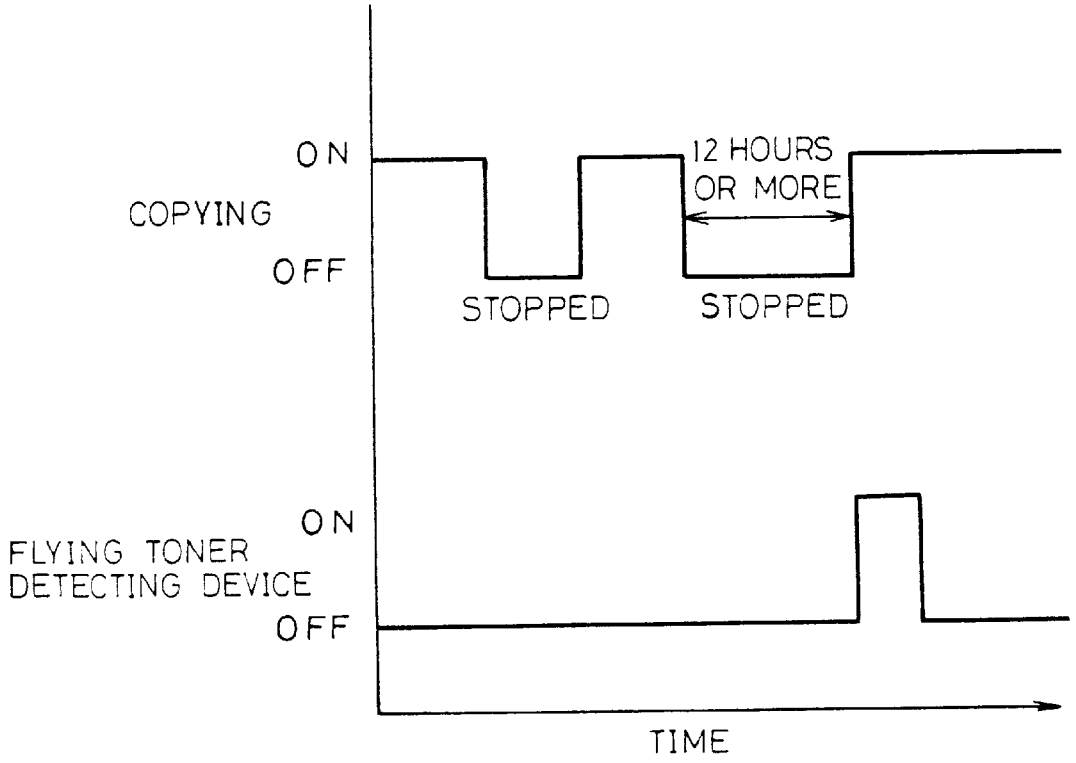
FIG. 22 is a timing chart showing a control operation performed by the timing controlling section of the control unit to detect the amount of flying toner when a predetermined leave time has elapsed.

Next, the detection of the flying toner based on the leave time is explained. In this structure, after leaving the copying machine 1 without being operated for a predetermined time or more, the amount of flying toner is detected. For example, as shown in FIG. 22, when the copying machine 1 is in a stopped state, i.e., the leave time continues, for 12 hours or more between a copying operation and the next copying operation, the flying toner detecting device 40 is activated.

Namely, when the copying stop state continues, the amount of electrostatic charges of the developer decreases due to a leakage, and the toner tends to fly. Therefore, when development resumes after the elapse of a predetermined leave time, the amount of flying toner is detected while both or one of the agitation roller 24 and the toner supply roller 22*a* are/is rotating. In this structure, since the amount of the flying toner is detected before resuming copying, it is possible to give a feedback about flying toner from the first sheet of copy. It is thus possible to always prevent the toner from flying.

Figure 23:
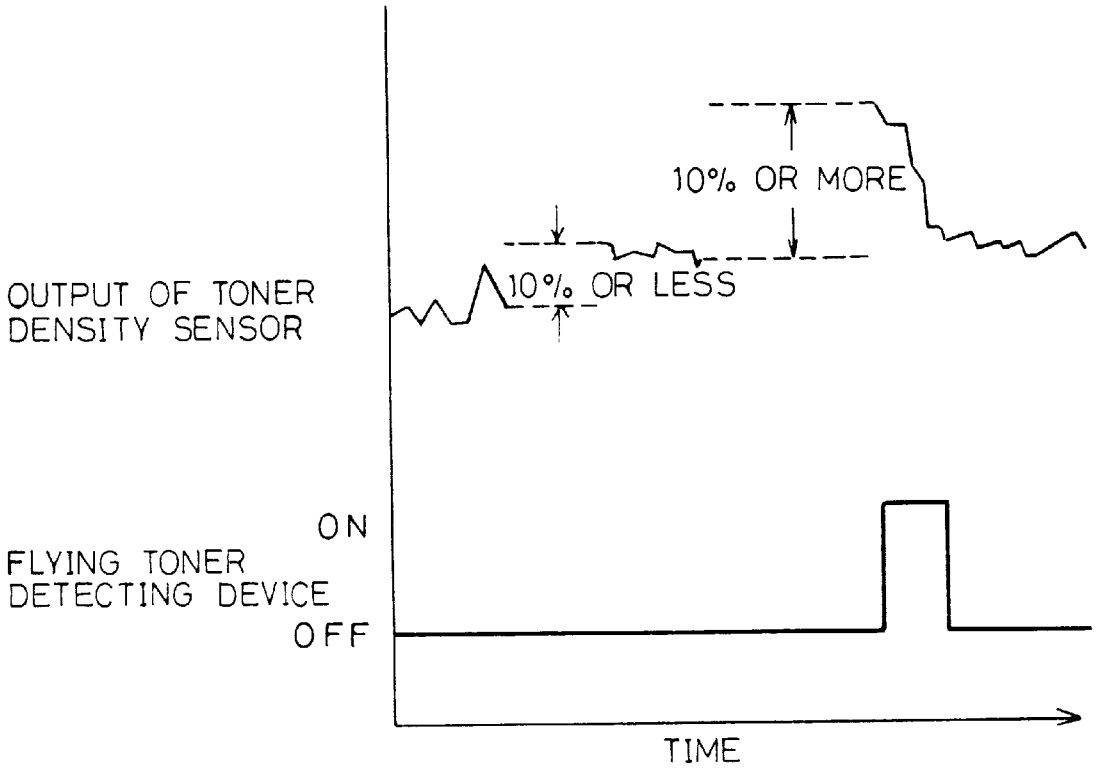
FIG. 23 is a timing chart showing a control operation performed by the timing controlling section of the control unit to detect the amount of flying toner when a change in the output of the toner density sensor exceeds a predetermined value.

Next, a detection based on a change in the output of the toner density sensor 23 is explained. When the change in the output of the toner density sensor 23 becomes or exceeds a predetermined value, the amount of flying toner is detected. For example, as shown in FIG. 23, when the output of the toner density sensor 23 changes by 10 percent or more, the flying toner detecting device 40 is activated.

More specifically, as described above, when the copying stop state continues, the amount of electrostatic charges of the developer is lowered due to a leakage. When copying is resumed after a predetermined leave time, if the change in the output of the toner density sensor 23 is great, an excessive amount of toner is supplied temporarily and the toner tends to fly. If the amount of the flying toner is detected while both or one of the agitation roller 24 and the toner supply roller 22*a* are/is rotating when the change in the output of the toner density sensor 23 becomes or exceeds 10 percent, the amount of the flying toner is detected before resuming development. Consequently, a feedback about flying toner can be applied from the first sheet of copy, thereby always preventing the toner from flying.

Figure 24:
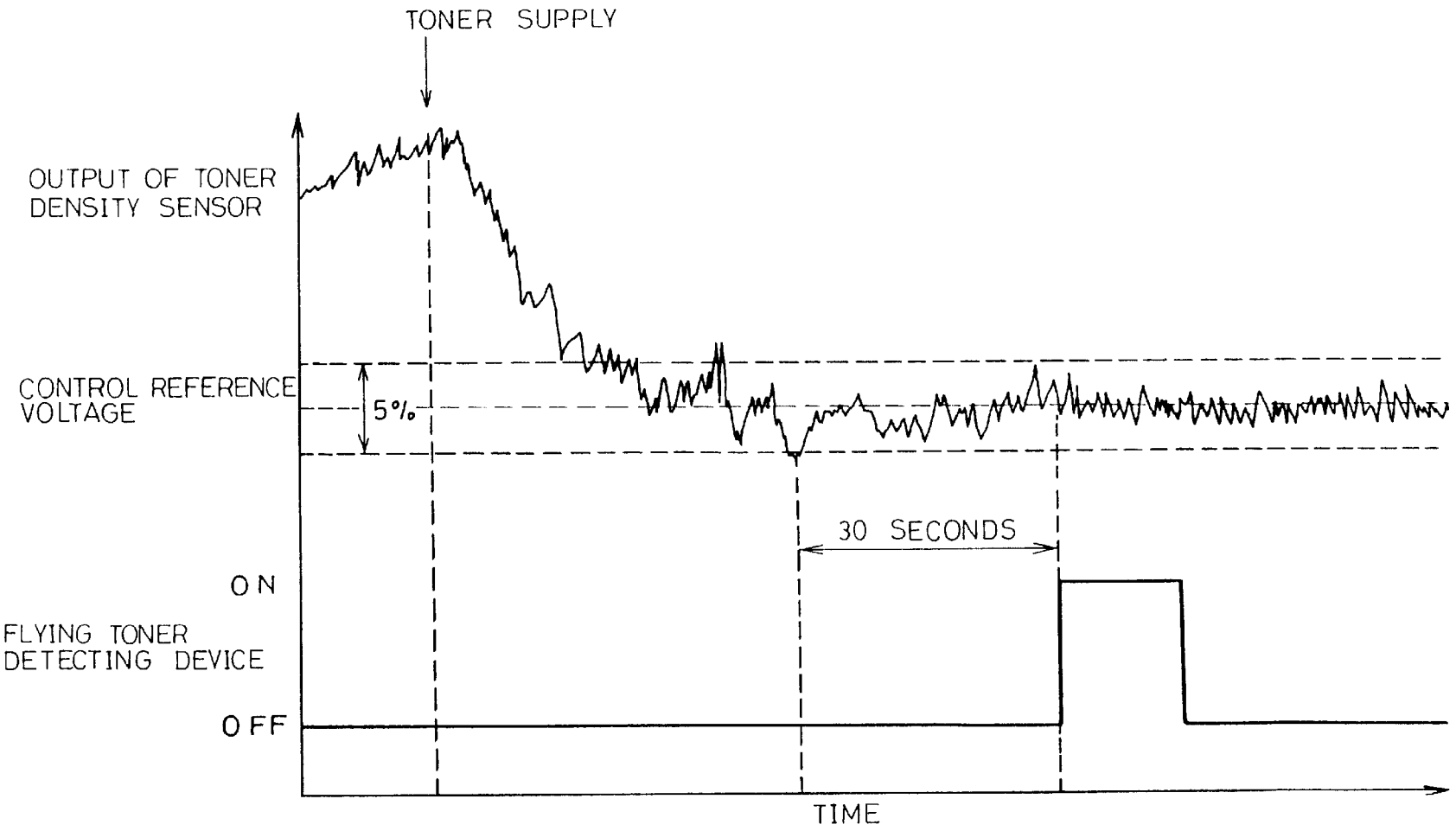
FIG. 24 is a timing chart showing a control operation performed by the timing controlling section of the control unit to detect the amount of flying toner when a change in the output of the toner density sensor is stabilized for a predetermined time after the supply of the toner.

It is also possible to use another structure for the detection based on the change in the output of the toner density sensor 23. For example, as shown in FIG. 24, when copying is resumed from the copying stop state or when copying is resumed by supplying the toner to the toner hopper 22, the flying toner detecting device 40 is activated after the output of the toner density sensor 23 shows a great change before and after the resume and reaches a stable level.

In short, if the image forming operation is kept in the stopped state, the amount of electrostatic charges of the developer decreases due to a leakage, but increases when copying is resumed after a passage of the predetermined leave time.

When the increase of the amount of electrostatic charges is moderate, the toner density sensor 23 which detects the toner density based on the magnetic permeability of the developer detects a low toner density. Therefore, when the agitation of the developer and the supply of toner continue to be performed until the output level of the toner density sensor 23 stably coincides with a reference level, the supply of the toner becomes excessive and the toner tends to fly.

Meanwhile, the agitation of the developer and the supply of toner continue to be performed even after the supply of the toner to the toner hopper 22 until the output of the toner density sensor 23 coincides with the reference value in a stable manner. The amount of electrostatic charges of the supplied toner increases and slightly charged toner tends to fly during the agitation of the supplied toner.

When the amount of the flying toner is detected in this state, i.e., in the state where the output of the toner density sensor 23 changes from the instable state to a stable level, the amount of the flying toner is detected before resuming copying. It is therefore possible to apply a feedback control about flying toner from the first sheet of copy, and always prevent the toner from flying.

In this embodiment, as shown in FIG. 24, if the level of the toner density sensor 23 enters into the stable state or not is judged depending on whether the variation in the control reference voltage is kept within a range of 5 percent for about 30 seconds or more.

Figure 25:
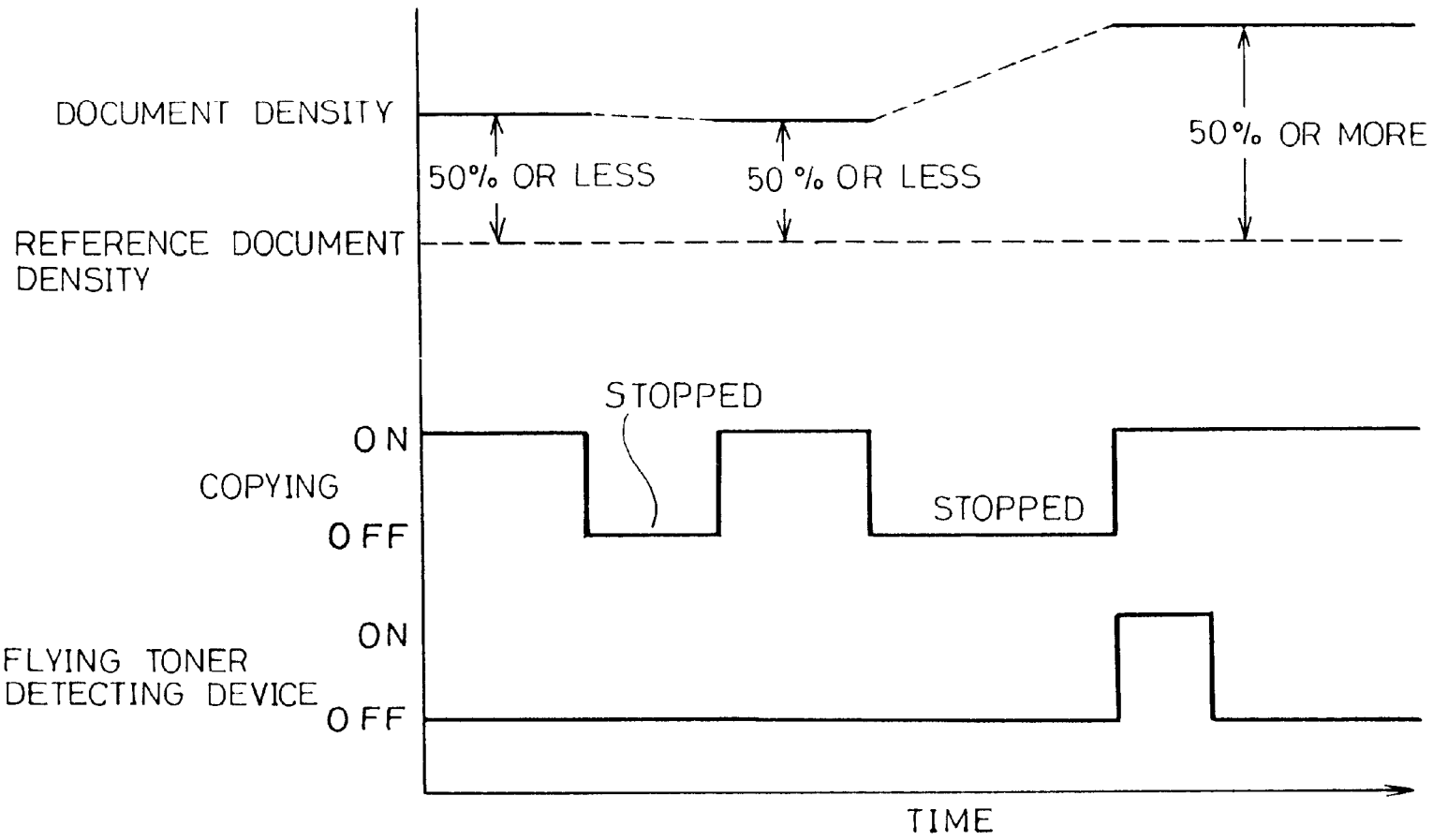
FIG. 25 is a timing chart performed by the timing controlling section of the control unit to detect the amount of flying toner when the document density is high.

Next, the structure for detecting the flying toner based on the document density is explained. In this structure, the amount of flying toner is detected when a document whose density is higher than a predetermined level is copied. For example, as shown in FIG. 25, when the document density detected by the automatic exposure sensor 5 as a document density reading sensor changes from an initially registered reference document density by 50 percent or more, the amount of the flying toner is detected.

Figure 26:
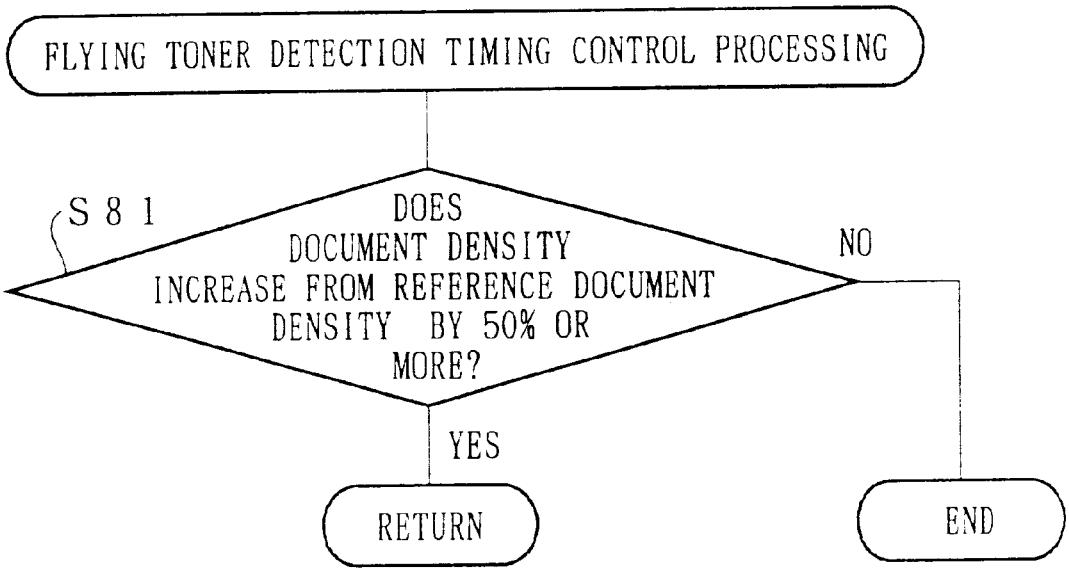
FIG. 26 shows flying toner detection timing control performed by the timing controlling section of the control unit, and is a flow chart for detecting the amount of flying toner when the document density is high.

The control performed by the timing controlling section 60 is specifically shown in the flow chart of FIG. 26. As shown in FIG. 26, the timing controlling section 60 judges whether the document density changes from the reference document density by at least 50 percent (S81). When the document density changes from the reference document density by 10 percent or more, the flying toner detection processing is performed and then flying toner preventive processing is carried out (see FIG. 4).

When a document whose density is higher than a predetermined density is copied, since a large amount of toner is consumed, the amount of the supplied toner also increases.

The increase in the amount of the supplied toner lowers the amount of electrostatic charges in a moment, and raises the amount of flying toner. Therefore, in the above-mentioned control, by detecting an increase in the document density that is higher than the predetermined value, an increase in the amount of the supplied toner and an increase in the amount of flying toner are predicted so as to perform the flying toner preventive processing at an early stage.

Next, a detection based on the consumption of toner is discussed. In this structure, the amount of flying toner is detected when the amount of the toner consumed is more than a predetermined amount. For example, the amount of flying toner is detected when the number of rotations of the toner supply roller 22*a* per 100 copies is increased by 10 percent from the initial reference value or the previous number of rotations. This structure uses such a characteristic that the toner consumption is proportional to the number of rotations of the toner supply roller 22*a*.

Figure 27:
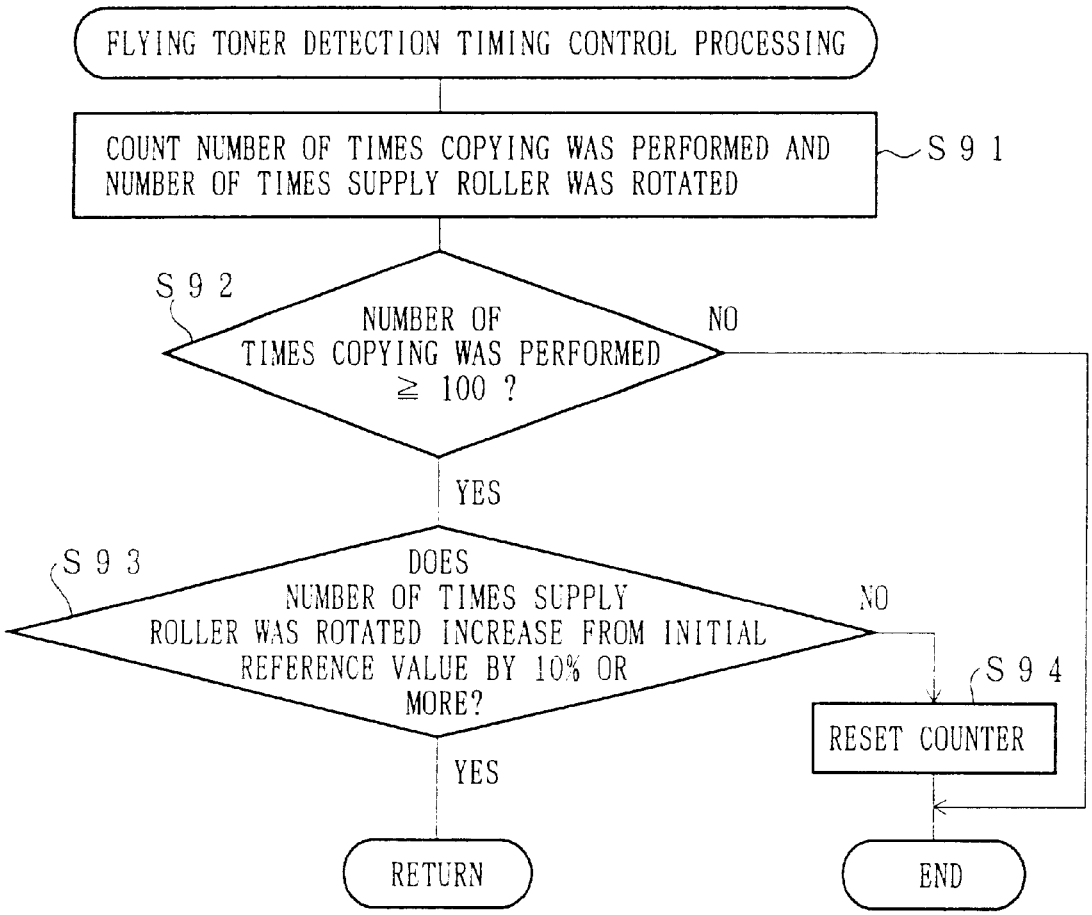
FIG. 27 shows flying toner detection timing control performed by the timing controlling section of the control unit, and is a flow chart for detecting the amount of flying toner when the number of times copying performed and the rotation speed of the supply roller reach or exceed a predetermined level.

The control performed by the timing controlling section 60 is specifically shown in the flow chart of FIG. 27. As shown in FIG. 27, the timing controlling section 60 counts the number of times copying was performed and the number of rotations of the toner supply roller 22*a* (S91). Subsequently, whether the number of times copying was performed reaches 100 or not is judged (S92). If the number of times copying was performed reaches 100, whether the number of rotations of the toner supply roller 22*a* is increased by at least 10 percent from the initial reference value is judged (S93). If the number of rotations of the toner supply roller 22*a* is increased by at least 10 percent from the initial reference value, the flying toner detection processing and then the flying toner preventive processing are performed (see FIG. 4). After the flying toner preventive processing, the count is reset (not shown).

On the other hand, if the number of times copying was performed is less than 100, the operation is just terminated. Moreover, if the number of rotations of the toner supply roller 22*a* is increased by less than 10 percent from initial reference value, the operation is terminated after resetting the count (S94).

Thus, when the number of rotations of the toner supply roller 22*a* becomes higher than the initial reference value, i.e., the amount of the supplied toner per unit time becomes higher than the initial reference amount, it takes a longer time to charge the supplied toner than a time usually taken, and development is performed under a condition in which the amount of electrostatic charges of the toner is low. Consequently, the toner tends to fly. Since the possibility that flying toner occurs is the highest at this time, the flying toner can be effectively prevented by detecting the amount of the flying toner at this time.

Next, the structure for detecting the flying toner based on the temperature is explained. In this structure, the amount of flying toner is detected when the temperature of the outside air or in the copying machine reaches or exceeds a predetermined temperature. For example, the amount of flying toner is detected when the temperature at an upper section of the developer container 28 detected during copying by the temperature and humidity sensor 29 shown in FIG. 1 is equal to or higher than 50° C.

Figure 28:
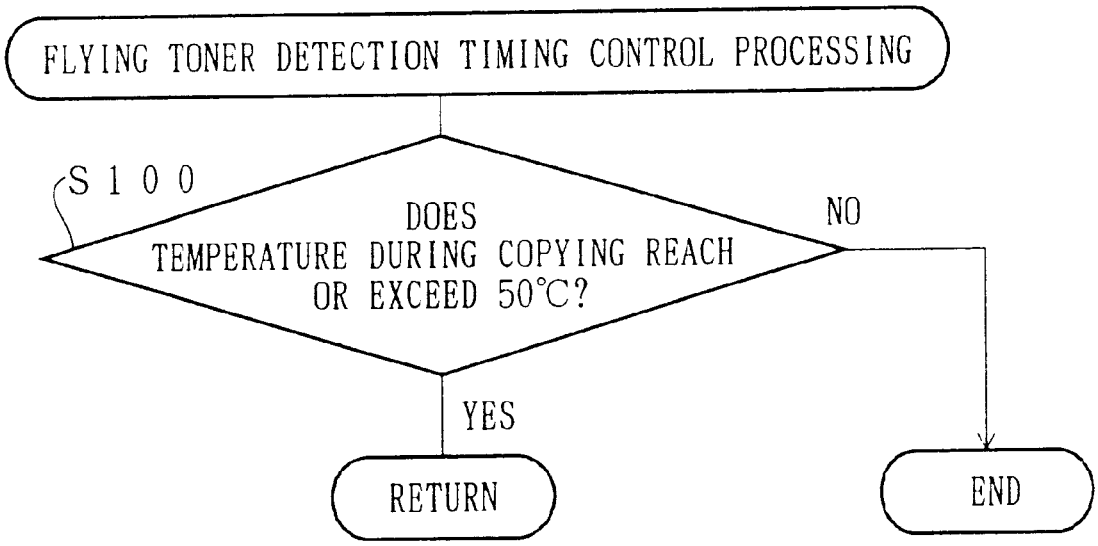
FIG. 28 shows flying toner detection timing control performed by the timing controlling section of the control unit, and is a flow chart for detecting the amount of flying toner when the temperature reaches or exceeds a predetermined level during copying.

The control performed by the timing controlling section 60 is specifically shown in the flow chart of FIG. 28. As shown in FIG. 28, the timing controlling section 60 judges whether the temperature in the copying machine during copying is not lower than 50° C. (S100). When the temperature in the copying machine during copying is not lower than 50° C., the next flying toner detection processing and then the flying toner preventive processing are performed (see FIG. 4). On the other hand, when the temperature inside the copying machine during copying is lower than 50° C., the operation is completed without performing the flying toner detection processing.

Thus, when the temperature inside the machine and the temperature of the outside air increase, the amount of electrostatic charges of the toner is likely to be lowered, and the toner tends to fly. In particular, by detecting the flying toner when the temperature inside the machine and the outside air temperature reach a predetermined temperature, it is possible to predict an increase in the amount of the flying toner and take an effective measure to prevent the toner from flying at an early stage.

Next, the structure for detecting the flying toner based on the humidity is explained. In this structure, the amount of flying toner is detected when the humidity in the outside air or in the copying machine reaches or exceeds a predetermined humidity. For example, the amount of flying toner is detected when the humidity at the upper section of the developer container 28 detected during copying by the temperature and humidity sensor 29 shown in FIG. 1 reaches or exceeds 70 percent.

Figure 29:
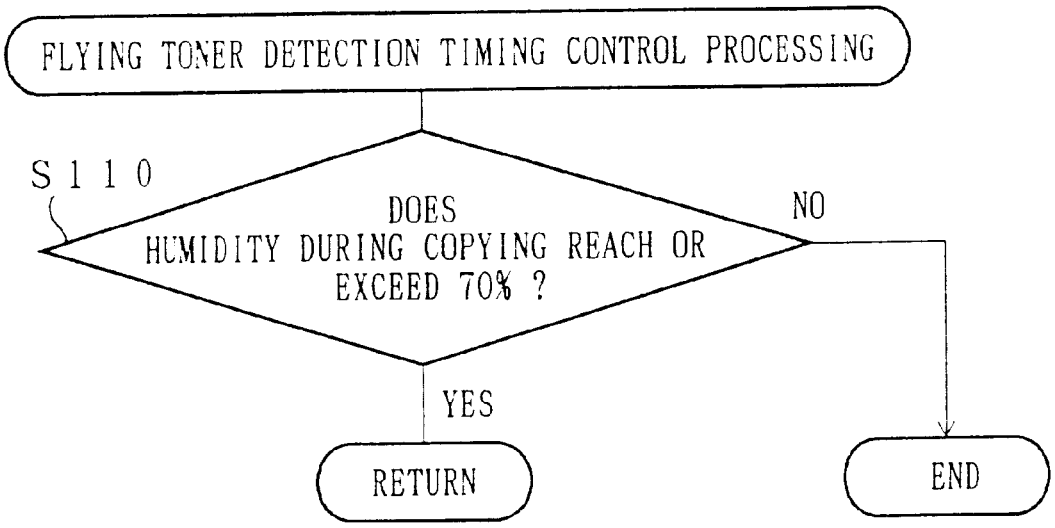
FIG. 29 shows flying toner detection timing control performed by the timing controlling section of the control unit, and is a flow chart for detecting the amount of flying toner when the humidity reaches or exceeds a predetermined level during copying.

The control performed by the timing controlling section 60 is specifically shown in the flow chart of FIG. 29. As shown in FIG. 29, the timing controlling section 60 judges whether the humidity in the copying machine is not lower than 70 percent during copying (S110). When the humidity in the copying machine is not lower than 70 percent during copying, the flying toner detection processing and then the flying toner preventive processing are performed (see FIG. 4). On the other hand, when the humidity in the copying machine is lower than 70 percent during copying, the operation is completed without performing the flying toner detection processing.

Thus, when the humidity inside the machine and the humidity in the outside air increase, the amount of electrostatic charges of the toner is lowered by a leakage of the electrostatic charges of the toner due to the moisture in the air, and the toner tends to fly. This is particularly prominent when the humidity inside the machine reaches or exceeds 70 percent. By detecting the flying toner when the humidity inside the machine and the humidity in the outside air reach a predetermined humidity level, it is possible to predict a lowering of the amount of electrostatic charges of the toner and an increase in the amount of the flying toner. Consequently, a measure can be taken at an early stage to effectively prevent the toner from flying.

Next, the structure for detecting the flying toner based on the developer agitation time is explained. In this structure, the amount of flying toner is detected when the agitation time of developer in the developer container 28 reaches or exceeds a predetermined time. For example, the amount of flying toner is detected every 30 minutes after the initiation of the agitation of the developer in the developer container 28.

Figure 30:
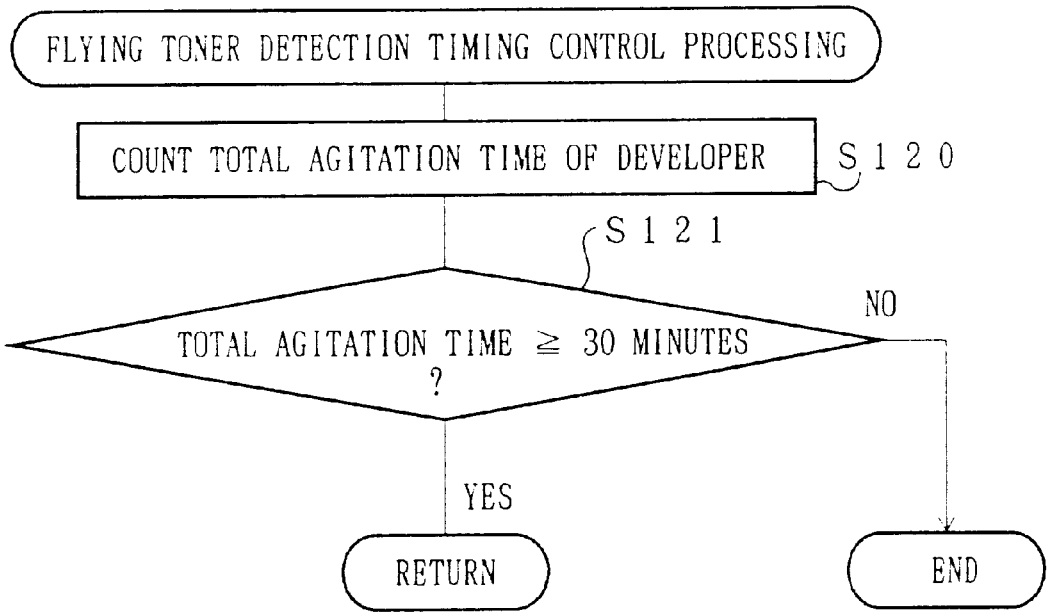
FIG. 30 shows flying toner detection timing control performed by the timing controlling section of the control unit, and is a flow chart for detecting the amount of flying toner when the total agitation time of the agitation roller in the developer container reaches or exceeds a predetermined level.

The control performed by the timing controlling section 60 is specifically shown in the flow chart of FIG. 30. As shown in FIG. 30, the timing controlling section 60 adds up the agitation time of the developer (S120) and judges whether the total agitation time reaches or exceeds 30 minutes (S121). If the agitation time reaches or exceeds 30 minutes, the flying toner detection processing and then the flying toner preventive processing are performed (see FIG. 4). After the flying toner preventive processing, the count is reset (not shown). On the other hand, if the total developer agitation time does not reach 30 minutes in S121, the operation is completed.

Thus, when the developer agitation time reaches or exceeds a predetermined time as the copying operation progresses and the life of the developer expires, the electrostatic charging property of the developer is suddenly lowered. As a result, the amount of electrostatic charges of the toner is reduced, and the amount of flying toner increases. Therefore, the use of the total developer agitation time for predicting the life of the developer is typical and effective means. In an alternative example, when the total agitation time reaches a predetermined time, the amount of flying toner is detected. If the detected value exceeds a predetermined value, it is judged that the life of the developer has come to an end.

Next, a structure for detecting the amount of flying toner based on the amount of toner collected by the cleaning unit 20 is discussed. In this structure, the amount of flying toner is detected when the amount of toner collected by the cleaning unit 20 per unit time reaches a predetermined amount. The cleaning unit 20 is provided to clean residual toner remaining on the photoreceptor drum 14 after development.

Figure 31:
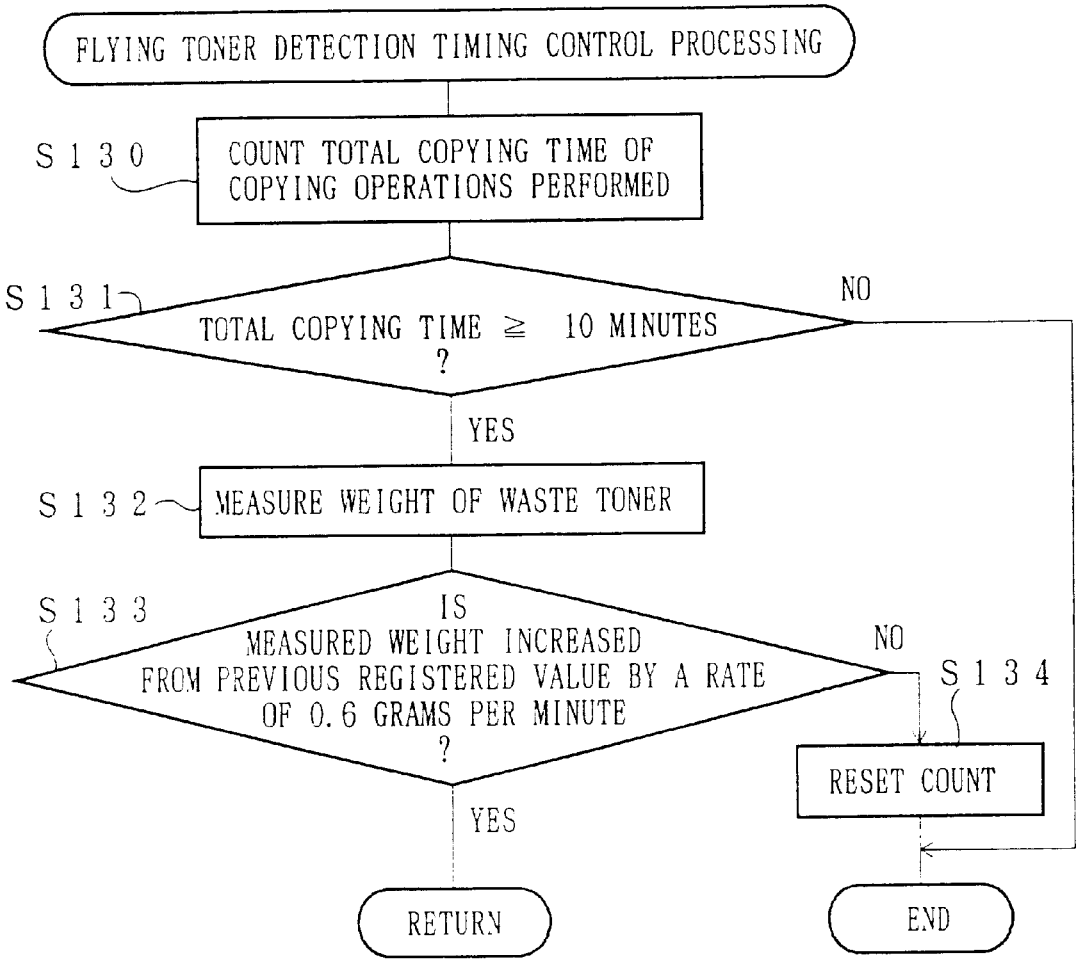
FIG. 31 shows flying toner detection timing control performed by the timing controlling section of the control unit, and is a flow chart for detecting the amount of flying toner when the weight of waste toner accumulated after the elapse of a predetermined time increases at a rate not lower than a predetermined rate.

The control performed by the timing controlling section 60 is specifically shown in the flow chart of FIG. 31. As shown in FIG. 31, the waste toner collected by the cleaning unit 20 is gathered in a recovery box through a transportation system (not shown). In FIG. 31, first, the timing controlling section 60 counts the total time of copying (S130), and then judges whether the copying time exceeds 10 minutes or not (S131).

If the copying time exceeds 10 minutes, the weight of the waste toner is measured (S132). Subsequently, the timing controlling section 60 judges whether the measured value is increased at a rate, for example, 0.6 grams per minute or more, compared to a previously registered value (S133). For example, if the measured value shows an increase of 0.6 grams per minute from the previously registered value, the flying toner detection processing and then the flying toner preventive processing are performed (see FIG. 4). The count is reset after the flying toner preventive processing.

On the other hand, for example, if the measured value does not show an increase of 0.6 grams per minute from the previously registered value, the count is reset (S134), and then the operation is completed. Similarly, when the copying time does not exceed 10 minutes in S133, the operation is completed.

In this control, when the amount of the residual toner collected from the photoreceptor drum 14 after development, it is judged that the consumption of the toner is great and a large amount of the toner is supplied to the developer container 28. In this state, the amount of electrostatic charges of the toner in the developer container 28 is lowered, and the toner tends to fly. Therefore, if the amount of the flying toner is detected in this state, a satisfactory detection can be performed and the flying toner preventive control is performed in an excellent manner.

As described above, in the copying machine 1 of this embodiment, the timing controlling section 60 controls the timing of the detection of the amount of the flying toner performed by the flying toner detecting device 40. Namely, in order to prevent the toner from flying, it is important to detect the amount of flying toner when the possibility of the occurrence of flying toner is high. Considering this fact, in the structure of this embodiment, since the timing of the detection of the amount of flying toner is controlled by the timing controlling section 60, it is possible to efficiently and surely prevent the toner from flying.

Embodiment 3

The following description will discuss still another embodiment of the present invention with reference to FIGS. 3 and 32 to 41. The members having the same function as in Embodiments 1 and 2 will be designated by the same code and their description will be omitted.

This embodiment mainly explains the control performed by the development controlling section 53 of the control unit 27 shown in FIG. 3.

In this embodiment, in order to prevent the toner from flying, development is adjusted by controlling the processing elements used for the image formation according to the amount of flying toner detected. More specifically, the development controlling section 53 performs development control such as DC bias control, charging blade bias control, charging blade pressure control, DSD (drum sleeve distance) control, and development gap control.

Each development control will be separately explained below.

First, the DC bias control is discussed. With this control, as shown in FIG. 32, the power of the development roller 16*a* for holding the toner thereon is improved by shifting a DC bias voltage 91 to be applied to the development roller 16*a* in a polarity opposite to a desired polarity in which the toner is to be charged.

Figure 33:
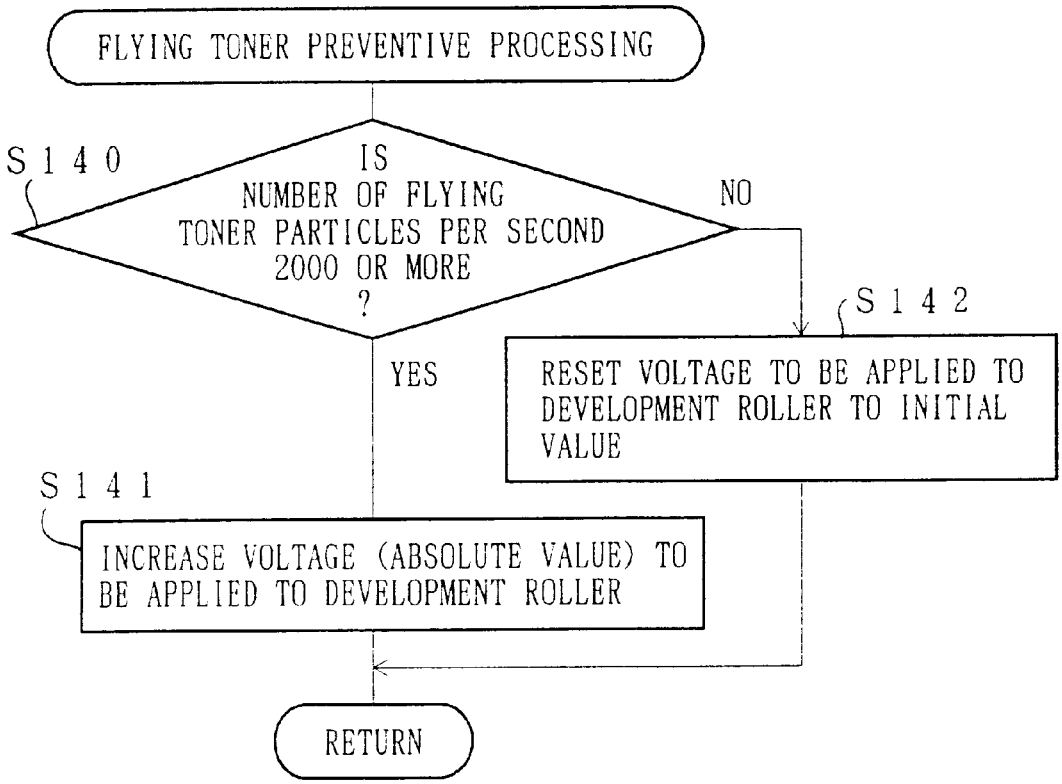
FIG. 33 is a flow chart showing flying toner preventive processing when a voltage to be applied to the development roller of the development controlling section in the control unit is increased.

The control performed by the development controlling section 53 is specifically shown in the flow chart of FIG. 33. As shown in FIG. 33, the development controlling section 53 judges whether the number of flying toner particles per second is not less than 2000 (S140). If the number of flying toner particles per second is not less than 2000, the development controlling section 53 shifts the DC bias voltage to be applied to the development roller 16*a* in a polarity opposite to a desired polarity of the toner by an absolute value within a range of from 10 to 500 V with respect to the set value (S141). On the other hand, if the number of flying toner particles per second is less than 2000, the voltage applied to the development roller 16*a* is reset to the initial value (S142).

Thus, by shifting the DC bias voltage 91 to be applied to the development roller 16*a* in a polarity opposite to a desired polarity of the toner, it is possible to increase the power of the development roller 16*a* for holding the toner and prevent the toner from flying. With the application of this control, flying toner and the background fog can be reduced without varying the amount of electrostatic charges of the toner.

Figure 32:
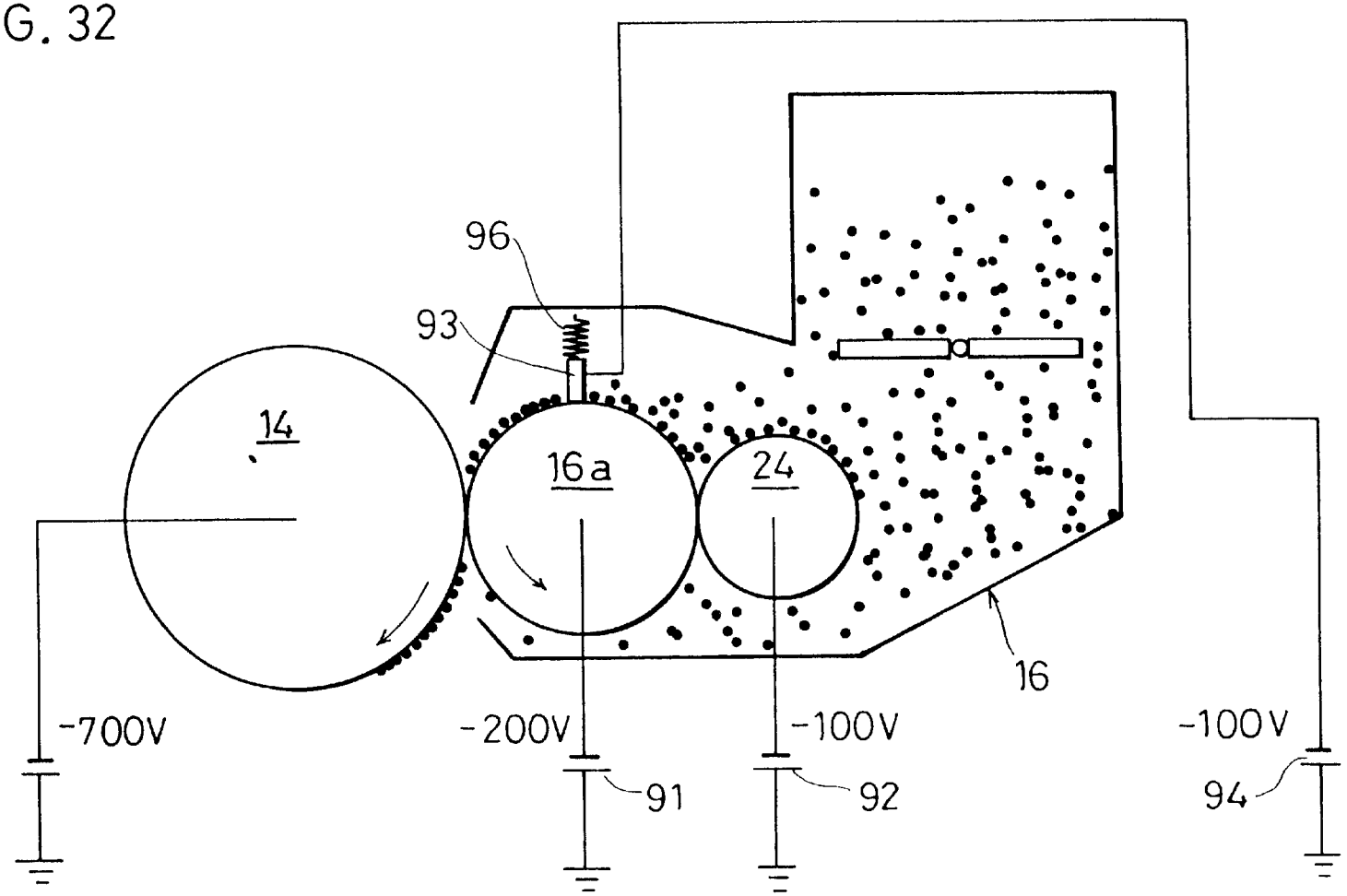
FIG. 32 is a structural view showing a bias voltage to be applied to the photoreceptor drum of the copying machine.

In an alternative example of the DC bias control, the charging property of the developer is improved by shifting a voltage to be applied to the agitation roller 24 shown in FIG. 32 in a polarity opposite to a desired polarity in which the toner is charged. The voltage 92 is used to impart 5 to 95 percent of the final amount of electrostatic charges required for development in advance to a one-component toner. Although this structure is particularly effective in the development using a one-component developer, it is also applicable to development using a two-component developer.

Figure 34:
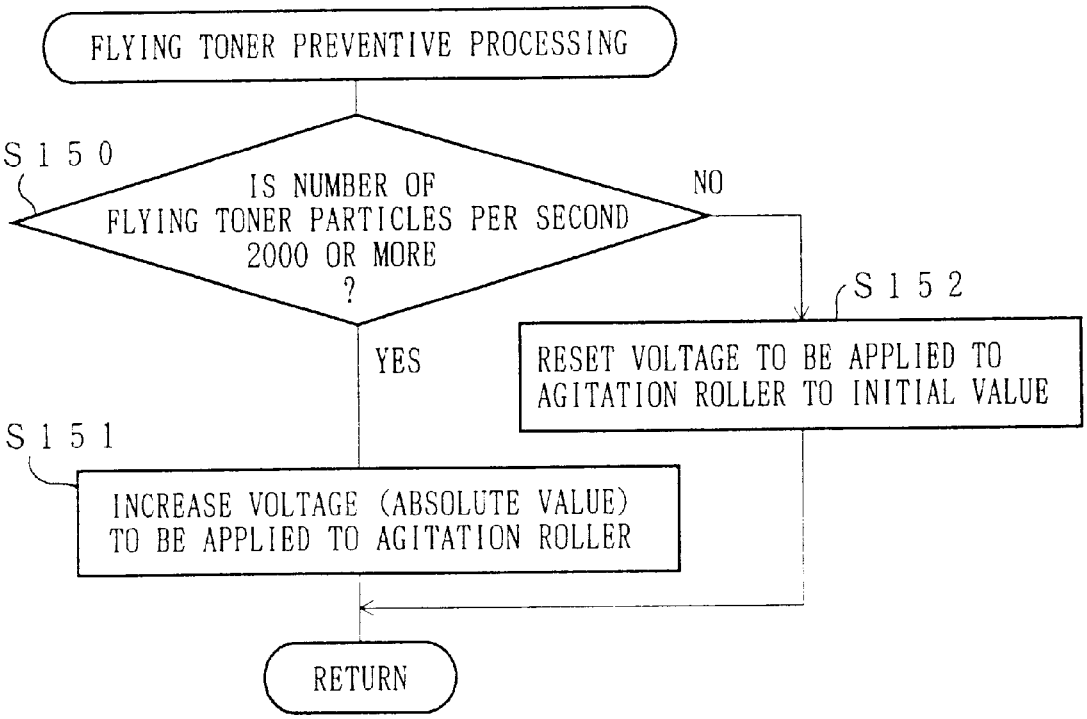
FIG. 34 is a flow chart showing flying toner preventive processing when a voltage to be applied to the agitation roller of the development controlling section in the control unit is raised.

The control performed by the development controlling section 53 is specifically shown in the flow chart of FIG. 34. As shown in FIG. 34, first, the development controlling section 53 judges whether the number of flying toner particles per second is not less than 2000 (S150). If the number of flying toner particles per second is not less than 2000, the development controlling section 53 shifts the voltage 92 to be applied to the agitation roller 24 in a polarity opposite to a desired polarity in which the toner is charged by an absolute value within a range of from 10 to 500 V (S151). More specifically, when the polarity of the toner is positive, the voltage 92 is usually shifted by an amount ranging from −10 to −500 V with respect to the agitation roller 24. On the other hand, if the number of flying toner particles per second is less than 2000 in S150, the voltage applied to the agitation roller 24 is reset to the initial value (S152).

Thus, by shifting the voltage 92 to be applied to the agitation roller 24 located in front of the development roller 16*a* in a polarity opposite to a desired polarity of the toner, it is possible to improve the charging property of the developer. With the application of this control, the toner can be easily charged between the development roller 16*a* and the charging blade, and particularly the amount of slightly charged toner in a one-component developer is reduced, thereby preventing the toner from flying.

Next, the charging blade bias control is explained. This control is performed so as to charge the developer in an improved manner by shifting a voltage 94 to be applied to the charging blade 93 in a polarity opposite to a desired polarity in which the toner is to be charged. The charging blade 93 is provided for giving 100 percent of a desired amount of electrostatic charges to the developer. This control is particularly effective for a one-component developer.

Figure 35:
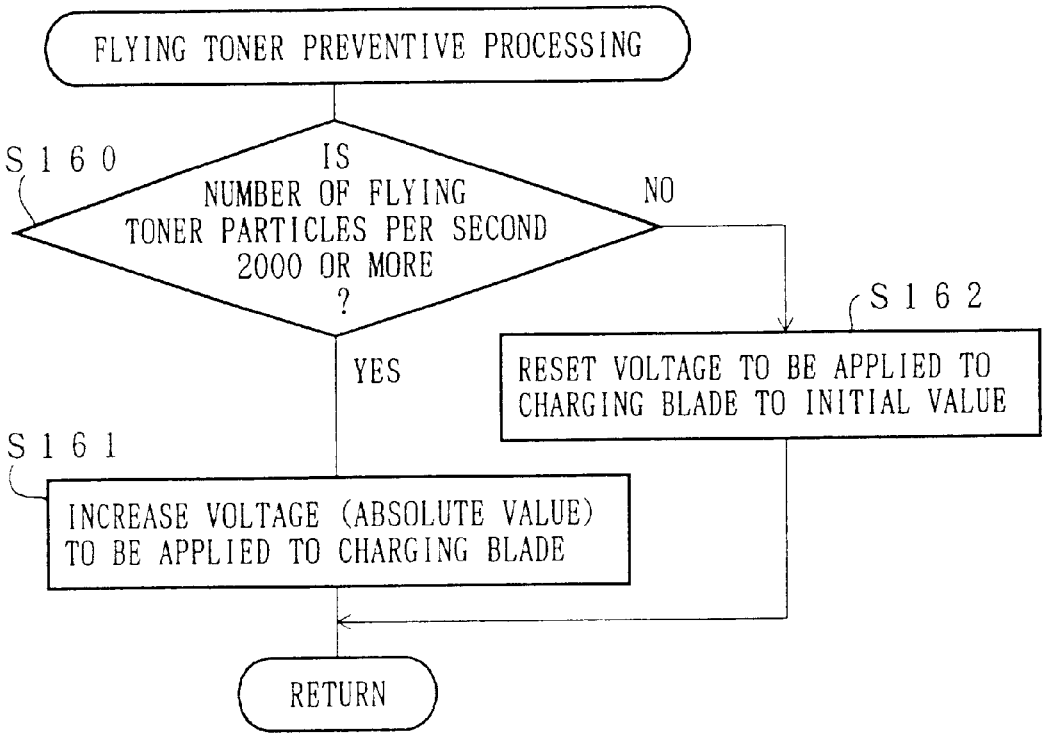
FIG. 35 is a flow chart showing flying toner preventive processing when a voltage to be applied to the charging blade of the development controlling section in the control unit is raised.

The control performed by the development controlling section 53 is specifically shown in the flow chart of FIG. 35. As shown in FIG. 35, first, the development controlling section 53 judges whether the number of flying toner particles per second is not less than 2000 (S160). If the number of flying toner particles per second is not less than 2000, the voltage 94 to be applied to the charging blade 93 is shifted in a polarity opposite to a polarity in which the toner is charged by simply increasing an absolute value within range of 5 to 200 V (S161). Namely, when the polarity of the toner is positive, the voltage to be applied to the charging blade 93 is usually shifted by an amount of −5 to −200 V. On the other hand, if the number of flying toner particles per second is less than 2000 in S160, the voltage to be applied to the charging blade 93 is reset to the initial value (S162).

Thus, by shifting the voltage 94 to be applied to the charging blade 93 in a polarity opposite to the polarity in which the toner is to be charged, it is possible to charge the developer in an improved manner. With the application of this control, the amount of electrostatic charges, particularly, that of the one-component developer is increased, thereby reducing the flying toner.

Figure 36B:
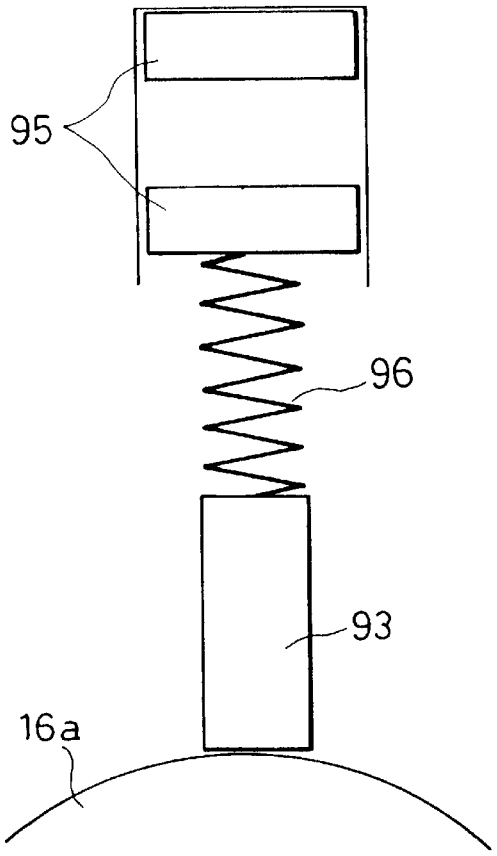
FIG. 36(*a*) is an explanatory view showing a normal operation of a device for changing the pressure of the charging blade in the copying machine, and FIG. 36(*b*) is an explanatory view showing a flying toner preventive operation of the device.
Figure 36A:
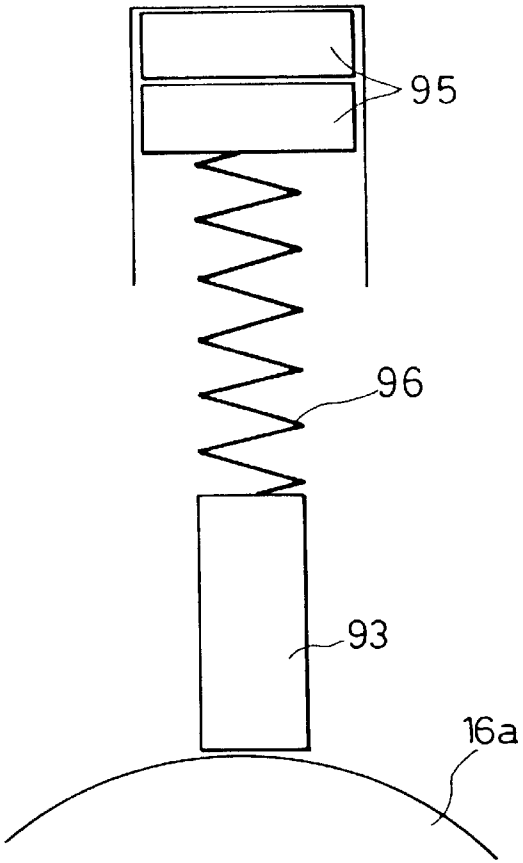

Next, the charging blade pressure control is discussed. This control is performed so as to change the pressure to be applied to the charging blade 93 according to a value detected by the flying toner detecting device 40. The charging blade 93 is provided to give 100 percent of a desired amount of electrostatic charges to the developer. Therefore, a pressure spring 96 is mounted on the charging blade 93, and a solenoid 95 as pressure adjusting means is installed to compress and extend the pressure spring 96. In this structure, when the amount of the flying toner is larger than a predetermined value, the pressure applied to the charging blade 93 in the direction of the development roller 16*a* is increased by 5 to 100 percent as shown in FIG. 36(*b*) from a normal state shown in FIG. 36(*a*). This control is particularly effective for one-component developer.

Figure 37:
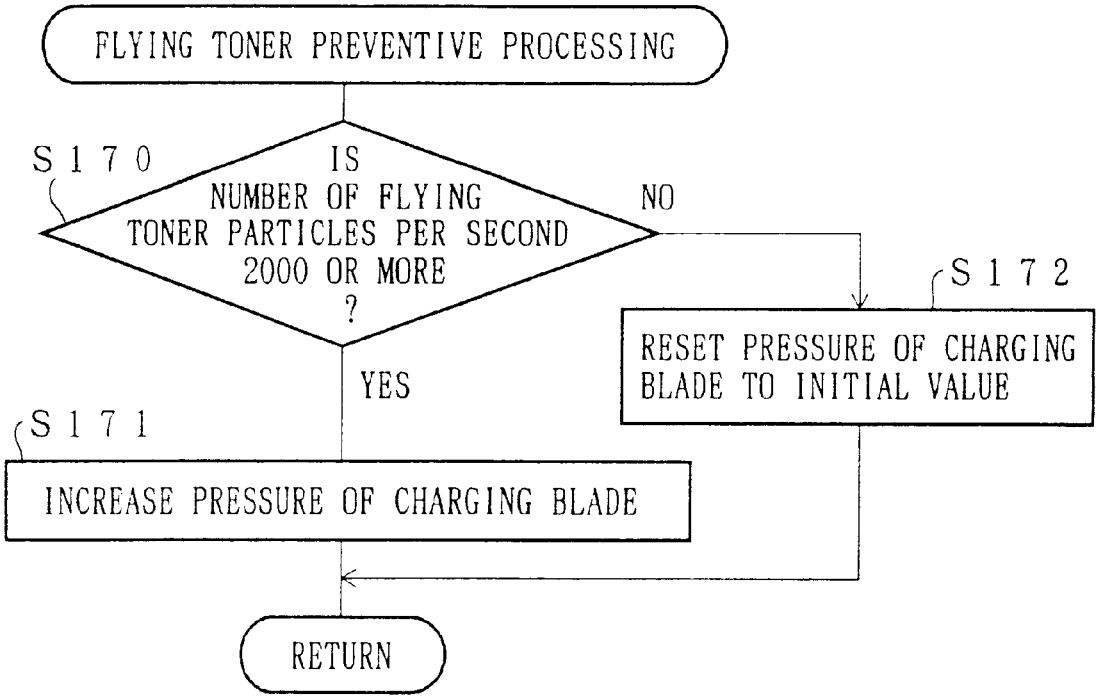
FIG. 37 shows flying toner preventive processing of the development section in the control unit, and is a flow chart of an operation for increasing the pressure of the charging blade.

The control performed by the development controlling section 53 is specifically shown in the flow chart of FIG. 37. As shown in FIG. 37, first, the development controlling section 53 judges whether the number of flying toner particles per second is not less than 2000 (S170). If the number of flying toner particles per second is not less than 2000, the development controlling section 53 controls the solenoid 95 so as to increase the pressure to be applied to the charging blade 93 by 5 to 100 percent from the normal value according to a value detected by the flying toner detecting section 40. On the other hand, if the number of flying toner particles per second is less than 2000 in S160, the pressure to be applied to the charging blade 93 is reset to the initial value (S172).

Thus, by increasing the pressure to be applied to the charging blade 93, the friction between the charging blade 93 and the development roller 16*a* is increased, and the amount of electrostatic charges of the toner is increased particularly when the developer is one-component developer. It is therefore possible to reduce the flying toner.

Figure 38A:
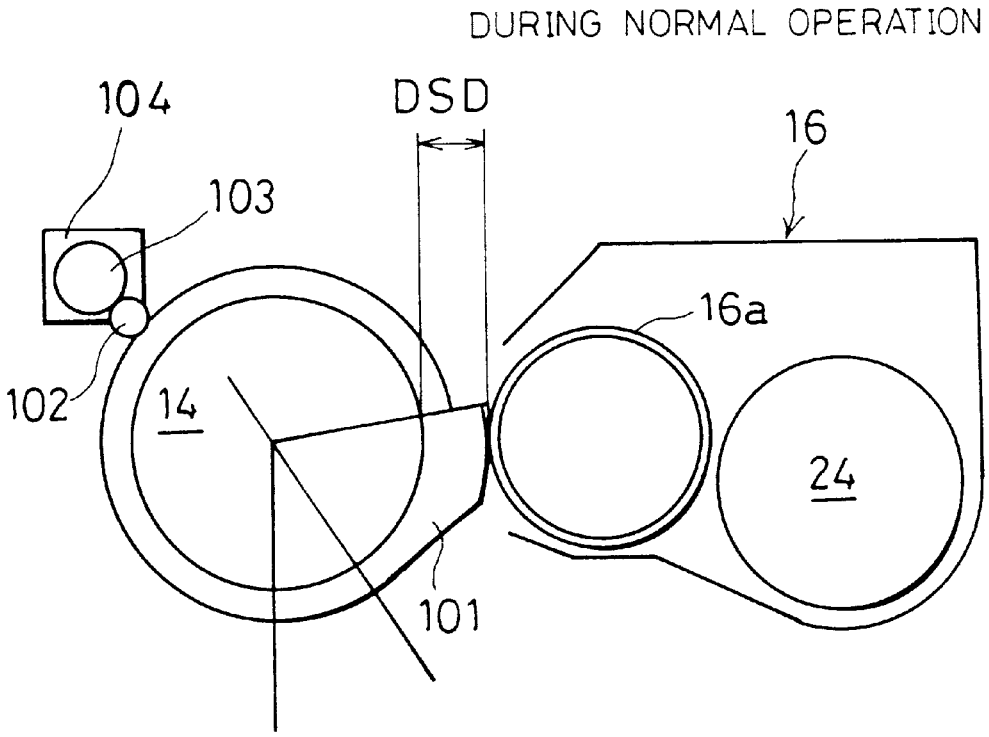
FIGS. 38(*a*) and 38(*b*) are the structural views of a device for changing the distance DSD between the photoreceptor drum and the development roller in the copying machine, wherein FIG. 38(*a*) shows a DSD in a normal operation and FIG. 38(*b*) shows a DSD during the flying toner preventive processing.
Figure 38B:
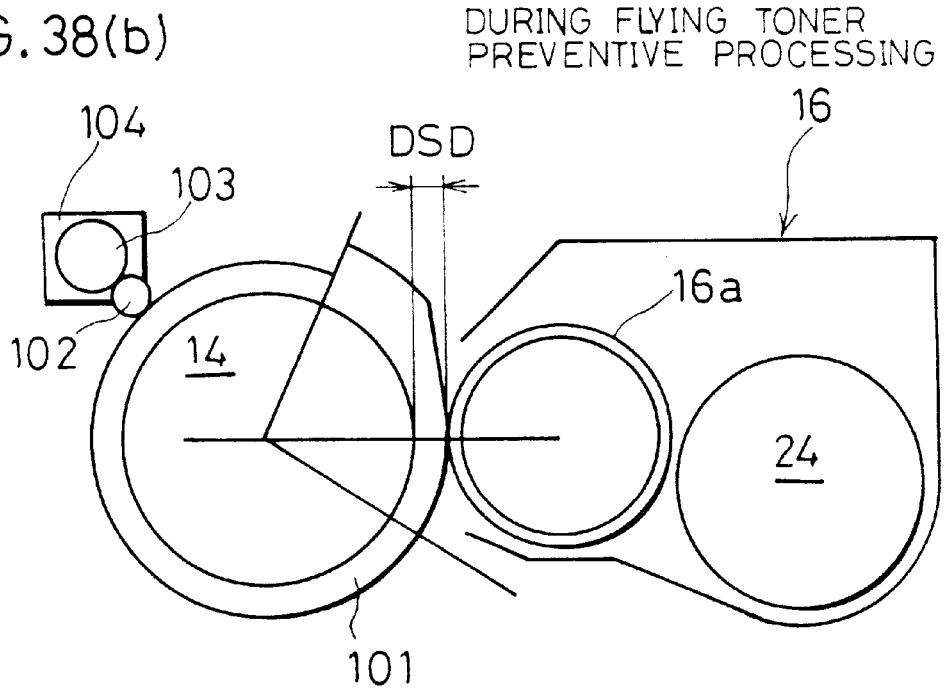

Next, the DSD control is explained. As shown in FIG. 38(*a*), the DSD, i.e., the distance between the development roller 16*a* and the photoreceptor drum 14, is narrowed by a unit of 0.1 mm shown in FIG. 38(*b*) according to a value detected by the flying toner detecting device 40.

Namely, in order to change the DSD, a DSD adjustment collar 101 having a portion protruding outward in a radial direction of the photoreceptor drum 14 is mounted coaxial with the photoreceptor drum 14. The DSD adjustment collar 101 as distance adjusting means is driven by a driving motor 104 through gears 102 and 103. When the DSD adjustment collar 101 is driven to rotate by the driving motor 104, the peripheral section of the DSD adjustment collar 101 presses the development roller 16*a*. As a result, the DSD is changed by a unit of 0.1 mm.

Figure 39:
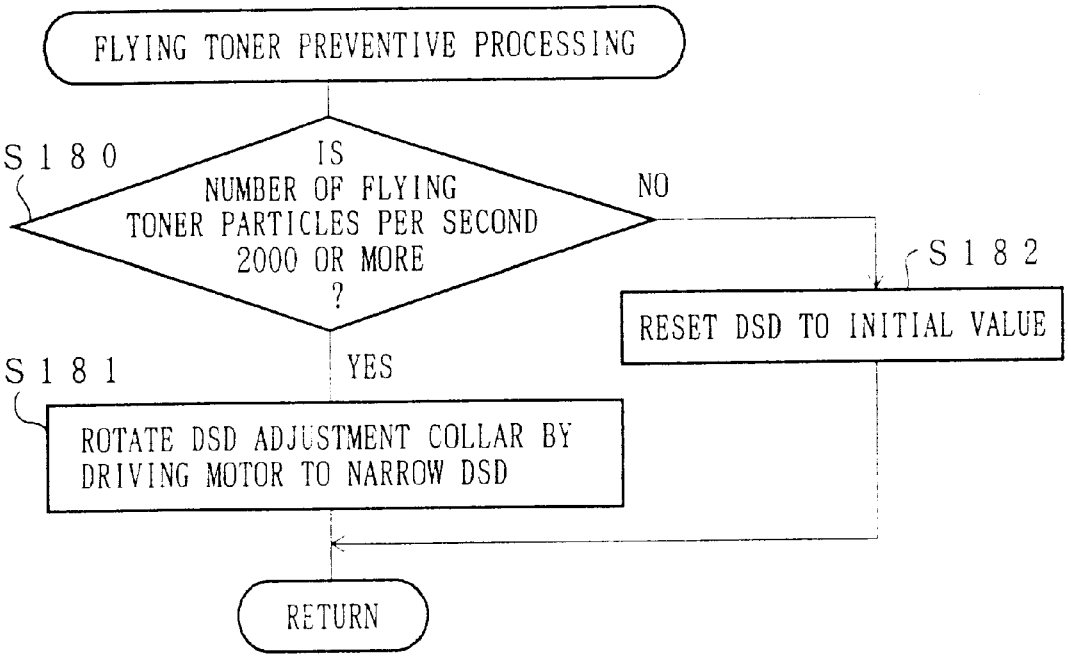
FIG. 39 is a flow chart showing a routine of flying toner preventive processing performed by the control unit when narrowing the distance DSD in the development controlling section.
Figure 40A:
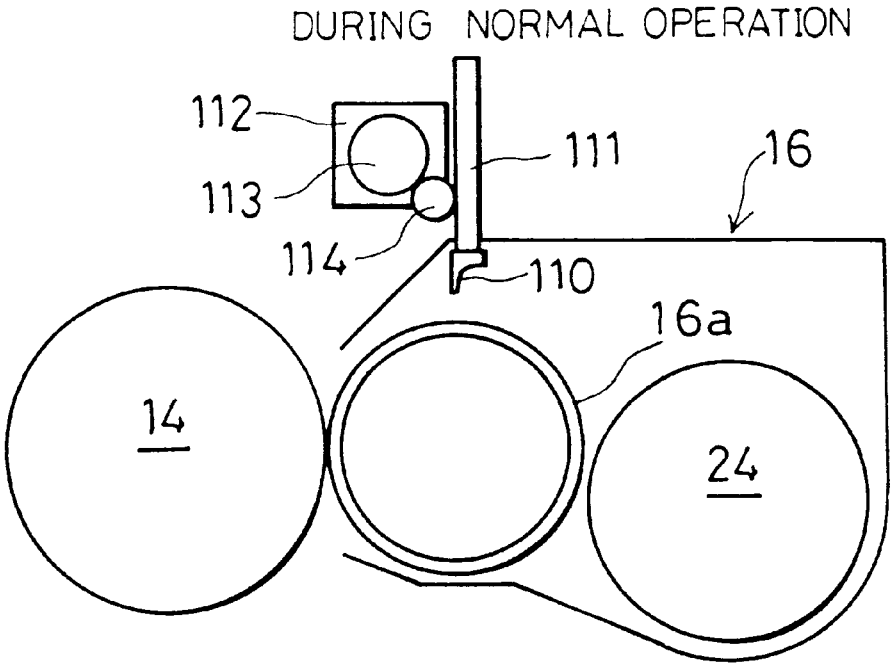
FIG. 40(*a*) is an explanatory view showing a normal state of a development gap set by a device for changing the development gap with a doctor in the copying machine, and FIG. 40(*b*) is an explanatory view showing a state of the development gap set by the device during the flying toner preventive processing.
Figure 40B:
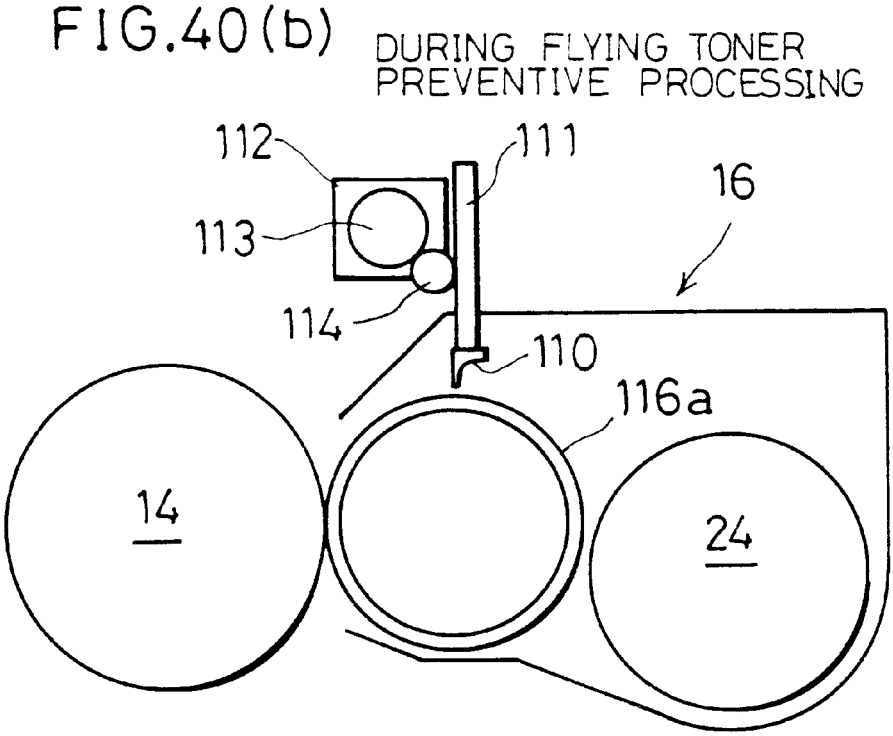

The control performed by the development controlling section 53 is specifically shown in the flow chart of FIG. 39. As shown in FIG. 39, first, the development controlling section 53 judges whether the number of flying toner particles per second is not less than 2000 (S180). If the number of flying toner particles per second is not less than 2000, the development controlling section 53 controls the driving motor 104 to rotate the DSD adjustment collar 101 so as to narrow the DSD.

On the other hand, if the number of flying toner particles per second is less than 2000 in S180, the DSD is reset to the initial value (S182).

Thus, by narrowing the distance DSD between the development roller 16*a* and the photoreceptor drum 14, the space between the development roller 16*a* and the photoreceptor drum 14 is decreased, and the amount of floating toner is reduced. This structure differs from other structures that indirectly prevent the toner from flying by increasing the amount of electrostatic charges of the developer. Namely, this structure can directly prevent the toner from flying in real time by changing the distance DSD in a moment.

Next, the control of a development gap is discussed. This control is performed so as to narrow a development gap that is a distance between the development roller 16*a* and a doctor 110 by a unit of 0.1 mm from the normal state shown in FIG. 40(*a*) to a state shown in FIG. 40(*b*) according to a value detected by the fling toner detecting device 40. The doctor 110 is a developer rise regulating member for regulating the amount of the developer raised by the development roller 16*a*.

In this embodiment, in order to vary the development gap between the doctor 110 and the development roller 16*a*, the doctor 110 is mounted on the lower edge of a lack gear 111. The lack gear 111 is moved up and down by a driving motor 112 through gears 113 and 114 so that the development gap is varied by a unit of 0.1 mm. The lack gear 111, the driving motor 112 and the gears 113 and 114 form regulating member moving means.

Figure 41:
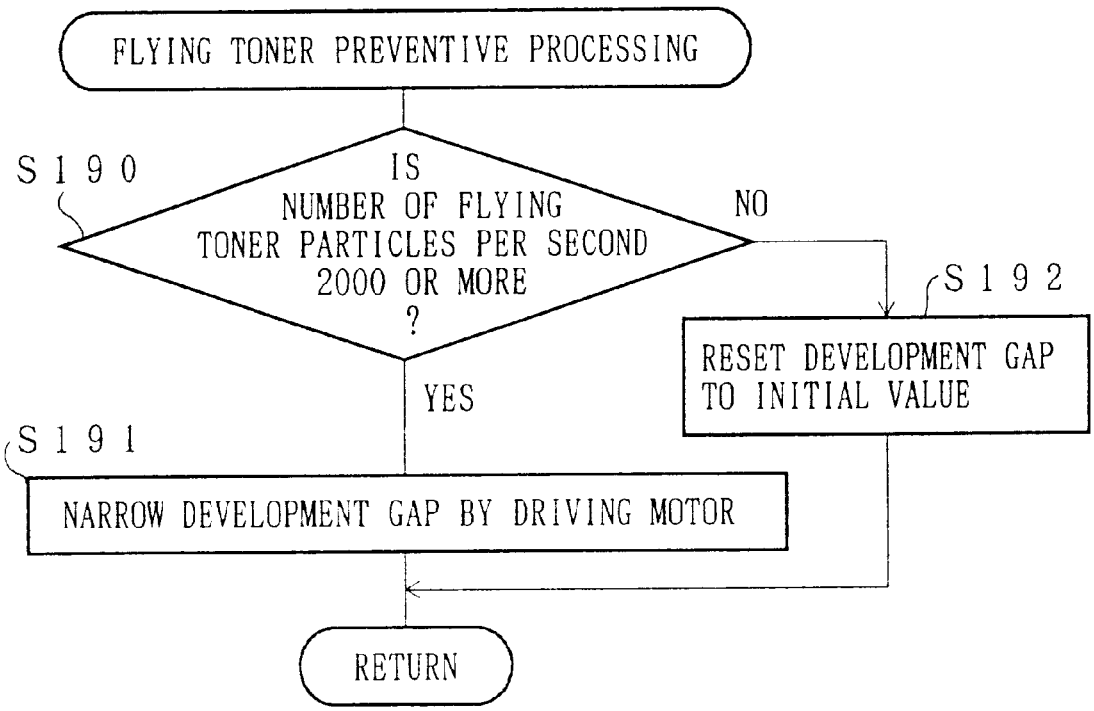
FIG. 41 is a flow chart of the flying toner preventive processing performed in the structure shown in FIGS. 40(*a*) and 40(*b*).
Figure 42:
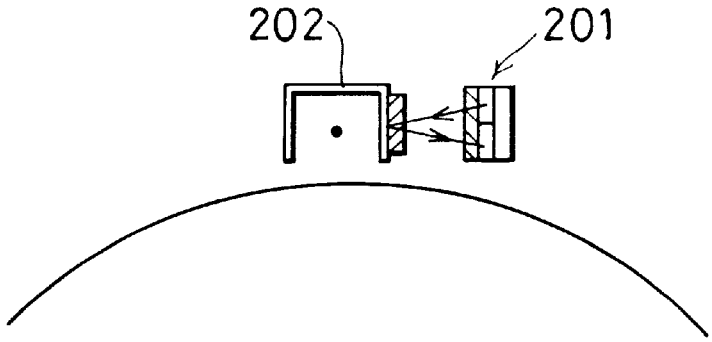
FIG. 42 PRIOR ART
FIG. 42 is an explanatory view showing the structure of a conventional flying toner detecting device in a copying machine.
Figure 43:
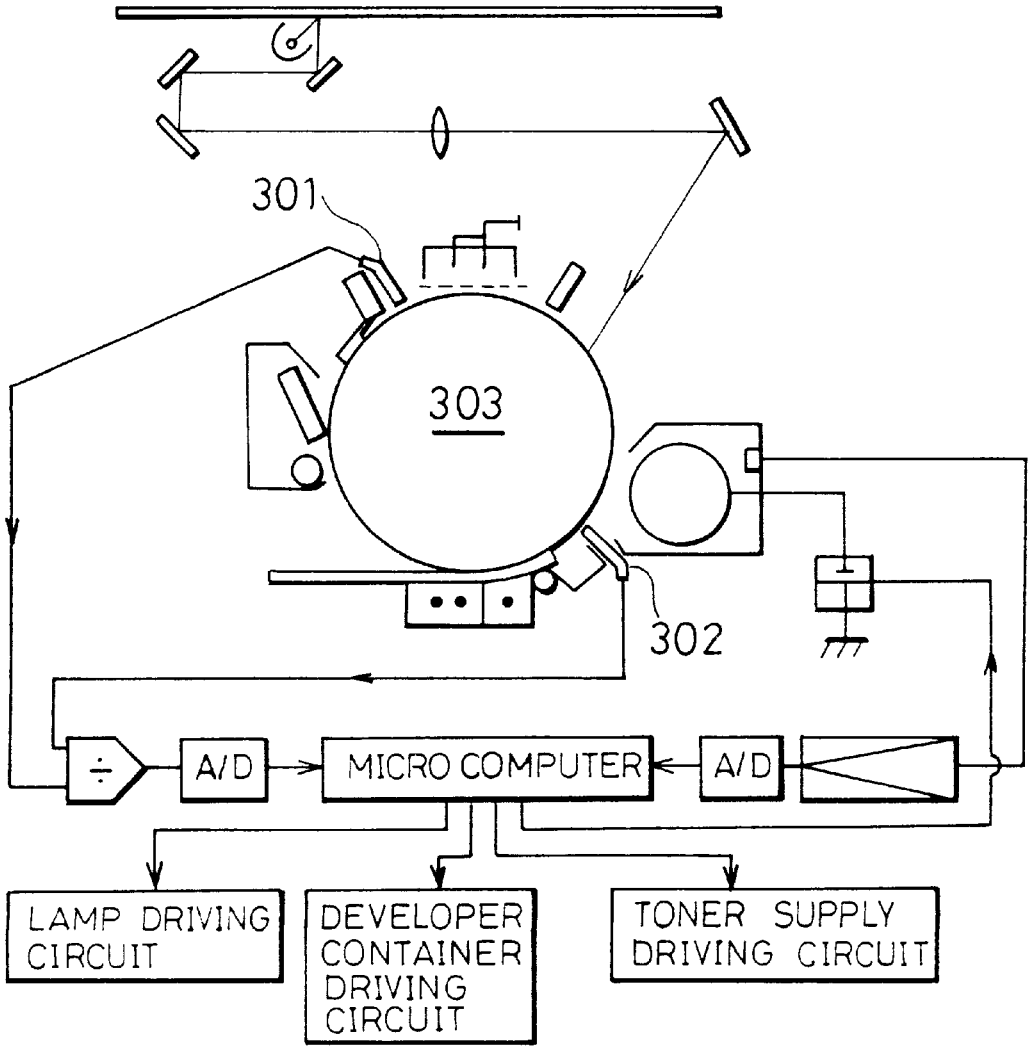
FIG. 43 PRIOR ART
FIG. 43 is an explanatory view showing the structure of another conventional flying toner detecting device in a copying machine.

The control performed by the development controlling section 53 is specifically shown in the flow chart of FIG. 41.

As shown in FIG. 41, first, the development controlling section 53 judges whether the number of flying toner particles per second is not less than 2000 (S190). If the number of flying toner particles per second is not less than 2000, the development controlling section 53 controls the driving motor 112 to narrow the development gap .(S191). On the other hand, if the number of flying toner particles per second is less than 2000 in S190, the development gap is reset to the initial value (S192).

Thus, by narrowing the development gap, the amount of toner injected from the development container 28 is decreased and the amount of flying toner is reduced. This structure differs from the other structures that indirectly prevent the toner from flying by increasing the amount of electrostatic charges of the developer. Namely, this structure can directly prevent the toner from flying in real time by varying the development gap in a moment. Moreover, not only the amount of the flying toner is reduced, but also the rise of the developer is shortened. Therefore, the developer strikes on the photoreceptor drum 14 softly. Consequently, the life of the photoreceptor drum 14 increases, and the development of a latent image is improved, resulting in better image quality.

As described above, in the copying machine 1 of this embodiment, it is possible to surely prevent the toner from flying by the development controlling section 53 for performing development control, for example, the application of a DC voltage, the application of a charging blade bias voltage, the generation of pressure of the charging blade, the DSD control, and the development gap control.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a development device for supplying developer to a latent image formed on a surface of a recording medium to develop the latent image;

flying toner detecting means for directing detecting an amount of airborne toner particles flying from said development device; and controlling means for shifting a set value relating to the airborne toner particles in a direction of reducing the airborne toner particles when an amount of the airborne toner particles detected by said flying toner detecting means reaches or exceeds a predetermined value.

2. An image forming apparatus comprising:

a development device including a toner containing section, a development roller, installed in said toner containing section, for supplying developer to a latent image formed on a surface of a recording medium to develop the latent image, and agitating means, installed in said toner containing section, for supplying toner to said development roller and for agitating toner in said toner containing section;

flying toner detecting means for directly detecting an amount of airborne toner particles flying from said development device; and controlling means for controlling agitation of toner performed by said agitating means in response to a result of a detection performed by said flying toner detecting means.

3. The image forming apparatus as set forth in claim 2, wherein said flying toner detecting means is formed by a particle counter.

4. The image forming apparatus as set forth in claim 2, wherein said flying toner detecting means includes an optical sensor having a light emitting section for applying light to a lower position of a toner supply opening section in a body of said development device, and a light receiving section for receiving reflected light and converting the reflected light into an electric signal.

5. An image forming apparatus comprising:

a development device including a toner containing section, a development roller, installed in said toner containing section, for supplying developer to a latent image formed on a surface of a recording medium to develop the latent image, and agitating means, installed in said toner containing section, for supplying toner to said development roller and for agitating toner in said toner containing section;

flying toner detecting means for detecting an amount of airborne toner particles flying from said development device; and controlling means for controlling agitation of toner performed by said agitating means in response to a result of a detection performed by said flying toner detecting means, further comprising a plurality of charging means disposed to face said recording medium, each of said charging means including a discharging section and a shielding member disposed around said discharging section, wherein said recording medium forms a latent image by removing charges from said recording medium after charging, and said flying toner detecting means includes current detecting means for detecting a current flowing through said shielding member of one of said charging means located closest to said development device.

6. The image forming apparatus as set forth in claim 2, wherein said flying toner detecting means includes:

an exhaust port formed in said image forming apparatus;

an exhaust filter, installed in said exhaust port, for collecting airborne toner particles an exhaust fan for discharging air in said image forming apparatus through said exhaust filter; and a pressure sensor provided between said exhaust fan and said exhaust filter.

7. The image forming apparatus as set forth in claim 2, wherein said flying toner detecting means includes:

an exhaust port formed in said image forming apparatus; and an exhaust filter, installed in said exhaust port, for collecting airborne toner particles;

an exhaust fan for discharging air in said image forming apparatus through said exhaust filter; and wherein said flying toner detecting means detects a change in an electrical resistance of said exhaust filter.

8. The image forming apparatus as set forth in claim 2, wherein said flying toner detecting means is installed in a lower position of said development device.

9. The image forming apparatus as set forth in claim 2, wherein said controlling means executes a control operation based on a result of detection performed by said flying toner detecting means at a predetermined time between a start of supplying toner to a toner supply section for supplying the toner to said toner containing section and just after a completion of the supply of the toner.

10. The image forming apparatus as set forth in claim 9, wherein said controlling means further executes a control operation based on a result of a detection performed by said flying toner detecting means when the amount of electrostatic charges of the toner is recognized as being stabilized after the completion of the supply of the toner to said toner supply section.

11. The image forming apparatus as set forth in claim 2, wherein said agitating means performs a pre-agitating operation that is an agitation operation performed before starting an image forming operation, and said controlling means further executes a control operation based on a result of a detection performed by said flying toner detecting means at a predetermined time between a start of the pre-agitating operation of said agitating means and a start of the image forming operation.

12. The image forming apparatus as set forth in claim 2, further comprising toner consumption detecting means, wherein said controlling means executes a control operation based on a result of a detection performed by said flying toner detecting means when a consumption of toner detected by said toner consumption detecting means reaches or exceeds a predetermined value.

13. The image forming apparatus as set forth in claim 2, further comprising:

toner collecting means for collecting residual toner on the surface of said recording medium; and collected toner detecting means for detecting an amount of toner collected by said toner collecting means, wherein said controlling means performs a control operation based on a result of a detection performed by said flying toner detecting means when an amount of the toner collected per unit time which is detected by said collected toner detecting means reaches or exceeds a predetermined value.

14. The image forming apparatus as set forth in claim 2, wherein said controlling means performs a control operation based on a result of a detection performed by said flying toner detecting means when a time in which said image forming apparatus is being stopped reaches or exceeds a predetermined time.

15. The image forming apparatus as set forth in claim 2, further comprising document density detecting means, wherein said controlling means performs a control operation based on a result of a detection performed by said flying toner detecting means when a document density detected by said document density detecting means is higher than a reference document density by an amount not smaller than a predetermined amount.

16. The image forming apparatus as set forth in claim 2, further comprising temperature detecting means, wherein said controlling means performs a control operation based on a result of a detection performed by said flying toner detecting means when a temperature detected by said temperature detecting means reaches or exceeds a predetermined value.

17. The image forming apparatus as set forth in claim 2, further comprising humidity detecting means, wherein said controlling means performs a control operation based on a result of a detection performed by said flying toner detecting means when a humidity detected by said humidity detecting means reaches or exceeds a predetermined value.

18. The image forming apparatus as set forth in claim 2, wherein said controlling means performs a control operation based on a result of a detection performed by said flying toner detecting means when an agitation time of said agitating means reaches or exceeds a predetermined time.

19. The image forming apparatus as set forth in claim 2, wherein said controlling means increases an agitation speed of said agitating means when an amount of airborne toner particles detected by said flying toner detecting means reaches or exceeds a predetermined value.

20. The image forming apparatus as set forth in claim 2, wherein said controlling means extends an operation time of said agitating means when an amount of airborne toner particles detected by said flying toner detecting means reaches or exceeds a predetermined value.

21. An image forming apparatus comprising:

a development device including a toner containing section, agitating means for agitating toner in said toner containing section, toner density detecting means for detecting a toner density in said toner containing section, a toner supply section for supplying toner into said toner containing section in response to a result of a detection performed by said toner density detecting means, said development device developing a latent image formed on a surface of a recording medium with the toner in said toner containing section, flying toner detecting means for directly detecting an amount of airborne toner particles flying from said development device, and controlling means for controlling a toner supply operation performed by said toner supply section in response to a result of a detection executed by said flying toner detecting means.

22. The image forming apparatus as set forth in claim 21, wherein said flying toner detecting means is formed by a particle counter.

23. The image forming apparatus as set forth in claim 21, wherein said flying toner detecting means includes an optical sensor having a light emitting section for applying light to a lower position of a toner supply opening section in a body of said development device, and a light receiving section for receiving reflected light and converting the reflected light into an electric signal.

24. An image forming apparatus comprising:

a development device including a toner containing section, agitating means for agitating toner in said toner containing section, toner density detecting means for detecting a toner density in said toner containing section, a toner supply section for supplying toner into said toner containing section in response to a result of a detection performed by said toner density detecting means, said development device developing a latent image formed on a surface of a recording medium with the toner in said toner containing section, flying toner detecting means for detecting an amount of airborne toner particles flying from said development device, and controlling means for controlling a toner supply operation performed by said toner supply section in response to a result of a detection executed by said flying toner detecting means, further comprising a plurality of charging means disposed to face said recording medium, each of said charging means including a discharging section and a shielding member disposed around said discharging section, wherein said recording medium forms a latent image by removing charges from said recording medium after charging, and said flying toner detecting means includes current detecting means for detecting a current flowing through said shielding member of one of said charging means located closest to said development device.

25. The image forming apparatus as set forth in claim 21, wherein said flying toner detecting means includes:

an exhaust port formed in said image forming apparatus;

an exhaust filter, installed in said exhaust port, for collecting airborne toner particles;

an exhaust fan for discharging air in said image forming apparatus through said exhaust filter; and a pressure sensor provided between said exhaust fan and said exhaust filter.

26. The image forming apparatus as set forth in claim 21, wherein said flying toner detecting means includes:

an exhaust port formed in said image forming apparatus; and an exhaust filter, installed in said exhaust port, for collecting airborne toner particles;

an exhaust fan for discharging air in said image forming apparatus through said exhaust filter; and wherein said flying toner detecting means detects a change in an electrical resistance of said exhaust filter.

27. The image forming apparatus as set forth in claim 21, wherein said flying toner detecting means is installed in a lower position of said development device.

28. The image forming apparatus as set forth in claim 21, wherein said controlling means executes a control operation based on a result of a detection performed by said flying toner detecting means at a predetermined time between a start of supplying toner to a toner supply section for supplying the toner to said toner containing section and just after a completion of the supply of the toner.

29. The image forming apparatus as set forth in claim 28, wherein said controlling means further executes a control operation based on a result of a detection performed by said flying toner detecting means when the amount of electrostatic charges of the toner is recognized as being stabilized after the completion of the supply of the toner to said toner supply section.

30. The image forming apparatus as set forth in claim 21, wherein said agitating means performs a pre-agitating operation that is an agitation operation performed before starting an image forming operation, and said controlling means further executes a control operation based on a result of a detection performed by said flying toner detecting means at a predetermined time between a start of the pre-agitating operation of said agitating means and a start of the image forming operation.

31. The image forming apparatus as set forth in claim 21, further comprising toner consumption detecting means, wherein said controlling means executes a control operation based on a result of a detection performed by said flying toner detecting means when a consumption of toner detected by said toner consumption detecting means reaches or exceeds a predetermined value.

32. The image forming apparatus as set forth in claim 21, further comprising:

toner collecting means for collecting residual toner on the surface of said recording medium; and collected toner detecting means for detecting an amount of toner collected by said toner collecting means, wherein said controlling means performs a control operation based on a result of a detection performed by said flying toner detecting means when an amount of the toner collected per unit time which is detected by said collected toner detecting means reaches or exceeds a predetermined value.

33. The image forming apparatus as set forth in claim 21, wherein said controlling means performs a control operation based on a result of a detection performed by said flying toner detecting means when a time in which said image forming apparatus is being stopped reaches or exceeds a predetermined time.

34. The image forming apparatus as set forth in claim 21, further comprising document density detecting means, wherein said controlling means performs a control operation based on a result of a detection performed by said flying toner detecting means when a document density detected by said document density detecting means is higher than a reference document density by an amount not smaller than a predetermined amount.

35. The image forming apparatus as set forth in claim 21, further comprising temperature detecting means, wherein said controlling means performs a control operation based on a result of a detection performed by said flying toner detecting means when a temperature detected by said temperature detecting means reaches or exceeds a predetermined value.

36. The image forming apparatus as set forth in claim 21, further comprising humidity detecting means, wherein said controlling means performs a control operation based on a result of a detection performed by said flying toner detecting means when a humidity detected by said humidity detecting means reaches or exceeds a predetermined value.

37. The image forming apparatus as set forth in claim 21, wherein said controlling means performs a control operation based on a result of a detection performed by said flying toner detecting means when an agitation time of said agitating means reaches or exceeds a predetermined time.

38. The image forming apparatus as set forth in claim 21, wherein said controlling means increases an agitation speed of said agitating means when an amount of airborne toner particles detected by said flying toner detecting means reaches or exceeds a predetermined value.

39. The image forming apparatus as set forth in claim 21, wherein said controlling means extends an operation time of said agitating means when an amount of airborne toner particles detected by said flying toner detecting means reaches or exceeds a predetermined value.

40. The image forming apparatus as set forth in claim 21, wherein said controlling means controls an amount of toner supplied by said toner supply section per unit time to be reduced when an amount of airborne toner particles detected by said flying toner detecting means reaches or exceeds a predetermined value.

41. The image forming apparatus as set forth in claim 40, wherein said controlling means controls said toner supply section to perform an intermittent toner supply operation.

42. The image forming apparatus as set forth in claim 21, wherein said toner supply section performs a toner supply operation when a toner density detected by said toner density detecting means is not higher than a reference toner density, and said controlling means controls the reference toner density to be lowered when an amount of airborne toner particles detected by said flying toner detecting means reaches or exceeds a predetermined value.

43. The image forming apparatus as set forth in claim 21, wherein said controlling means executes a control operation based on a result of a detection performed by said flying toner detecting means when an image forming operation which has been stopped is resumed and when a value detected by said toner density detecting means changes by an amount equal to or larger than a predetermined value from a value when the image forming operation is stopped.

44. The image forming apparatus as set forth in claim 21, wherein when an image forming operation is resumed after being stopped, said controlling means executes a control operation based on a result of a detection performed by said flying toner detecting means when a value detected by said toner density detecting means changes from a value which was detected at the time the image forming operation is being stopped and enters into a stable state.

45. An image forming apparatus comprising:

a development device including a toner containing section, a development roller, installed in said toner containing section, for supplying developer to a latent image formed on a surface of a recording medium to develop the latent image, agitating means, installed in said toner containing section, for supplying toner to said development roller and for agitating toner in said toner containing section;

flying toner detecting means for directly detecting an amount of airborne toner particles flying from said development device; and controlling means for controlling adhesion of toner to said development roller in response to a result of a detection performed by said flying toner detecting means.

46. The image forming apparatus as set forth in claim 45, wherein said flying toner detecting means is formed by a particle counter.

47. The image forming apparatus as set forth in claim 45, wherein said flying toner detecting means includes an optical sensor having a light emitting section for applying light to a lower position of a toner supply opening section in a body of said development device, and a light receiving section for receiving reflected light and converting the reflected light into an electric signal.

48. An image forming apparatus comprising:

a development device including a toner containing section, a development roller, installed in said toner containing section, for supplying developer to a latent image formed on a surface of a recording medium to develop the latent image, agitating means, installed in said toner containing section, for supplying toner to said development roller and for agitating toner in said toner containing section;

flying toner detecting means for detecting an amount of airborne toner particles flying from said development device; and controlling means for controlling adhesion of toner to said development roller in response to a result of a detection performed by said flying toner detecting means, further comprising a plurality of charging means disposed to face said recording medium, each of said charging means including a discharging section and a shielding member disposed around said discharging section, wherein said recording medium forms a latent image by removing charges from said recording medium after charging, said flying toner detecting means includes current detecting means for detecting a current flowing through said shielding member of one of said charging means located closest to said development device.

49. The image forming apparatus as set forth in claim 45, wherein said flying toner detecting means includes:

an exhaust port formed in said image forming apparatus;

an exhaust filter, installed in said exhaust port, for collecting airborne toner particles;

an exhaust fan for discharging air in said image forming apparatus through said exhaust filter; and a pressure sensor provided between said exhaust fan and said exhaust filter.

50. The image forming apparatus as set forth in claim 45, wherein said flying toner detecting means includes:

an exhaust port formed in said image forming apparatus; and an exhaust filter, installed in said exhaust port, for collecting airborne toner particles;

an exhaust fan for discharging air in said image forming apparatus through said exhaust filter; and wherein said flying toner detecting means detects a change in an electrical resistance of said exhaust filter.

51. The image forming apparatus as set forth in claim 45, wherein said flying toner detecting means is installed in a lower position of said development device.

52. The image forming apparatus as set forth in claim 45, wherein said controlling means executes a control operation based on a result of a detection performed by said flying toner detecting means at a predetermined time between a start of supplying toner to a toner supply section for supplying the toner to said toner containing section and just after a completion of the supply of the toner.

53. The image forming apparatus as set forth in claim 47, wherein said controlling means further executes a control operation based on a result of a detection performed by said flying toner detecting means when the amount of electrostatic charges of the toner is recognized as being stabilized after the completion of the supply of the toner to said toner supply section.

54. The image forming apparatus as set forth in claim 45, wherein said agitating means performs a pre-agitating operation that is an agitation operation performed before starting an image forming operation, and said controlling means further executes a control operation based on a result of a detection performed by said flying toner detecting means at a predetermined time between a start of the pre-agitating operation of said agitating means and a start of the image forming operation.

55. The image forming apparatus as set forth in claim 46, further comprising toner consumption detecting means, wherein said controlling means executes a control operation based on a result of a detection performed by said flying toner detecting means when a consumption of toner detected by said toner consumption detecting means reaches or exceeds a predetermined value.

56. The image forming apparatus as set forth in claim 45, further comprising:

toner collecting means for collecting residual toner on the surface of said recording medium; and collected toner detecting means for detecting an amount of toner collected by said toner collecting means, wherein said controlling means performs a control operation based on a result of a detection performed by said flying toner detecting means when an amount of the toner collected per unit time which is detected by said collected toner detecting means reaches or exceeds a predetermined value.

57. The image forming apparatus as set forth in claim 45, wherein said controlling means performs a control operation based on a result of a detection performed by said flying toner detecting means when a time in which said image forming apparatus is being stopped reaches or exceeds a predetermined time.

58. The image forming apparatus as set forth in claim 45, further comprising document density detecting means, wherein said controlling means performs a control operation based on a result of a detection performed by said flying toner detecting means when a document density detected by said document density detecting means is higher than a reference document density by an amount not smaller than a predetermined amount.

59. The image forming apparatus as set forth in claim 47, further comprising temperature detecting means, wherein said controlling means performs a control operation based on a result of a detection performed by said flying toner detecting means when a temperature detected by said temperature detecting means reaches or exceeds a predetermined value.

60. A The image forming apparatus as set forth in claim 47, further comprising humidity detecting means, wherein said controlling means performs a control operation based on a result of a detection performed by said flying toner detecting means when a humidity detected by said humidity detecting means reaches or exceeds a predetermined value.

61. The image forming apparatus as set forth in claim 45, wherein said controlling means performs a control operation based on a result of a detection performed by said flying toner detecting means when an agitation time of said agitating means reaches or exceeds a predetermined time.

62. The image forming apparatus as set forth in claim 45, wherein said controlling means increases an agitation speed of said agitating means when an amount of airborne toner particles detected by said flying toner detecting means reaches or exceeds a predetermined value.

63. The image forming apparatus as set forth in claim 45, wherein said controlling means extends an operation time of said agitating means when an amount of airborne toner particles detected by said flying toner detecting means reaches or exceeds a predetermined value.

64. The image forming apparatus as set forth in claim 45, wherein said agitating means includes a supply roller for supplying toner to said development roller, said development roller and said supply roller being supplied with a voltage for imparting a predetermined amount of electrostatic charges to the toner so that said supply roller imparts to the toner an amount of electrostatic charges less than the predetermined amount of electrostatic charges in advance, and wherein said controlling means switches the voltage to be supplied to said supply roller into a voltage which has a polarity opposite to a polarity in which the toner is charged and is higher than the applied voltage in a direction of the opposite polarity when an amount of airborne toner particles detected by said flying toner detecting means reaches or exceeds a predetermined value.

65. The image forming apparatus as set forth in claim 45, further comprising a charging blade for charging toner passing through a section between an edge section of said charging blade and a member facing said edge section, said charging blade being supplied with a voltage for imparting predetermined amount of electrostatic charges to toner, wherein said controlling means switches the voltage to be supplied to said charging blade to a voltage which has a polarity opposite to a polarity in which the toner is charged and is higher than the supplied voltage in a direction of the opposite polarity when an amount of airborne toner particles detected by said flying toner detecting means reaches or exceeds a predetermined value.

66. The image forming apparatus as set forth in claim 45, further comprising:

a charging blade for charging toner passing through a section between an edge section of said charging blade and a member facing said edge section; and pressure adjusting means for adjusting a pressure of said charging blade to be applied to said member facing said edge section of said charging blade, wherein said controlling means controls said pressure adjusting means to increase the pressure of said charging blade to be applied to said member facing said edge section of said charging blade when an amount of airborne toner particles detected by said flying toner detecting means reaches or exceeds a predetermined value.

67. The image forming apparatus as set forth in claim 45, further comprising distance adjusting means for adjusting a distance between said recording medium and said development roller, wherein said controlling means controls said distance adjusting means to narrow the distance between said recording medium and said development roller when an amount of airborne toner particles detected by said flying toner detecting means reaches or exceeds a predetermined value.

68. The image forming apparatus as set forth in claim 45, further comprising:

developer rise regulating means for regulating an amount of developer raised from the surface of said development roller; and regulating member moving means for moving forward and backward said developer rise regulating member in a direction opposite to said development roller, wherein said controlling means controls said regulating member moving means to move said developer rise regulating member in a direction approaching said development roller when an amount of airborne toner particles detected by said flying toner detecting means reaches or exceeds a predetermined value.

69. An image forming apparatus comprising:

a development device including a toner containing section, and a development roller to which a development bias voltage is applied and which attracts and transports toner contained in said toner containing section, said development device performing development by supplying the toner to a latent image formed on a surface of a recording medium through said development roller;

flying toner detecting means for directly detecting an amount of airborne toner particles flying from said development device; and controlling means for controlling the development bias voltage in response to a result of a detection performed by said flying toner detecting means.

70. An image forming apparatus comprising:

a development device for developing a latent image formed on a surface of a recording medium by supplying developer to the latent image;

flying toner detecting means for detecting an amount of airborne toner particles flying from said development device; and controlling means for shifting a set value relating to airborne toner particles in a direction of reducing an amount of the airborne toner particles when the amount of the airborne toner particles detected by said flying toner detecting means reaches or exceeds a predetermined value, and for resetting the set value relating to airborne toner particles to an initial state when an amount of the airborne toner particles detected thereafter by said flying toner detecting means is less than the predetermined value.

* * * * *